US006973876B2

(12) United States Patent
Nakano et al.

(10) Patent No.: US 6,973,876 B2
(45) Date of Patent: Dec. 13, 2005

(54) METHOD AND APPARATUS FOR PLATE CHANGING IN A PLATE CYLINDER OF A PRINTING PRESS

(75) Inventors: Takeaki Nakano, Noda (JP); Yoshiyuki Ueno, Noda (JP); Kazunori Takeda, Noda (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/874,248

(22) Filed: Jun. 24, 2004

(65) Prior Publication Data

US 2005/0005796 A1 Jan. 13, 2005

(30) Foreign Application Priority Data

Jun. 26, 2003 (JP) ..... 2003-182366

(51) Int. Cl.[7] ..... B41F 13/08; B41F 5/00
(52) U.S. Cl. ..... 101/477; 101/484; 101/247
(58) Field of Search ..... 101/477, 484, 101/247, 479, 480, 483, 216

(56) References Cited

U.S. PATENT DOCUMENTS 5,983,793 A * 11/1999 Volz et al. ..... 101/216
6,598,528 B2 * 7/2003 Nakano et al. ..... 101/484
6,814,003 B2 * 11/2004 Tobe et al. ..... 101/477

FOREIGN PATENT DOCUMENTS

| | | | | |
|---|---|---|---|---|
| EP | 1348551 A2 | | 10/2003 | |
| JP | 59-042957 | * | 3/1984 | ..... B41F/5/24 |
| JP | 2704558 B2 | | 10/1997 | |
| JP | 11-170486 A | | 6/1999 | |

* cited by examiner

*Primary Examiner*—Ren Yan
*Assistant Examiner*—Wasseem H. Hamdan
(74) *Attorney, Agent, or Firm*—Birch, Stewart, Kolasch & Birch, LLP

(57) ABSTRACT

A plate changing method and an apparatus for rotating all plate cylinders of a plurality of printing units by a drive device, and performing plate changing by plate changing unit provided in correspondence with the plate cylinders has an abnormality detection step of detecting presence or absence of a plate changing abnormality by detectors provided in correspondence with the plate cylinders, a step of stopping the drive device when the plate changing abnormality is detected in the abnormality detection step, a return step of controlling at least one of the drive device and the plate changing unit of a normal unit, other than an error unit in which the plate changing abnormality has been detected, in accordance with the status of progress of plate changing in the normal unit after the stop step, and an error elimination step of eliminating the plate changing abnormality in the error unit after the stop step.

24 Claims, 33 Drawing Sheets

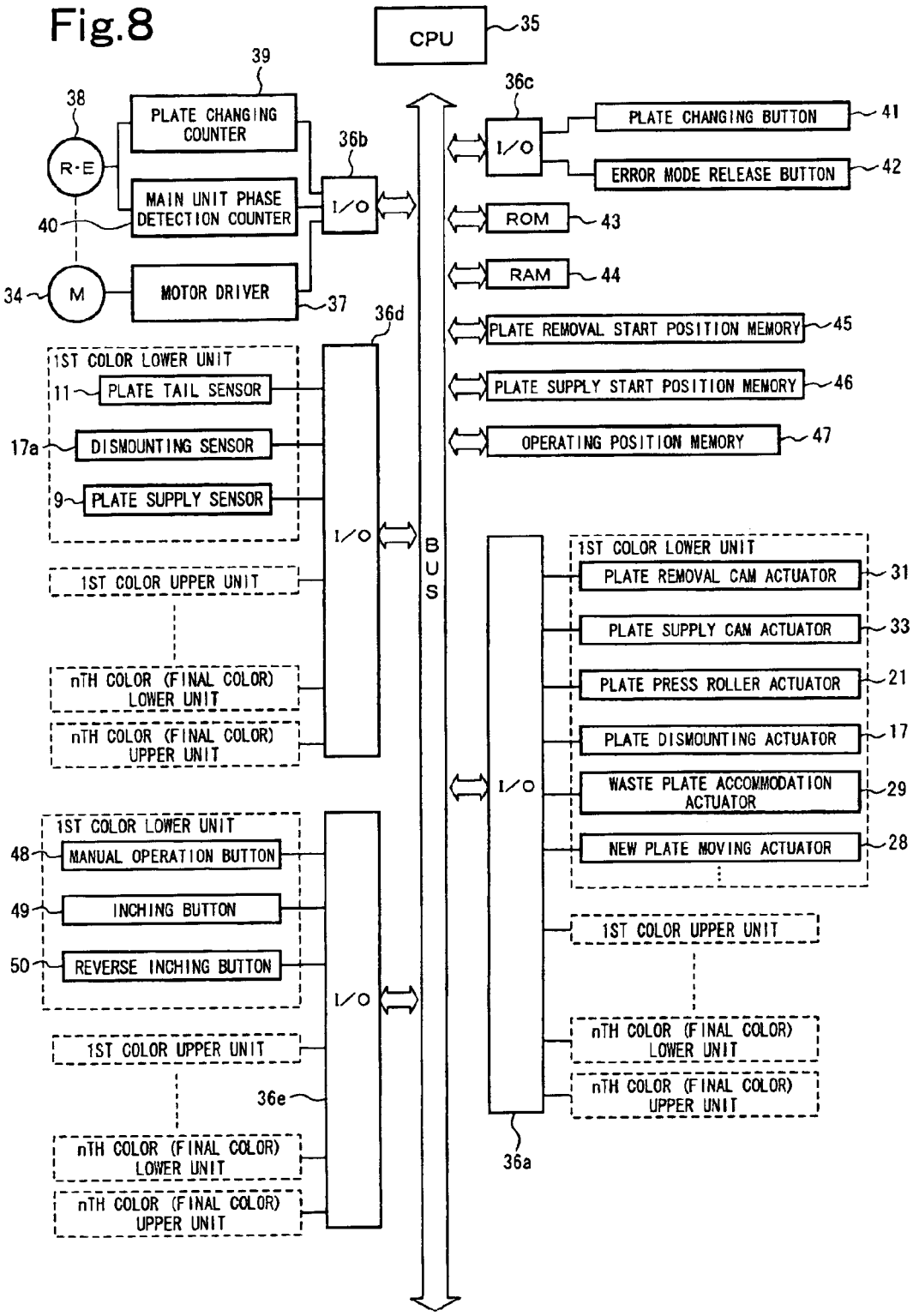
Fig.8
CPU
35
39
38
PLATE CHANGING COUNTER
R·E
36b
MAIN UNIT PHASE DETECTION COUNTER
I/O
40
34
M
MOTOR DRIVER
37
36c
I/O
PLATE CHANGING BUTTON
41
ERROR MODE RELEASE BUTTON
42
ROM
43
RAM
44
PLATE REMOVAL START POSITION MEMORY
45
PLATE SUPPLY START POSITION MEMORY
46
OPERATING POSITION MEMORY
47
36d
1ST COLOR LOWER UNIT
11
PLATE TAIL SENSOR
17a
DISMOUNTING SENSOR
9
PLATE SUPPLY SENSOR
1ST COLOR UPPER UNIT
nTH COLOR (FINAL COLOR) LOWER UNIT
nTH COLOR (FINAL COLOR) UPPER UNIT
I/O
BUS
1ST COLOR LOWER UNIT
PLATE REMOVAL CAM ACTUATOR
31
PLATE SUPPLY CAM ACTUATOR
33
PLATE PRESS ROLLER ACTUATOR
21
PLATE DISMOUNTING ACTUATOR
17
WASTE PLATE ACCOMMODATION ACTUATOR
29
NEW PLATE MOVING ACTUATOR
28
1ST COLOR UPPER UNIT
nTH COLOR (FINAL COLOR) LOWER UNIT
nTH COLOR (FINAL COLOR) UPPER UNIT
36a
1ST COLOR LOWER UNIT
48
MANUAL OPERATION BUTTON
49
INCHING BUTTON
50
REVERSE INCHING BUTTON
1ST COLOR UPPER UNIT
36e
nTH COLOR (FINAL COLOR) LOWER UNIT
nTH COLOR (FINAL COLOR) UPPER UNIT

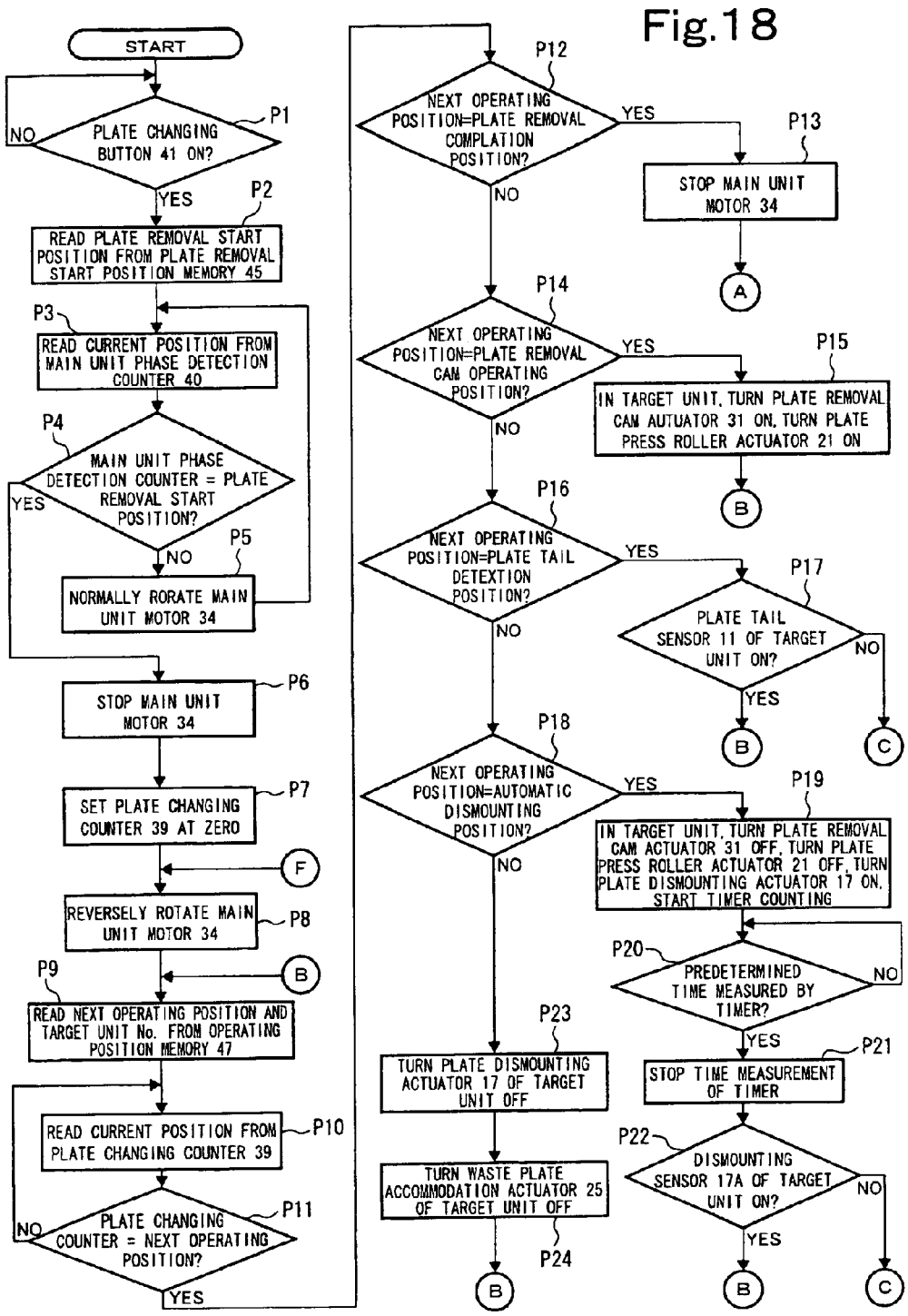
Fig.18
START
PLATE CHANGING BUTTON 41 ON?
P1
NO
YES
P2
READ PLATE REMOVAL START POSITION FROM PLATE REMOVAL START POSITION MEMORY 45
P3
READ CURRENT POSITION FROM MAIN UNIT PHASE DETECTION COUNTER 40
P4
MAIN UNIT PHASE DETECTION COUNTER = PLATE REMOVAL START POSITION?
YES
NO
P5
NORMALLY RORATE MAIN UNIT MOTOR 34
STOP MAIN UNIT MOTOR 34
P6
SET PLATE CHANGING COUNTER 39 AT ZERO
P7
F
REVERSELY ROTATE MAIN UNIT MOTOR 34
P8
B
P9
READ NEXT OPERATING POSITION AND TARGET UNIT No. FROM OPERATING POSITION MEMORY 47
READ CURRENT POSITION FROM PLATE CHANGING COUNTER 39
P10
PLATE CHANGING COUNTER = NEXT OPERATING POSITION?
P11
NO
YES
P12
NEXT OPERATING POSITION=PLATE REMOVAL COMPLATION POSITION?
YES
NO
P13
STOP MAIN UNIT MOTOR 34
A
P14
NEXT OPERATING POSITION=PLATE REMOVAL CAM OPERATING POSITION?
YES
NO
P15
IN TARGET UNIT, TURN PLATE REMOVAL CAM AUTUATOR 31 ON, TURN PLATE PRESS ROLLER ACTUATOR 21 ON
B
P16
NEXT OPERATING POSITION=PLATE TAIL DETEXTION POSITION?
YES
NO
P17
PLATE TAIL SENSOR 11 OF TARGET UNIT ON?
NO
YES
B
C
P18
NEXT OPERATING POSITION=AUTOMATIC DISMOUNTING POSITION?
YES
NO
P19
IN TARGET UNIT, TURN PLATE REMOVAL CAM ACTUATOR 31 OFF, TURN PLATE PRESS ROLLER ACTUATOR 21 OFF, TURN PLATE DISMOUNTING ACTUATOR 17 ON, START TIMER COUNTING
P20
PREDETERMINED TIME MEASURED BY TIMER?
NO
YES
P21
STOP TIME MEASUREMENT OF TIMER
P22
DISMOUNTING SENSOR 17A OF TARGET UNIT ON?
NO
YES
B
C
P23
TURN PLATE DISMOUNTING ACTUATOR 17 OF TARGET UNIT OFF
TURN WASTE PLATE ACCOMMODATION ACTUATOR 25 OF TARGET UNIT OFF
P24
B

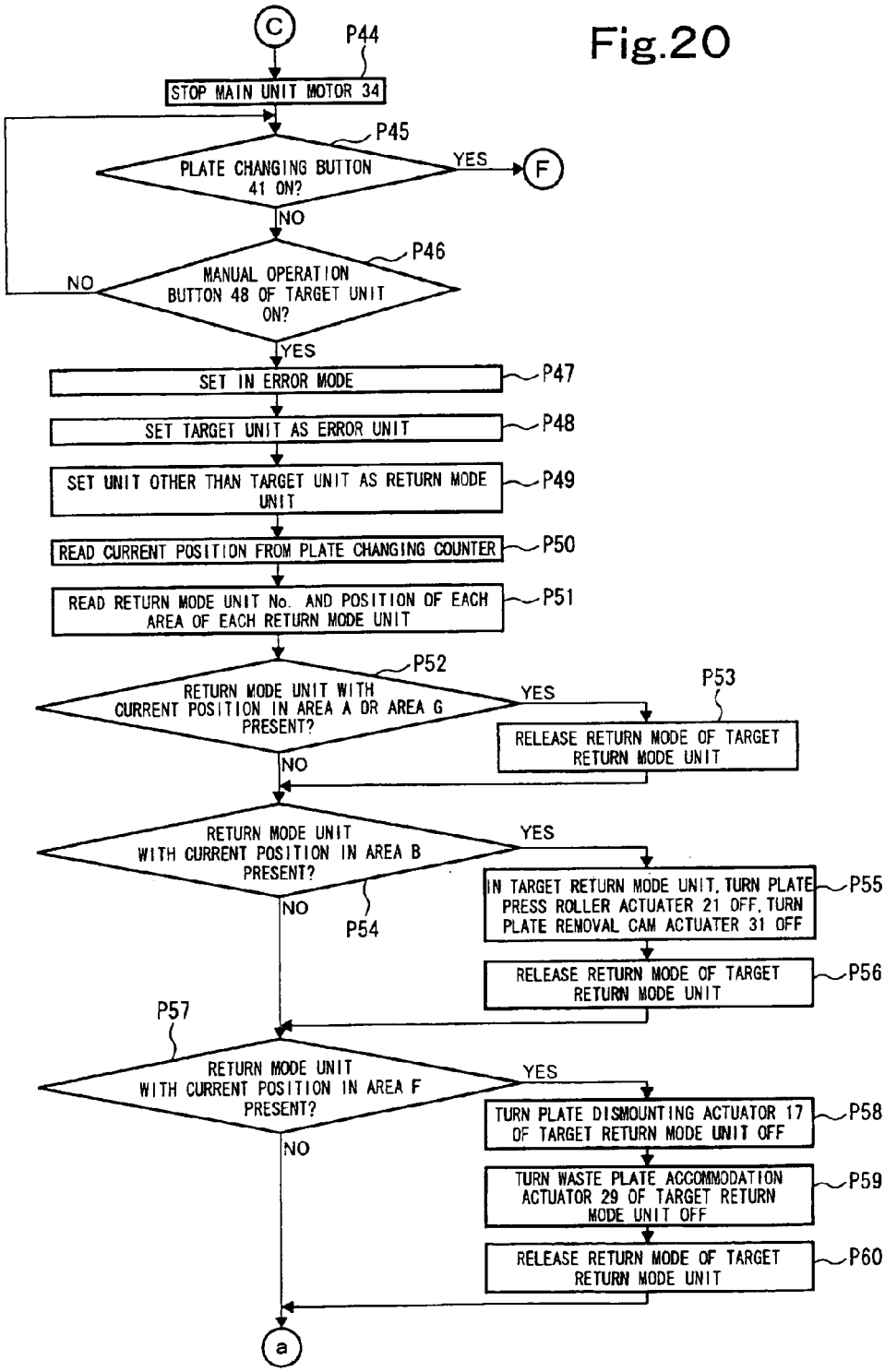
Fig.20
C
P44
STOP MAIN UNIT MOTOR 34
P45
PLATE CHANGING BUTTON 41 ON?
YES
F
NO
P46
MANUAL OPERATION BUTTON 48 OF TARGET UNIT ON?
NO
YES
SET IN ERROR MODE
P47
SET TARGET UNIT AS ERROR UNIT
P48
SET UNIT OTHER THAN TARGET UNIT AS RETURN MODE UNIT
P49
READ CURRENT POSITION FROM PLATE CHANGING COUNTER
P50
READ RETURN MODE UNIT No. AND POSITION OF EACH AREA OF EACH RETURN MODE UNIT
P51
P52
RETURN MODE UNIT WITH CURRENT POSITION IN AREA A OR AREA G PRESENT?
YES
P53
RELEASE RETURN MODE OF TARGET RETURN MODE UNIT
NO
RETURN MODE UNIT WITH CURRENT POSITION IN AREA B PRESENT?
YES
IN TARGET RETURN MODE UNIT, TURN PLATE PRESS ROLLER ACTUATER 21 OFF, TURN PLATE REMOVAL CAM ACTUATER 31 OFF
P55
NO
P54
RELEASE RETURN MODE OF TARGET RETURN MODE UNIT
P56
P57
RETURN MODE UNIT WITH CURRENT POSITION IN AREA F PRESENT?
YES
TURN PLATE DISMOUNTING ACTUATOR 17 OF TARGET RETURN MODE UNIT OFF
P58
NO
TURN WASTE PLATE ACCOMMODATION ACTUATOR 29 OF TARGET RETURN MODE UNIT OFF
P59
RELEASE RETURN MODE OF TARGET RETURN MODE UNIT
P60
a

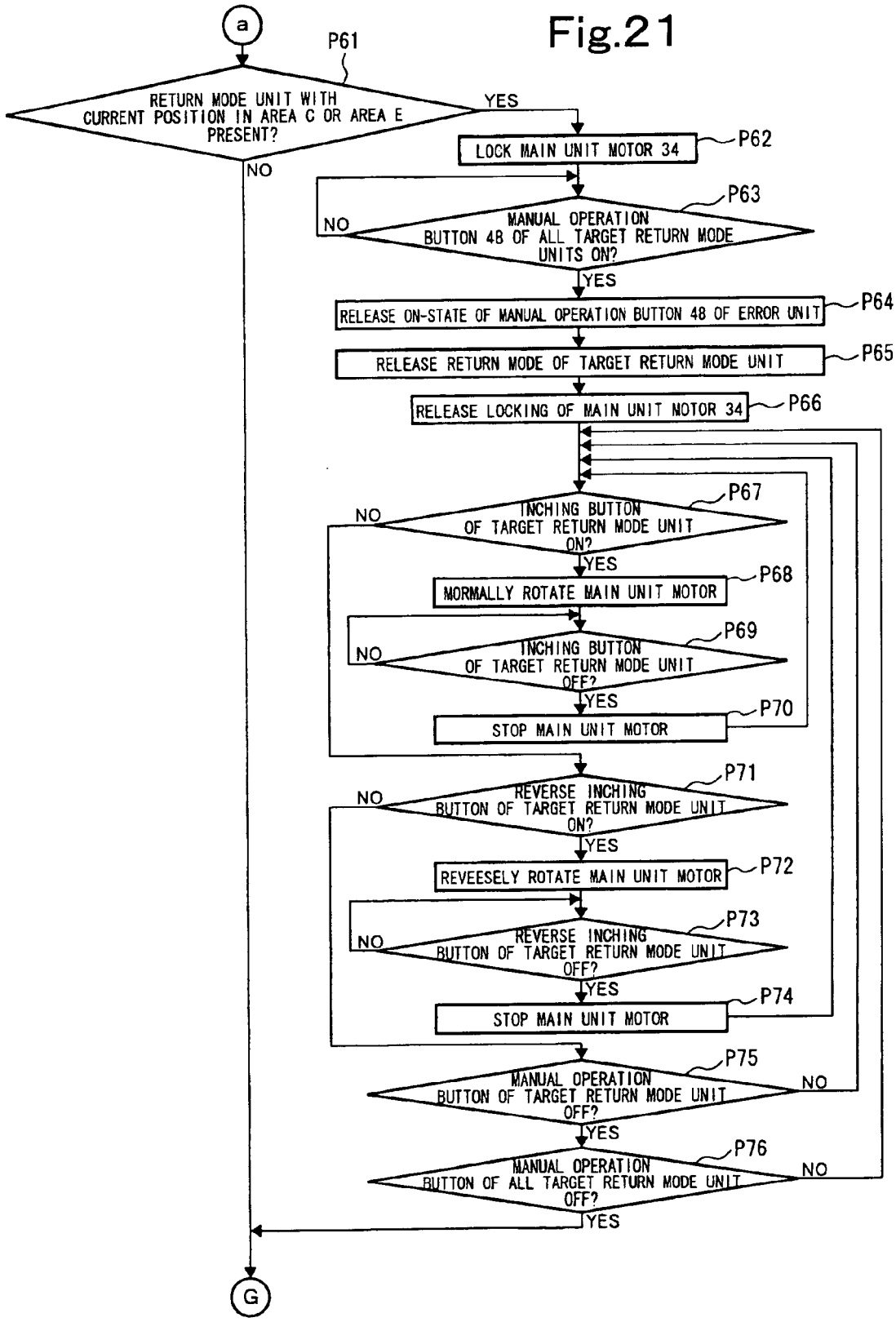
Fig.21
a
P61
RETURN MODE UNIT WITH CURRENT POSITION IN AREA C OR AREA E PRESENT?
YES
NO
LOCK MAIN UNIT MOTOR 34
P62
P63
MANUAL OPERATION BUTTON 48 OF ALL TARGET RETURN MODE UNITS ON?
NO
YES
RELEASE ON-STATE OF MANUAL OPERATION BUTTON 48 OF ERROR UNIT
P64
RELEASE RETURN MODE OF TARGET RETURN MODE UNIT
P65
RELEASE LOCKING OF MAIN UNIT MOTOR 34
P66
P67
INCHING BUTTON OF TARGET RETURN MODE UNIT ON?
NO
YES
MORMALLY ROTATE MAIN UNIT MOTOR
P68
P69
INCHING BUTTON OF TARGET RETURN MODE UNIT OFF?
NO
YES
STOP MAIN UNIT MOTOR
P70
P71
REVERSE INCHING BUTTON OF TARGET RETURN MODE UNIT ON?
NO
YES
REVEESELY ROTATE MAIN UNIT MOTOR
P72
P73
REVERSE INCHING BUTTON OF TARGET RETURN MODE UNIT OFF?
NO
YES
STOP MAIN UNIT MOTOR
P74
P75
MANUAL OPERATION BUTTON OF TARGET RETURN MODE UNIT OFF?
NO
YES
P76
MANUAL OPERATION BUTTON OF ALL TARGET RETURN MODE UNIT OFF?
NO
YES
G

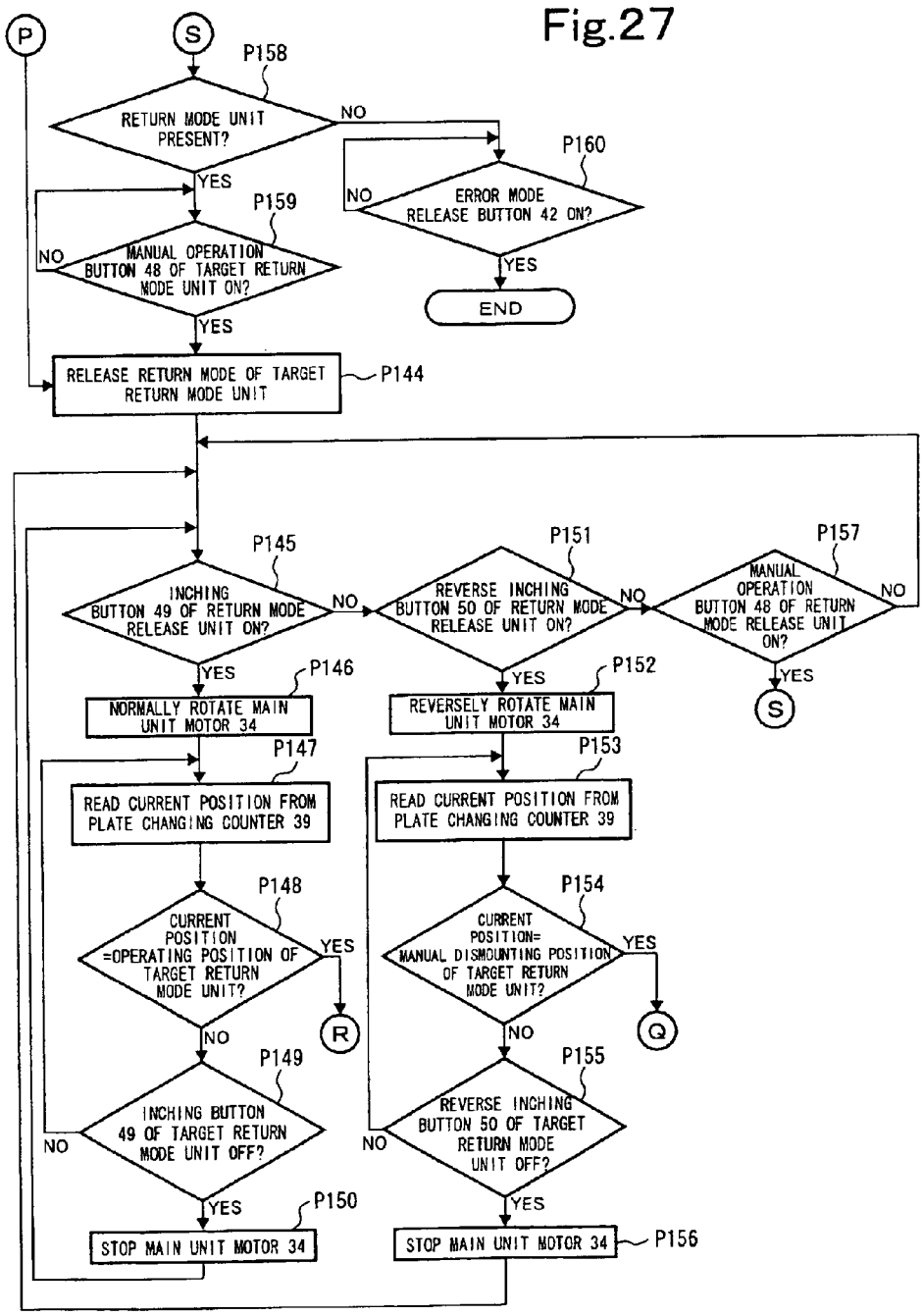
Fig.27
P
S
P158
RETURN MODE UNIT PRESENT?
NO
YES
P160
ERROR MODE RELEASE BUTTON 42 ON?
NO
YES
END
P159
MANUAL OPERATION BUTTON 48 OF TARGET RETURN MODE UNIT ON?
NO
YES
RELEASE RETURN MODE OF TARGET RETURN MODE UNIT
P144
P145
INCHING BUTTON 49 OF RETURN MODE RELEASE UNIT ON?
NO
YES
P151
REVERSE INCHING BUTTON 50 OF RETURN MODE RELEASE UNIT ON?
NO
YES
P157
MANUAL OPERATION BUTTON 48 OF RETURN MODE RELEASE UNIT ON?
NO
YES
S
P146
NORMALLY ROTATE MAIN UNIT MOTOR 34
P152
REVERSELY ROTATE MAIN UNIT MOTOR 34
P147
READ CURRENT POSITION FROM PLATE CHANGING COUNTER 39
P153
READ CURRENT POSITION FROM PLATE CHANGING COUNTER 39
P148
CURRENT POSITION =OPERATING POSITION OF TARGET RETURN MODE UNIT?
YES
R
NO
P154
CURRENT POSITION= MANUAL DISMOUNTING POSITION OF TARGET RETURN MODE UNIT?
YES
Q
NO
P149
INCHING BUTTON 49 OF TARGET RETURN MODE UNIT OFF?
NO
YES
P150
STOP MAIN UNIT MOTOR 34
P155
REVERSE INCHING BUTTON 50 OF TARGET RETURN MODE UNIT OFF?
NO
YES
STOP MAIN UNIT MOTOR 34
P156

METHOD AND APPARATUS FOR PLATE CHANGING IN A PLATE CYLINDER OF A PRINTING PRESS

The entire disclosure of Japanese Patent Application No. 2003-182366 filed on Jun. 26, 2003, including specification, claims, drawings and summary, is incorporated herein by reference in its entirety.

BACKGROUND OF THE INVENTION

1. Field of the Invention

This invention relates to a method and an apparatus for plate changing in a plate cylinder of a printing press.

2. Description of the Related Art

For a web rotary press or the like, in which a plurality of printing units are arranged, various proposals have been made for an automatic plate changer which automatically mounts a printing plate (hereinafter referred to simply as a plate) at a predetermined position of a plate cylinder of each of the plural printing units, and automatically removes the plate from the plate cylinder.

For example, Patent Document 1 (Japanese Patent No. 2704558) describes a method for plate changing in a printing press having a plurality of printing units different from each other in the rotation phase of each plate cylinder, whereby even during a plate removal in one of the printing units, a plate removal operation is performed in the other printing units, thus shortening the plate changing time.

If an error occurs during the plate removal (or plate supply) operation by the automatic plate changer, the plate being removed is engaged into the plate cylinder or ink form rollers and damages a blanket or the roller, unless the plate changing procedure is promptly stopped.

Thus, Patent Document 2 (Japanese Patent Application Laid-Open No. 11-170486) describes a feature in which a sensor is provided for detecting an abnormality in the plate being removed during plate removal, and when the abnormality in the plate removal is detected by the sensor, a printing press is shut down.

In the method for plate changing described in Patent Document 1, however, the rotation phase of the plate cylinder is different among the printing units, as stated above. Therefore, in the printing units showing no abnormality in the plate removal when an abnormality in the plate removal was detected in the other printing unit, there may be cases where the plate is being removed with its end portion being detached from the plate cylinder, or the plate remains substantially unremoved with its end portion being held by the plate cylinder.

If, in this state, the plate cylinder is rotated in a normal or reverse direction to eliminate the plate of the printing unit showing the abnormality in the plate removal, the plate cylinders of all printing units are rotated in the normal or reverse direction in an interlocked manner. As a result, damage is caused to the printing plate of the other printing unit where no abnormality in the plate removal was detected during detection of the plate removal abnormality. To remove the damaged printing plate, many man-hours and much time are required. Similar problems are posed when an abnormality in the plate being supplied occurs during a plate supply operation for automatically mounting printing plates on the plate cylinders.

SUMMARY OF THE INVENTION

The present invention has been accomplished to solve the above problems. Its object is to provide a method and an apparatus for plate changing in a printing press having a plurality of printing units, the method and the apparatus being constituted such that during a plate removal or plate supply operation for an error unit where an abnormality in the plate removal or plate supply was detected, a plate removal or supply operation for the other normal units can be controlled properly in accordance with the progress status of plate changing of the normal units, whereby the plate removal or supply can be carried out reliably in a short amount of time.

To attain the above object, there is provided, according to a first aspect of the present invention, a method for plate changing in a printing press, for rotating all plate cylinders of a plurality of printing units by a drive device, and performing at least one of removal of printing plates from the plate cylinders and supply of printing plates to the plate cylinders by plate changing means provided in correspondence with the plate cylinders, comprising:

an abnormality detection step of detecting presence or absence of a plate changing abnormality by a detector provided in correspondence with each of the plate cylinders;

a stop step of stopping the drive device when the plate changing abnormality is detected in the abnormality detection step;

a return step of controlling at least one of the drive device and the plate changing means of a normal unit, other than an error unit in which the plate changing abnormality has been detected, in accordance with a status of progress of plate changing in the normal unit after the stop step; and an error elimination step of eliminating the plate changing abnormality in the error unit, in which the plate changing abnormality has been detected, after the stop step.

According to the above-described first aspect of the invention, in the normal unit other than the error unit in which an abnormality in plate changing is detected, at least one of the drive device or the plate changing means is controlled according to the progress status of the plate changing of this normal unit. This prevents damage to the printing plate of the normal unit due to normal or reverse rotation of the plate cylinder in return work for the plate changing. Hence, a return work in case of the plate changing abnormality can be done easily in a short amount of time, and burden on the operator can be reduced.

In a second aspect of the invention, the return step may have a first return step of controlling at least one of the drive device and the plate changing means of the normal unit in accordance with the status of progress of the plate changing in the normal unit at a position when the drive device has been stopped by the stop step, and the first return step may be executed before start of the error elimination step.

According to the second aspect of the invention, the printing plate of the normal unit in a specific progress status of the plate changing can be handled (can be brought into a state free from damage due to normal or reverse rotation of the plate cylinder) before the error elimination step. Thus, damage to the printing plate of the normal unit immediately after start of the error elimination step can be prevented. Hence, a return work in case of the plate changing abnormality can be done easily in a short amount of time, and burden on the operator can be reduced.

In a third aspect of the invention, the error elimination step may have a drive step of driving the drive device to rotate the plate cylinder, and the return step may have a second return step of controlling at least one of the drive device and the plate changing means of the normal unit in accordance with a status of the normal unit when the plate cylinder of the normal unit is in a predetermined phase during the drive step.

According to the third aspect of the invention, the printing plate of the normal unit located in a specific phase can be handled during the error elimination step. Thus, damage to the printing plate of the normal unit in the error elimination step can be prevented. Hence, a return work in case of the plate changing abnormality can be done easily in a short amount of time, and burden on the operator can be reduced.

In a fourth aspect of the invention, the first return step may include:

a first control step of controlling the plate changing means of the normal unit when there is the normal unit in which opposite end portions of the printing plate both are not mounted on the plate cylinder or are both mounted on the plate cylinder and the plate changing means is in an operating state;

a first drive lock step of prohibiting driving of the drive device at least in a plate removal direction when there is the normal unit in one of a first incomplete removal state where one end of the printing plate is mounted on the plate cylinder, and removal of other end of the printing plate from the plate cylinder is started, but the removal is not completed, and a second incomplete removal state where one end of the printing plate whose other end has been removed from the plate cylinder is located between an automatic removal position, at which the one end of the printing plate can be automatically removed, and a manual removal position at which the one end of the printing plate can be manually removed, and a first incomplete supply state where one end of the printing plate is mounted on the plate cylinder, and mounting of other end of the printing plate on the plate cylinder is started, but the mounting is not completed, and a second incomplete supply state where mounting of one end of the printing plate on the plate cylinder is started, but the mounting is not completed; and a first lock release step of releasing a state, which prohibits driving of the drive device at least in the plate removal direction, by operating a manual operation switch of the normal unit in the first incomplete removal state, the second incomplete removal state, the first incomplete supply state, or the second incomplete supply state after the first drive lock step.

According to the fourth aspect of the invention, the plate changing means in the normal unit before start and after completion of changing of the printing plate for the plate cylinder and during the operation of the plate changing means is controlled before the error elimination step. Thus, the printing plate of the normal unit can be handled automatically. Furthermore, if there is the normal unit in which the end portion of the printing plate is being removed or mounted, driving of the drive device at least in the direction of the plate removal is prohibited. Thus, damage to the printing plate in the normal unit can be prevented, a return work for the plate changing can be performed easily in a short amount of time, and burden on the operator can be reduced. Besides, execution of the error elimination step before handling of the normal unit can be prevented.

In a fifth aspect of the invention, the second return step may include:

a second drive lock step of prohibiting driving of the drive device at least in a plate removal direction, when the plate cylinder of the normal unit being in a state, where one end of the printing plate is mounted on the plate cylinder and other end of the printing plate is not mounted on the plate cylinder, is located in a phase in which the one end of the printing plate is removed from the plate cylinder during rotation of the drive device in the plate removal direction, or when the plate cylinder of the normal unit being in the state is located in a phase in which the other end of the printing plate is mounted on the plate cylinder during rotation of the drive device in a plate supply direction; and a second lock release step of releasing a state, which prohibits driving of the drive device, after the second drive lock step.

According to the fifth aspect of the invention, during the error elimination step, driving of the drive device at least in the direction of the plate removal is prohibited, when the normal unit is located in a phase related to removal or mounting of the end portion of the printing plate. Thus, before the error elimination step is resumed, the printing plate of the normal unit can be dealt with. Thus, damage to the printing plate of the normal unit can be prevented, a return work for the plate changing can be performed easily in a short amount of time, and burden on the operator can be reduced. Besides, the operator can be prevented from making the mistake of resuming the error elimination step before dealing with the printing plate of the normal unit.

In a sixth aspect of the invention, the plate cylinder may include plate holding means movable between a holding position, at which the plate holding means holds an end portion of the printing plate, and a release position at which the plate holding means releases holding of the end portion of the printing plate, the plate changing means may include:

plate removal switching means supported to be movable between a plate removal operating position, at which the plate removal switching means can switch the plate holding means from the holding position to the release position, and a plate removal retreat position at which the plate removal switching means retreats from the plate removal operating position;

removal holding means supported to be movable between a removal holding position, at which the removal holding means removes one end of the printing plate from the plate cylinder and holds the one end of the printing plate separated from the plate cylinder, and a holding release position at which the removal holding means releases holding of the printing plate;

removal plate accommodation portion for accommodating the printing plate removed from the plate cylinder;

removal plate accommodation means for moving the printing plate into the removal plate accommodation portion;

first removal plate detection means for detecting a failure in removal of other end of the printing plate from the plate cylinder; and second removal plate detection means for detecting a failure in removal of one end of the printing plate from the plate cylinder, the method for plate changing may further comprise:

a plate removal step for removing the printing plate from the plate cylinder, the plate removal step may include:

a plate removal drive step of driving the drive device in the plate removal direction;

a plate removal phase detection step of detecting a phase of the plate cylinder;

a plate removal switching means operating step which, when the phase detected in the plate removal phase detection step is a plate removal switching means operating position, moves the plate removal switching means of the corresponding printing unit to the plate removal operating position;

a plate removal switching step, in which at a plate removal switching start position, switching of the plate holding means from the holding position to the release position by the plate removal switching means of the corresponding printing unit is started, and at a plate removal switching termination position, switching of the plate holding means from the holding position to the release position by the plate removal switching means of the corresponding printing unit is terminated;

a removal holding means operating step which, when the phase detected in the plate removal phase detection step is a plate removal holding means operating position, moves the removal holding means of the corresponding printing unit to the removal holding position; and a removal plate accommodation step which, when the phase detected in the plate removal phase detection step is a removal plate accommodation position, moves the removal holding means of the corresponding printing unit to the holding release position, and also moves the printing plate to the removal plate accommodation portion by the removal plate accommodation means, the abnormality detection step may include:

a first removal plate detection step which, when the phase detected in the plate removal phase detection step is a first removal plate detection position, detects a plate removal abnormality by the first removal plate detection means of the corresponding printing unit; and a second removal plate detection step of detecting the plate removal abnormality by the second removal plate detection means for the printing unit after execution of the removal holding means operating step and before execution of the removal plate accommodation step, the first control step may move the plate removal switching means of the normal unit, which is located between the plate removal switching means operating position and the plate removal switching start position, to the plate removal retreat position, and may move the removal holding means of the normal unit, which is located between a manual removal position, where one end of the printing plate can be manually removed from the plate cylinder, and the removal plate accommodation position, to the holding release position and may move the printing plate to the removal plate accommodation portion by the removal plate accommodation means, the first drive lock step may be performed when there is the normal unit located between the plate removal switching start position and the plate removal switching termination position or between the removal holding means operating position and the manual removal position, the error elimination step may be performed after the first lock release step, and the second drive lock step may be performed when the normal unit, which has been located between the plate removal switching termination position and the removal holding means operating position in the stop step, is located at the plate removal switching termination position during driving of the drive device in a direction opposite to the plate removal direction by the drive step, or at the manual removal position during driving of the drive device in the plate removal direction by the drive step.

According to the sixth aspect of the invention, when a plate removal abnormality is detected during the plate removal step and the drive device stops, control is exercised on the plate changing means in the normal unit before start and after completion of removal of the printing plate from the plate cylinder and during the operating state of the plate changing means. Thus, the printing plate of the normal unit can be dealt with automatically. Furthermore, if there is the normal unit in which the end portion of the printing plate is being removed, driving of the drive device at least in the direction of plate removal is prohibited. Thus, damage to the printing plate can be prevented in the normal unit which is immediately after start of the error elimination step. Also, the operator can be prevented from accidentally performing the error elimination step before dealing with the printing plate of the normal unit. During the error elimination step, moreover, driving of the drive device at least in the direction of the plate removal is prohibited, when the normal unit is located in a phase related to the removal of the end portion of the printing plate. Thus, before the error elimination step is resumed, the printing plate of the normal unit can be dealt with. Thus, damage to the printing plate of the normal unit can be prevented, a return work for the plate changing can be performed easily in a short amount of time, and burden on the operator can be reduced. Besides, the operator can be prevented from making the mistake of resuming the error elimination step before dealing with the printing plate of the normal unit.

In a seventh aspect of the invention, the plate cylinder may include plate holding means movable between a holding position, at which the plate holding means holds an end portion of the printing plate, and a release position at which the plate holding means releases holding of the end portion of the printing plate, the plate changing means may include:

a plate press roller supported to be contactable with and separable from the plate cylinder;

plate supply switching means supported to be movable between a plate supply operating position, at which the plate supply switching means can switch the plate holding means from the release position to the holding position, and a plate supply retreat position at which the plate supply switching means retreats from the plate supply operating position;

removal holding means supported to be movable between a removal holding position, at which the removal holding means removes one end of the printing plate from the plate cylinder and holds the one end of the printing plate separated from the plate cylinder, and a holding release position at which the removal holding means releases holding of the printing plate;

a new plate accommodation portion for accommodating a printing plate to be supplied to the plate cylinder;

new plate moving means for moving a printing plate from the new plate accommodation portion to the plate cylinder or from the plate cylinder to the new plate accommodation portion; and new plate detection means for detecting a failure in mounting of one end of a printing plate on the plate cylinder;

the method for plate changing may further comprise:

a plate supply step of supplying a printing plate to the plate cylinder, the plate supply step may include:

a plate press roller operating step of bringing the plate press rollers of all of the printing units into contact with the plate cylinders;

a plate supply drive step of driving the drive device in the plate supply direction;

a plate supply phase detection step of detecting a phase of the plate cylinder;

a plate supply switching means operating step which, when the phase detected in the plate supply phase detection step is a plate supply switching means operating position, moves the plate supply switching means of the corresponding printing unit to the plate supply operating position;

a plate supply switching step, in which at a plate supply switching start position, switching of the plate holding means from the release position to the holding position by the plate supply switching means of the corresponding printing unit is started, and at a plate supply switching termination position, switching of the plate holding means from the release position to the holding position by the plate supply switching means of the corresponding printing unit is terminated; and a plate press roller retreat step which, when the phase detected in the plate supply phase detection step is a plate press roller retreat position, separates the plate press roller of the corresponding printing unit from the plate cylinder, the abnormality detection step may include:

a plate supply detection step which, when the phase detected in the plate supply phase detection step is a plate supply detection position, detects a plate supply abnormality by plate supply detection means of the corresponding printing unit, the first control step may retreat the plate press roller from the plate cylinder in the normal unit, which is located between a position where the plate press roller operating step is started and a new plate insertion start position where mounting of one end of the printing plate on the plate cylinder is started, and may also move a printing plate to the new plate accommodation portion by the new plate moving means, and may retreat the plate press roller of the normal unit, which is located between the plate supply switching termination position and the plate press roller retreat position, from the plate cylinder, and also may move the plate supply switching means to the plate supply retreat position, the first drive lock step may be performed when there is the normal unit located between the new plate insertion start position and the plate supply detection position or between the plate supply switching means operating position and the plate supply switching termination position, the error elimination step may be performed after the first lock release step, and the second drive lock step may be performed when the normal unit, which has been located between the plate supply detection position and the plate supply switching means operating position in the stop step, is located at the plate supply switching means operating position during driving of the drive device in a plate supply direction by the drive step, or at the manual removal position, at which one end of the printing plate can be manually removed from the plate cylinder, during driving of the drive device in a direction opposite to the plate supply direction by the drive step.

According to the seventh aspect of the invention, when a plate supply abnormality is detected during the plate supply step and the drive device stops, control is exercised on the plate changing means in the normal unit before start and after completion of supply of the printing plate to the plate cylinder and during the operating state of the plate changing means. Thus, the printing plate of the normal unit can be dealt with automatically. Furthermore, if there is the normal unit in which the end portion of the printing plate is being mounted, driving of the drive device at least in the direction of plate removal is prohibited. Thus, damage to the printing plate can be prevented in the normal unit which is immediately after start of the error elimination step. Also, the operator can be prevented from accidentally performing the error elimination step before dealing with the printing plate of the normal unit. During the error elimination step, moreover, driving of the drive device at least in the direction of the plate removal is prohibited, when the normal unit is located in a phase related to mounting or removal of the end portion of the printing plate. Thus, before the error elimination step is resumed, the printing plate of the normal unit can be dealt with. Thus, damage to the printing plate of the normal unit can be prevented, a return work for plate changing can be performed easily in a short amount of time, and burden on the operator can be reduced. Besides, the operator can be prevented from making the mistake of resuming the error elimination step before dealing with the printing plate of the normal unit.

In an eighth aspect of the invention, the second return step may include:

an automatic removal holding step which, when the plate cylinder of the normal unit is located at the manual removal position, moves the removal holding means of the corresponding normal unit to the removal holding position; and a removal confirmation step of detecting a plate removal abnormality by the second removal plate detection means after the automatic removal holding step, and the second lock release step may be performed when it is confirmed in the removal confirmation step that a printing plate has been removed normally.

According to the eighth aspect of the invention, during the error elimination step, when the normal unit is located in a phase related to removal of the end portion of the printing plate, the end portion of the printing plate can be removed automatically to separate the end portion of the printing plate from the plate cylinder, and the inability of the drive device to be driven at least in the direction of plate removal can be automatically released. Thus, the operator can resume the error elimination step without reciprocating between the error unit and the normal unit, can prevent damage to the printing plate of the normal unit, and can do a return work for plate changing easily in a short amount of time. Also, burden on the operator can be reduced.

The method in a ninth aspect of the invention may further comprise a second drive step of driving the drive device after the error elimination step to rotate the plate cylinder, and the return step may have a third return step of controlling at least one of the drive device and the plate changing means of the normal unit in accordance with a status of the normal unit when the plate cylinder of the normal unit is in a predetermined phase during the second drive step.

According to the ninth aspect of the invention, if there is the normal unit remaining untreated after the error elimination step, it is possible to treat the printing plate of the normal unit which is located in a specific phase when the plate cylinder is rotated normally or reversely to handle the printing plate of the untreated normal unit. Thus, a return work for plate changing can be done easily in a short amount of time, and burden on the operator can be reduced.

In a tenth aspect of the invention, each of the printing units may be provided with a manual operation switch, a mode setting step may be provided of operating the manual operation switch of the printing unit, in which a plate changing abnormality has been detected, after the stop step, setting the printing unit with the detected plate changing abnormality to be an error unit, and setting the normal unit other than the error unit to be a return mode unit, the first return step may include:

a first automatic return mode release step of automatically releasing a return mode of the return mode unit in accordance with a status of progress of plate changing of the return mode unit; and a first manual return mode release step of operating the manual operation switch of the return mode unit to release the return mode, and the second return step may be performed for the return mode unit not released from the return mode, and may include:

a second automatic return mode release step of automatically releasing the return mode of the return mode unit in accordance with a status of the return mode unit; and a second manual return mode release step of operating the manual operation switch of the return mode unit to release the return mode.

According to the tenth aspect of the invention, the return mode of the return mode unit can be automatically released according to the progress status of plate changing of the normal unit. Thus, a return work for plate changing can be done easily in a short amount of time, and burden on the operator can be reduced.

In an eleventh aspect of the invention, a plate changing switch for starting plate changing may be provided, and a plate changing resumption step of operating the plate changing switch to drive the drive device, thereby resuming plate changing suspended by the stop step, may be provided before the mode setting step.

According to the eleventh aspect of the invention, after a plate changing abnormality is detected and the drive device is stopped, a plate changing which has been suspended can be easily resumed by operating the plate changing switch.

According to a twelfth aspect of the present invention, there is provided an apparatus for plate changing in a printing press, comprising:

a plurality of printing units each having a plate cylinder;

a drive device for driving all of the plate cylinders;

plate changing means provided in correspondence with the plate cylinders and adapted to perform at least one of removal of a printing plate from the plate cylinder and supply of a printing plate to the plate cylinder; and detection means provided in correspondence with the plate cylinders and adapted to detect a plate changing abnormality, the apparatus for plate changing further comprising a control device for stopping the drive device if the plate changing abnormality is detected by the detection means during plate changing, and controlling at least one of the drive device and the plate changing means of a normal unit, other than an error unit in which the plate changing abnormality has been detected, in accordance with a status of progress of plate changing in the normal unit after the drive device is stopped.

According to the twelfth aspect of the invention, the same effects as by the first aspect of the invention can be obtained.

In a thirteenth aspect of the invention, the control device may either prohibit driving of the drive device at least in a plate removal direction, or control the plate changing means of the normal unit, in accordance with the status of progress of plate changing in the normal unit when the drive device is stopped.

According to the thirteenth aspect of the invention, the same effects as by the second aspect of the invention can be obtained.

The apparatus in a fourteenth aspect of the invention may further comprise phase detection means for detecting a phase of the plate cylinder, and the control device may stop the drive device when the phase detected by the phase detection means becomes a predetermined phase during driving of the drive device performed after stoppage of the drive device.

According to the fourteenth aspect of the invention, the same effects as by the third aspect of the invention can be obtained.

In a fifteenth aspect of the invention, each of the printing units may have a manual operation switch, and drive device driving means for driving the drive device in a direction of normal rotation and in a direction of reverse rotation, the plate cylinder may include plate holding means movable between a holding position, at which the plate holding means holds an end portion of a printing plate, and a release position at which the plate holding means releases holding of the end portion of the printing plate, the plate changing means may include:

plate removal switching means supported to be movable between a plate removal operating position, at which the plate removal switching means can switch the plate holding means from the holding position to the release position, and a plate removal retreat position at which the plate removal switching means retreats from the plate removal operating position;

removal holding means supported to be movable between a removal holding position, at which the removal holding means removes one end portion of a printing plate from the plate cylinder and holds the one end portion of the printing plate separated from the plate cylinder, and a holding release position at which the removal holding means releases holding of the printing plate;

removal plate accommodation portion for accommodating the printing plate removed from the plate cylinder;

removal plate accommodation means for moving the printing plate into the removal plate accommodation portion;

first removal plate detection means for detecting a failure in removal of other end portion of the printing plate from the plate cylinder; and second removal plate detection means for detecting a failure in removal of one end portion of a printing plate from the plate cylinder, the control device may drive the drive device in a plate removal direction;

when the phase detected by the phase detection means is a plate removal switching means operating position, may move the plate removal switching means of the corresponding printing unit to the plate removal operating position;

when the phase detected by the phase detection means is a first removal plate detection position, may detect a plate removal abnormality by the first removal plate detection means of the corresponding printing unit;

if the plate removal abnormality is not detected by detection of the first removal plate detection means, when the phase detected by the phase detection means is a removal holding means operating position, may move the removal holding means of the corresponding printing unit to the removal holding position, and may detect the plate removal abnormality by the second removal plate detection means of the printing unit concerned;

if the plate removal abnormality is not detected by detection of the second removal plate detection means, when the phase detected by the phase detection means is a removal plate accommodation position, may move the removal holding means of the corresponding printing unit to the holding release position, and may also move the printing plate to the removal plate accommodation portion by the removal plate accommodation means to accommodate a removal plate;

when the plate removal abnormality is detected by the first removal plate detection means and the second removal plate detection means, may stop the drive device;

when the normal unit at a position of stoppage is located between the plate removal switching means operating position and a plate removal switching start position, at which switching of the plate holding means from the holding position to the release position by the plate removal switching means is started, may move the plate removal switching means of the normal unit to the plate removal retreat position;

when the normal unit at the position of stoppage is located between a manual removal position, at which one end portion of the printing plate can be manually removed from the plate cylinder, and the removal plate accommodation position, may move the removal holding means of the normal unit to the holding release position, and may also move the printing plate to the removal plate accommodation portion by the removal plate accommodation means;

when the normal unit at the position of stoppage is located between the plate removal switching start position and a plate removal switching termination position, at which switching of the plate holding means from the holding position to the release position by the plate removal switching means is terminated, or between the removal holding means operating position and the manual removal position, may lock the drive device so as to be undrivable until the manual operation switch of the normal unit is operated;

when a phase of the normal unit, which has been located between the plate removal switching termination position and the removal holding means operating position, is located at the plate removal switching termination position during driving of the drive device by operating the drive device driving means of the error unit, may stop the drive device, and may lock the drive device so as to be undrivable until the manual operation switch of the normal unit is operated.

According to the fifteenth aspect of the invention, the same effects as by the sixth aspect of the invention can be obtained.

In a sixteenth aspect of the invention, each of the printing units may have a manual operation switch, and drive device driving means for driving the drive device in a direction of normal rotation and in a direction of reverse rotation, the plate cylinder may include plate holding means movable between a holding position, at which the plate holding means holds an end portion of a printing plate, and a release position at which the plate holding means releases holding of the end portion of the printing plate, the plate changing means may include:

a plate press roller supported to be contactable with and separable from the plate cylinder;

plate supply switching means supported to be movable between a plate supply operating position, at which the plate supply switching means can switch the plate holding means from the release position to the holding position, and a plate supply retreat position at which the plate supply switching means retreats from the plate supply operating position;

removal holding means supported to be movable between a removal holding position, at which the removal holding means removes one end portion of a printing plate from the plate cylinder and holds the one end portion of the printing plate separated from the plate cylinder, and a holding release position at which the removal holding means releases holding of the printing plate;

a new plate accommodation portion for accommodating a printing plate to be supplied to the plate cylinder;

new plate moving means for moving a printing plate from the new plate accommodation portion to the plate cylinder or from the plate cylinder to the new plate accommodation portion; and new plate detection means for detecting a failure in mounting of one end portion of a printing plate on the plate cylinder, the control device may bring the plate press roller of each of all the printing units into contact with the plate cylinder;

may drive the drive device in a plate supply direction;

when the phase detected by the phase detection means is a plate supply detection position, may detect a plate supply abnormality by the plate supply detection means of the corresponding printing unit;

if the plate supply abnormality is not detected by the plate supply detection means, when the phase detected by the phase detection means is a plate supply switching means operating position, may move the plate supply switching means of the corresponding printing unit to the plate supply operating position;

when the phase detected by the phase detection means is a plate press roller retreat position, may separate the plate press roller of the corresponding printing unit from the plate cylinder;

when the plate supply abnormality is detected by detection of the plate supply detection means, may stop the drive device;

when the normal unit at a position of stoppage is located between a point of contact of the plate press roller with the plate cylinder and a new plate insertion start position, at which mounting of one end of the printing plate on the plate cylinder is started, may retreat the plate press roller of the normal unit from the plate cylinder, and may also move the printing plate to the new plate accommodation portion by the new plate moving means;

when the normal unit at the position of stoppage is located between a plate supply switching termination position, at which switching of the plate holding means from the release position to the holding position by the plate supply switching means is terminated, and the plate press roller retreat position, may retreat the plate press roller of the normal unit from the plate cylinder, and may also move the plate supply switching means to the plate supply retreat position;

when the normal unit at the position of stoppage is located between the new plate insertion start position and the plate supply detection position, or between the plate supply switching means operating position and the plate supply switching termination position, may prohibit driving of the drive device at least in a direction opposite to the plate supply direction until the manual operation switch of the normal unit is operated; and when a phase of the normal unit, which has been located between the plate supply detection position and the plate supply switching means operating position, is located at the plate supply switching means operating position during driving of the drive device by operating the drive device driving means of the error unit, may stop the drive device, and may prohibit driving of the drive device at least in the direction opposite to the plate supply direction until the manual operation switch of the normal unit is operated.

According to the sixteenth aspect of the invention, the same effects as by the seventh aspect of the invention can be obtained.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 8 is a control block diagram;

FIG. 18 is a flow chart for a plate removal step;

FIG. 20 is a flow chart for a first return step;

FIG. 21 is a flow chart for the first return step;

FIG. 27 is a flow chart for a third return step;

DETAILED DESCRIPTION OF THE INVENTION

A method and an apparatus for plate changing in a printing press according to the present invention will now be described in detail by an embodiment with reference to the accompanying drawings, which in no way limit the invention.

Figure 1:
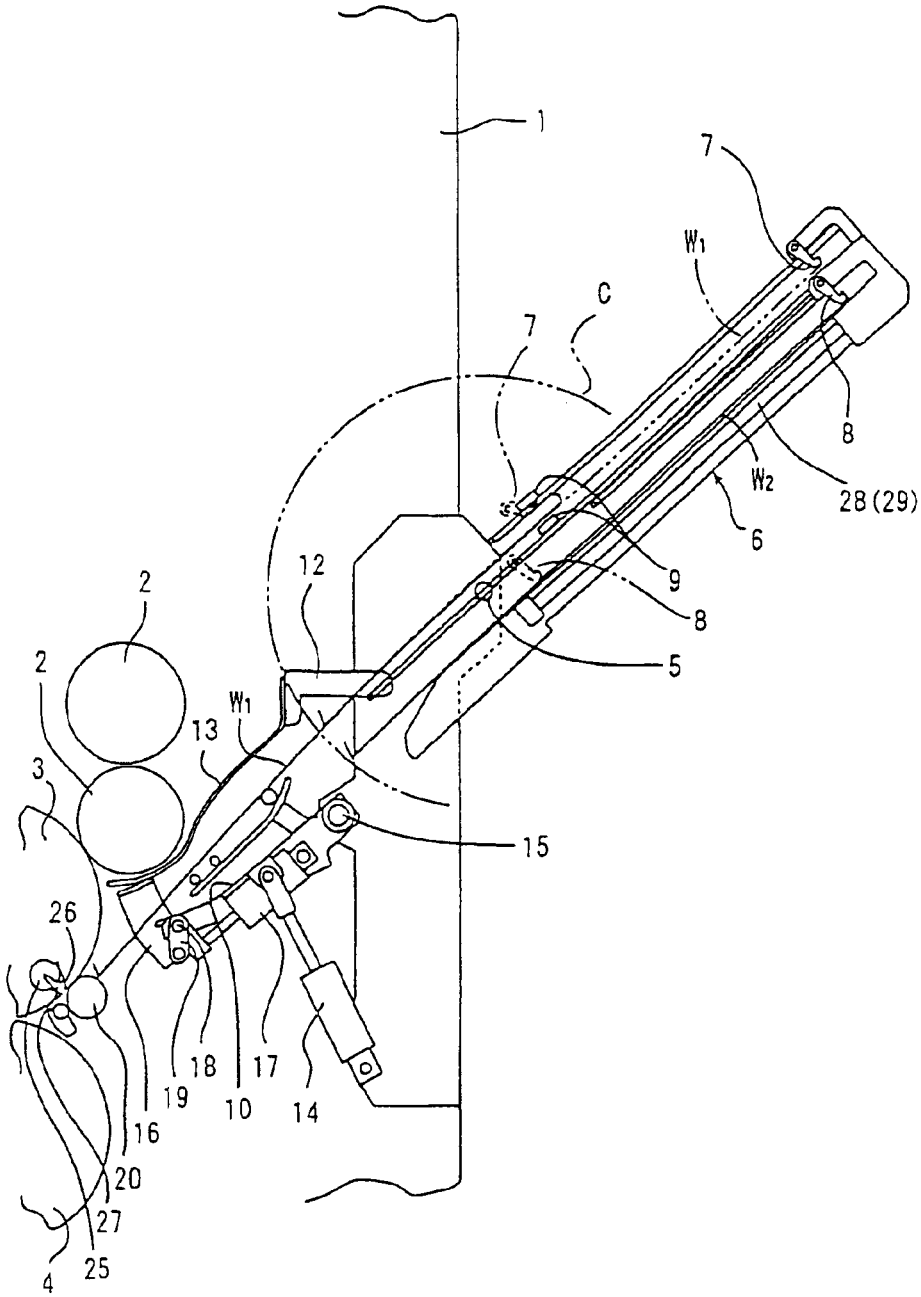
FIG. 1 is a schematic configuration drawing of an automatic plate changer and its surroundings of a perfecting printing press showing an embodiment of the present invention.
Figure 2:
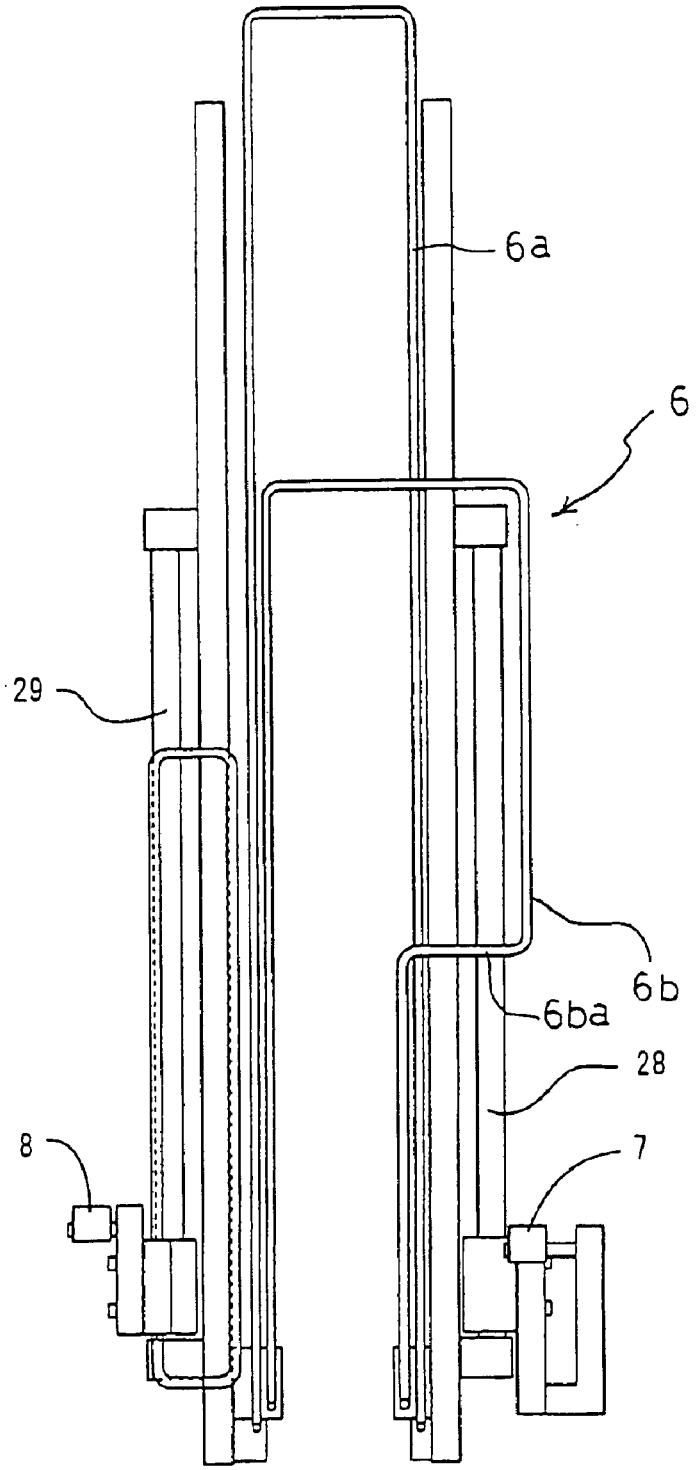
FIG. 2 is a plan view of a loader.
Figure 3:
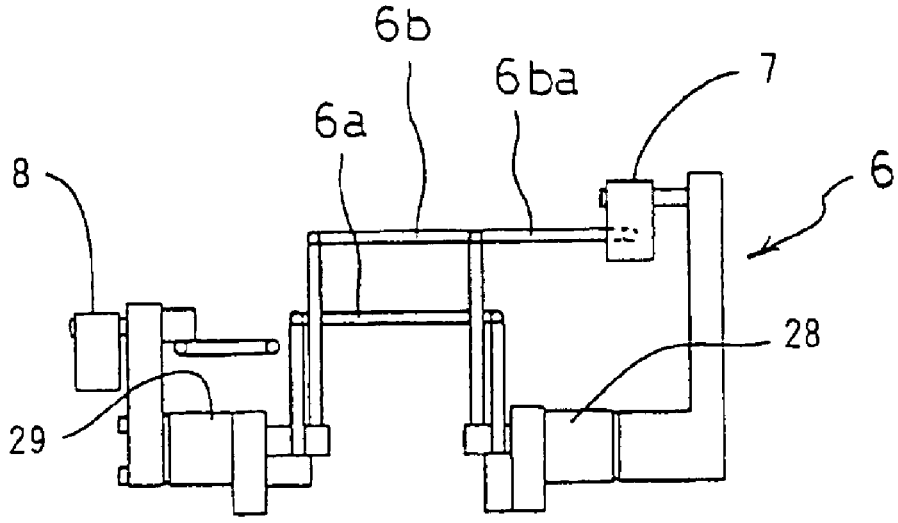
FIG. 3 is a rear view of the loader.
Figure 4:
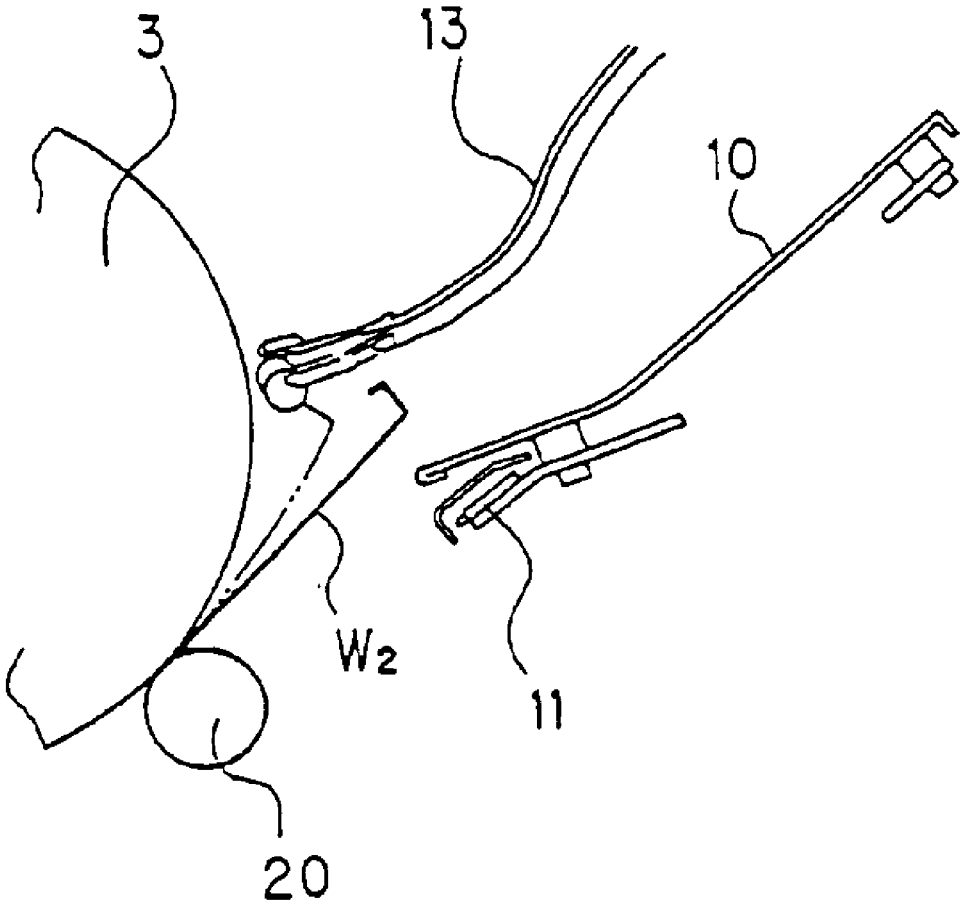
FIG. 4 is an enlarged view of a moving plate guide portion.
Figure 5:
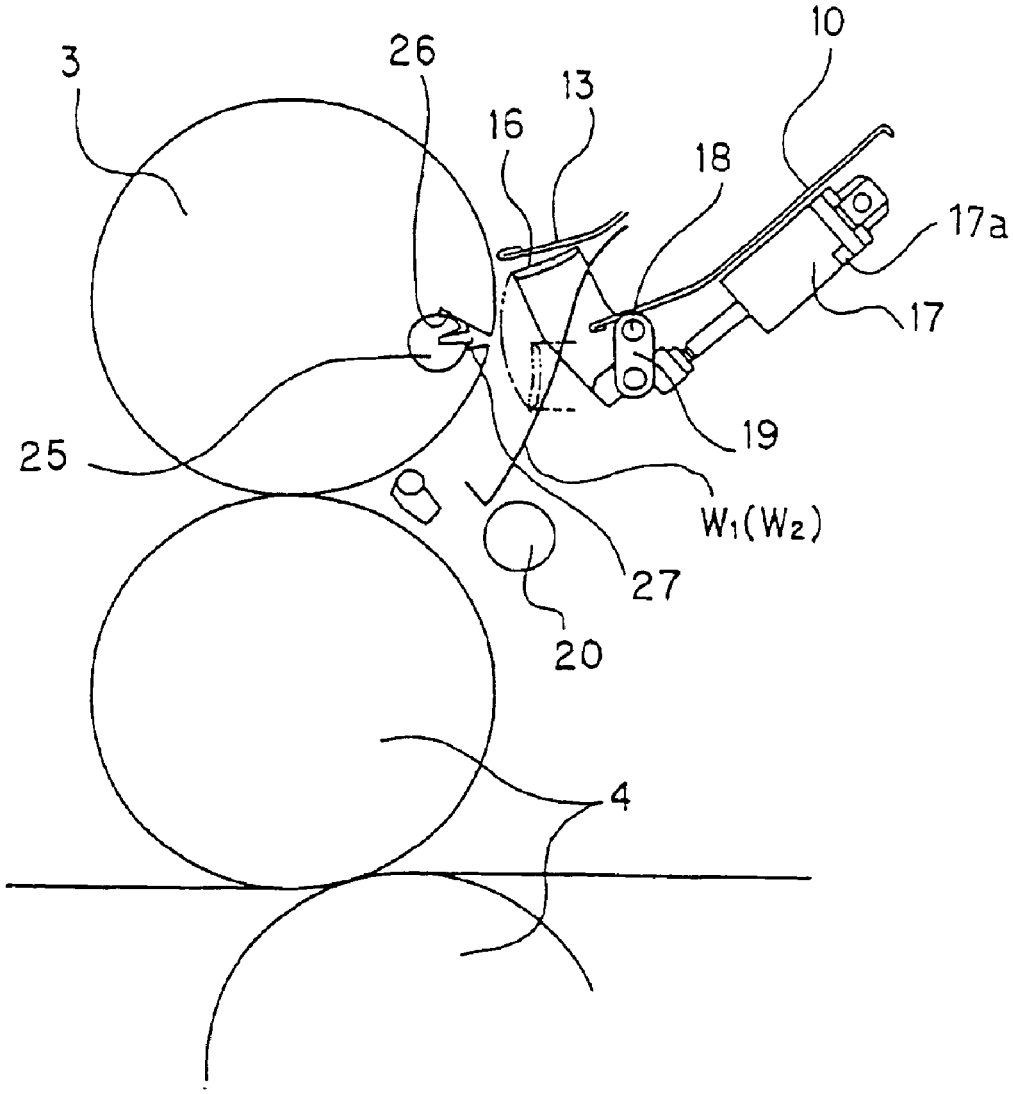
FIG. 5 is an enlarged view of a plate gripping/extracting guide portion.
Figure 6:
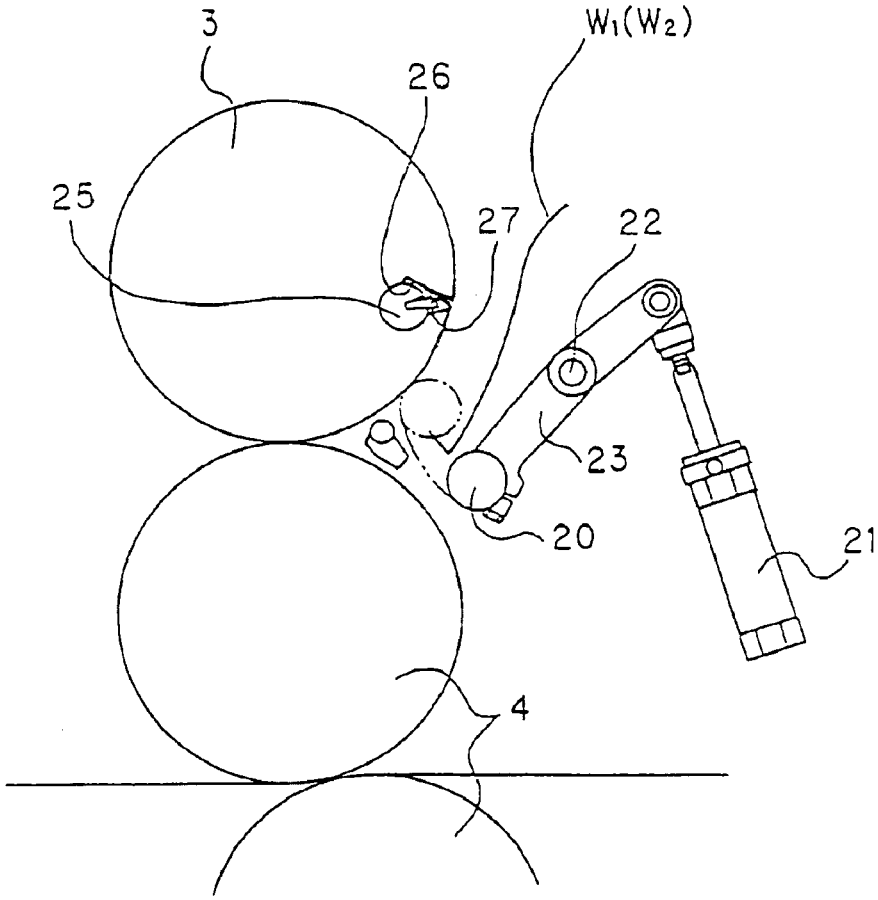
FIG. 6 is an enlarged view of a plate press roller portion.
Figure 7:
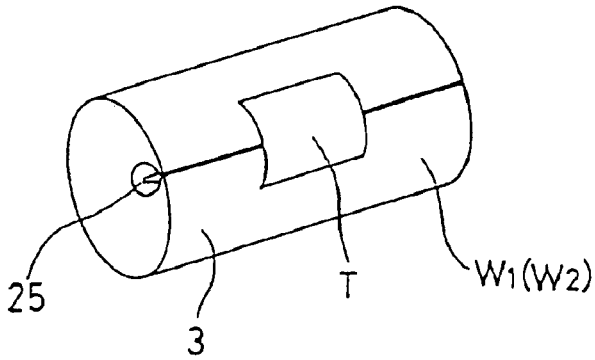
FIG. 7 is a perspective view of a plate cylinder.
Figure 9:
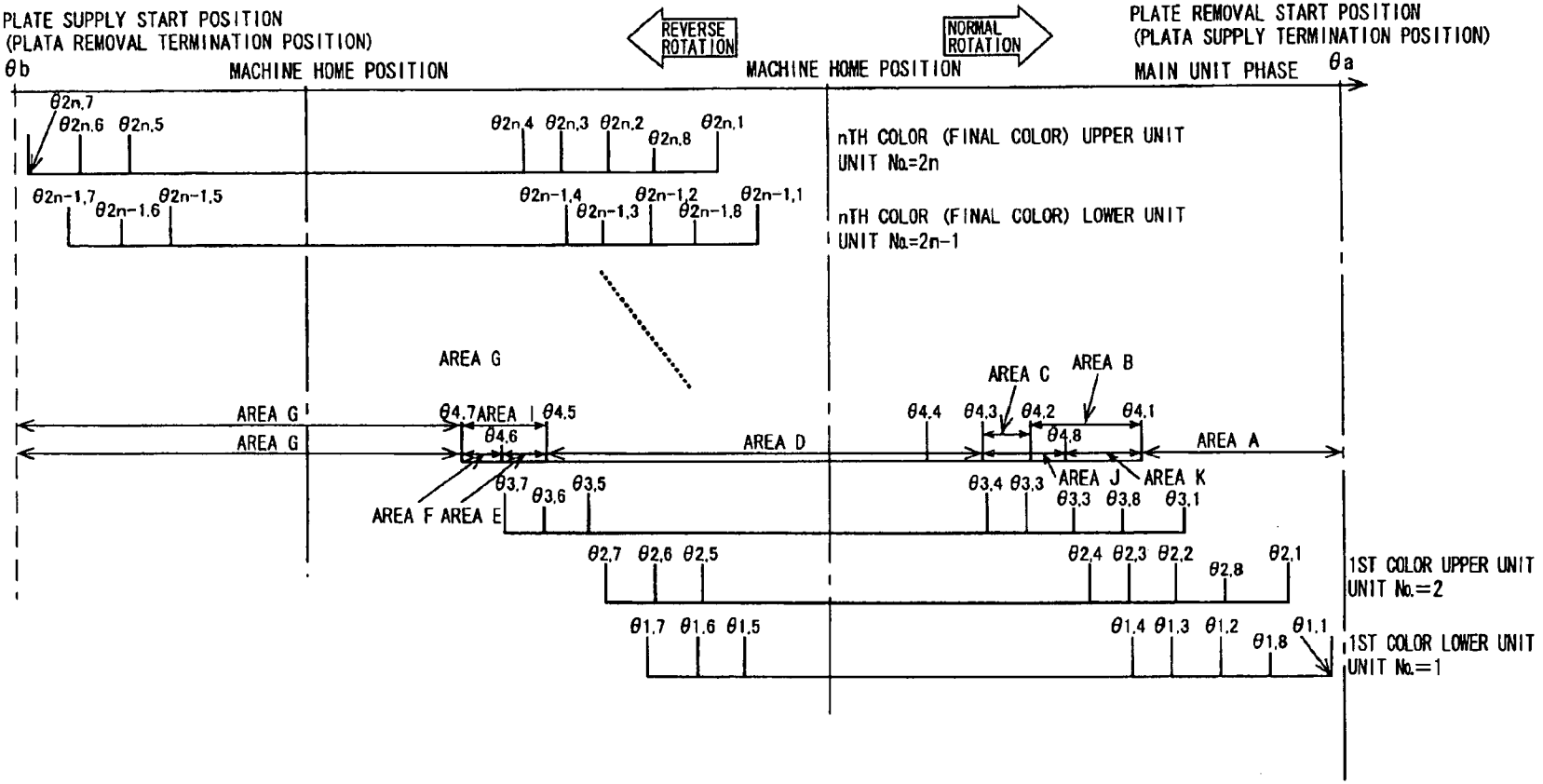
FIG. 9 is a time-chart showing the operating positions of printing units during plate changing.
Figure 10:
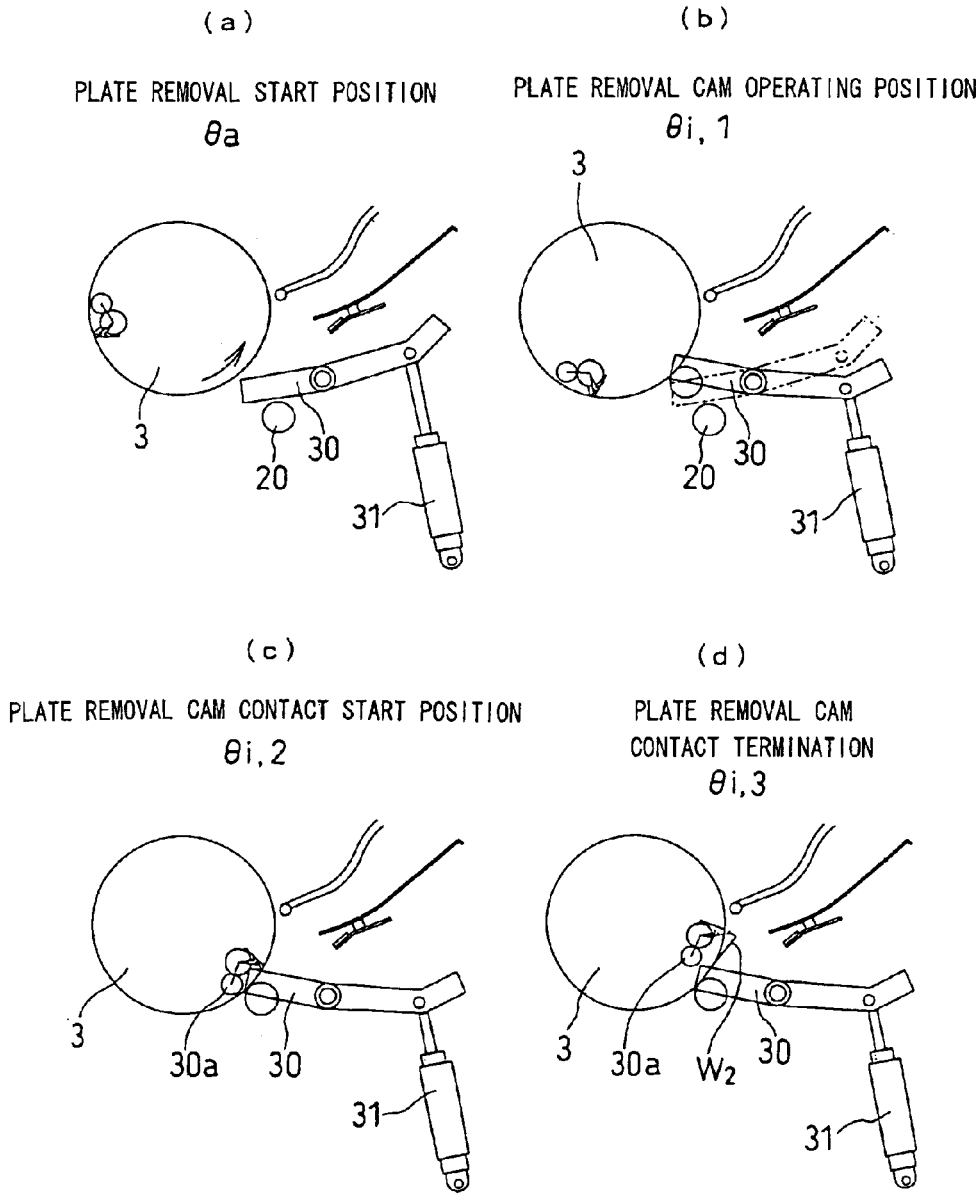
FIGS. 10(*a*) to 10(*d*) are explanation drawings of various operating positions during plate removal.
Figure 11:
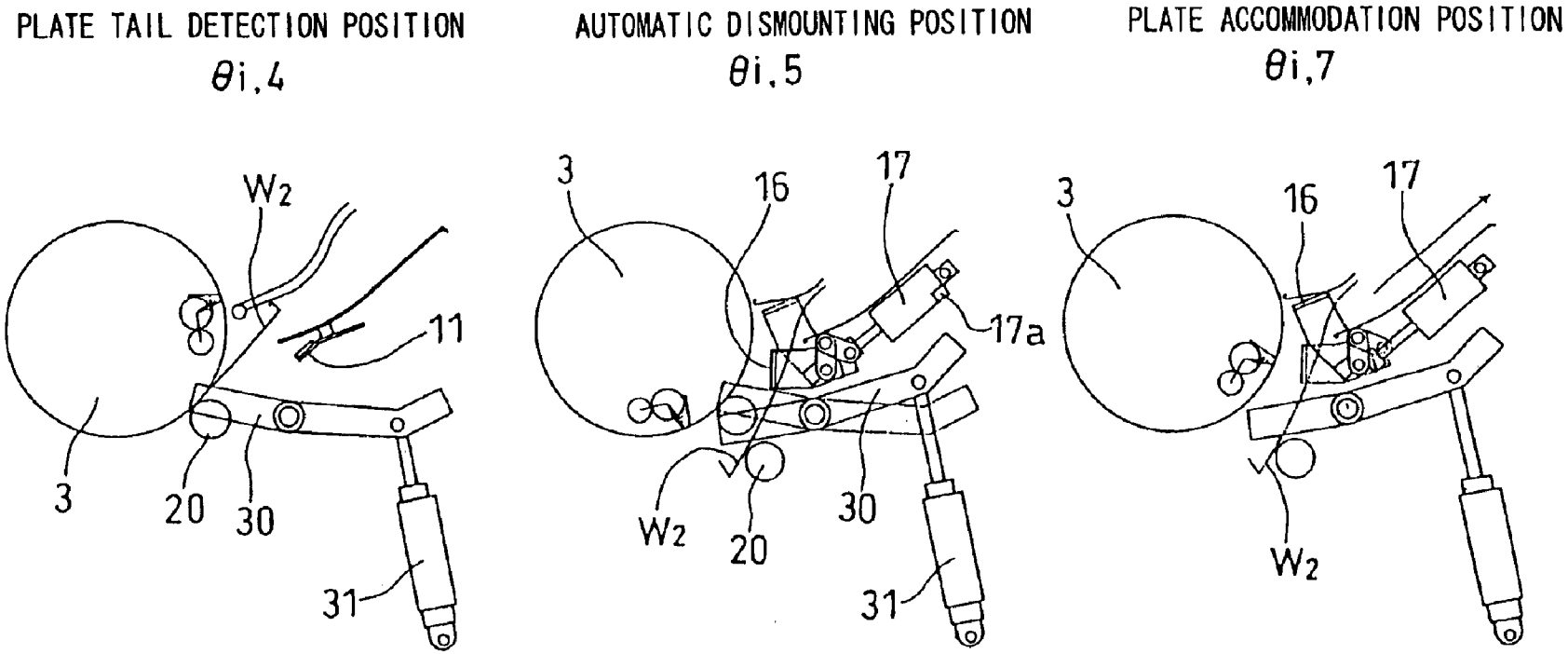
FIGS. 11(*a*) to 11(*c*) are explanation drawings of various operating positions during plate removal.
Figure 12:
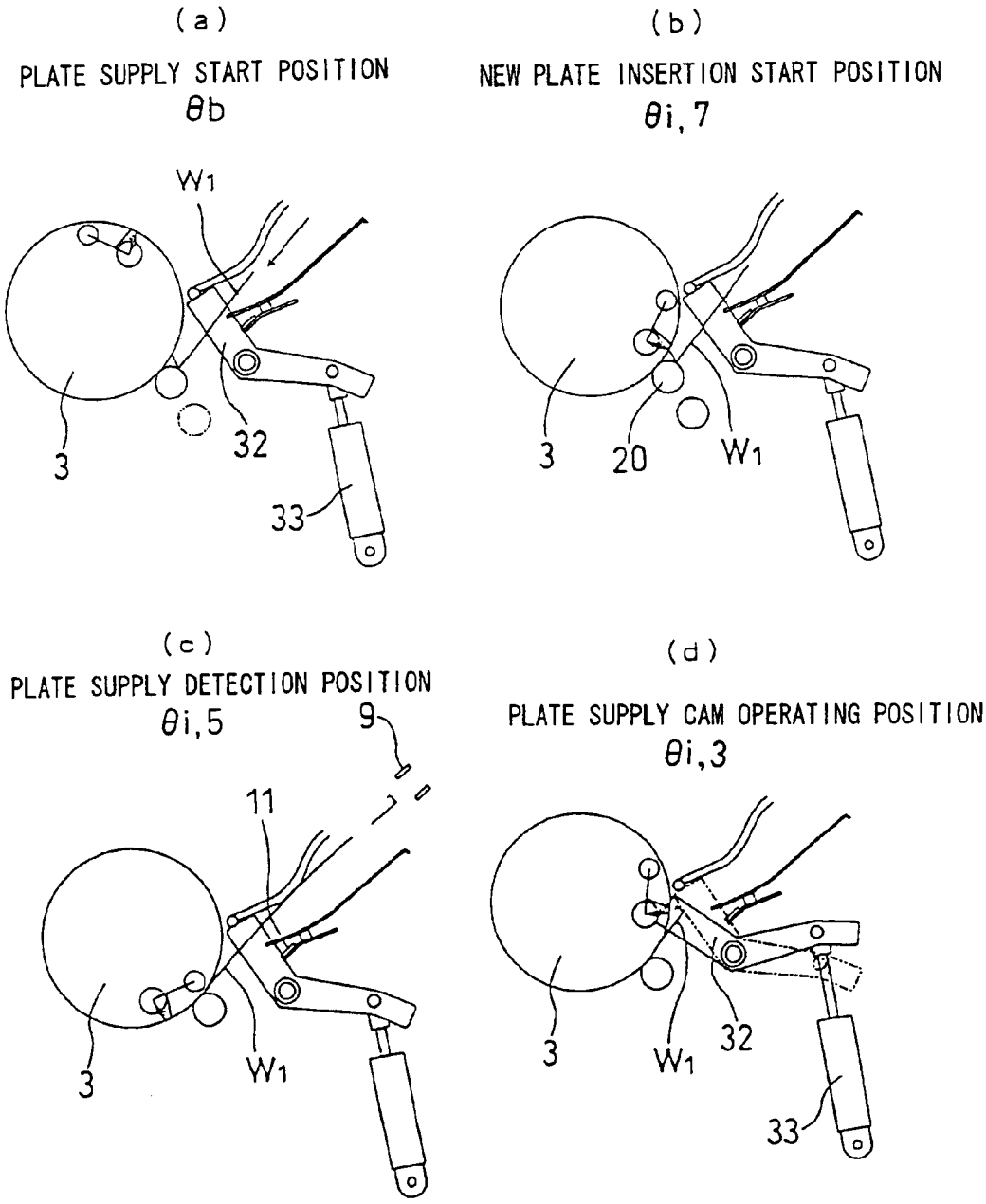
FIGS. 12(*a*) to 12(*d*) are explanation drawings of various operating positions during plate supply.
Figure 13:
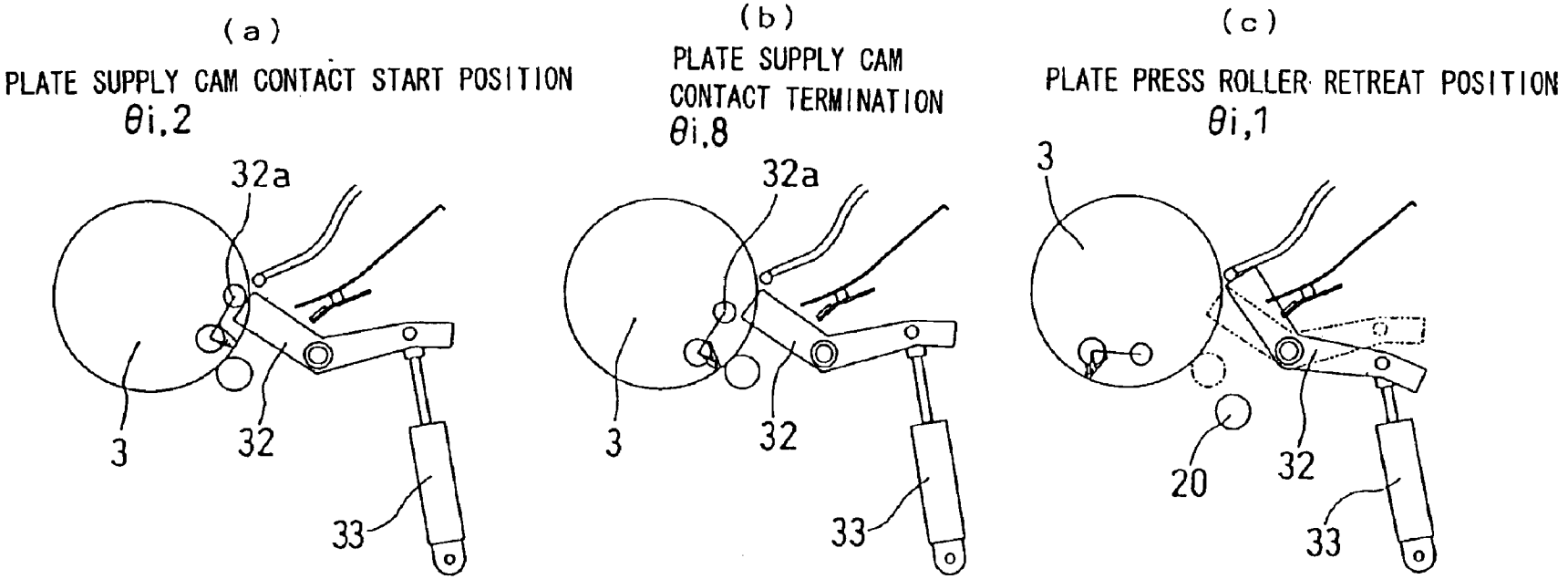
FIGS. 13(*a*) to 13(*c*) are explanation drawings of various operating positions during plate supply.
Figure 14:
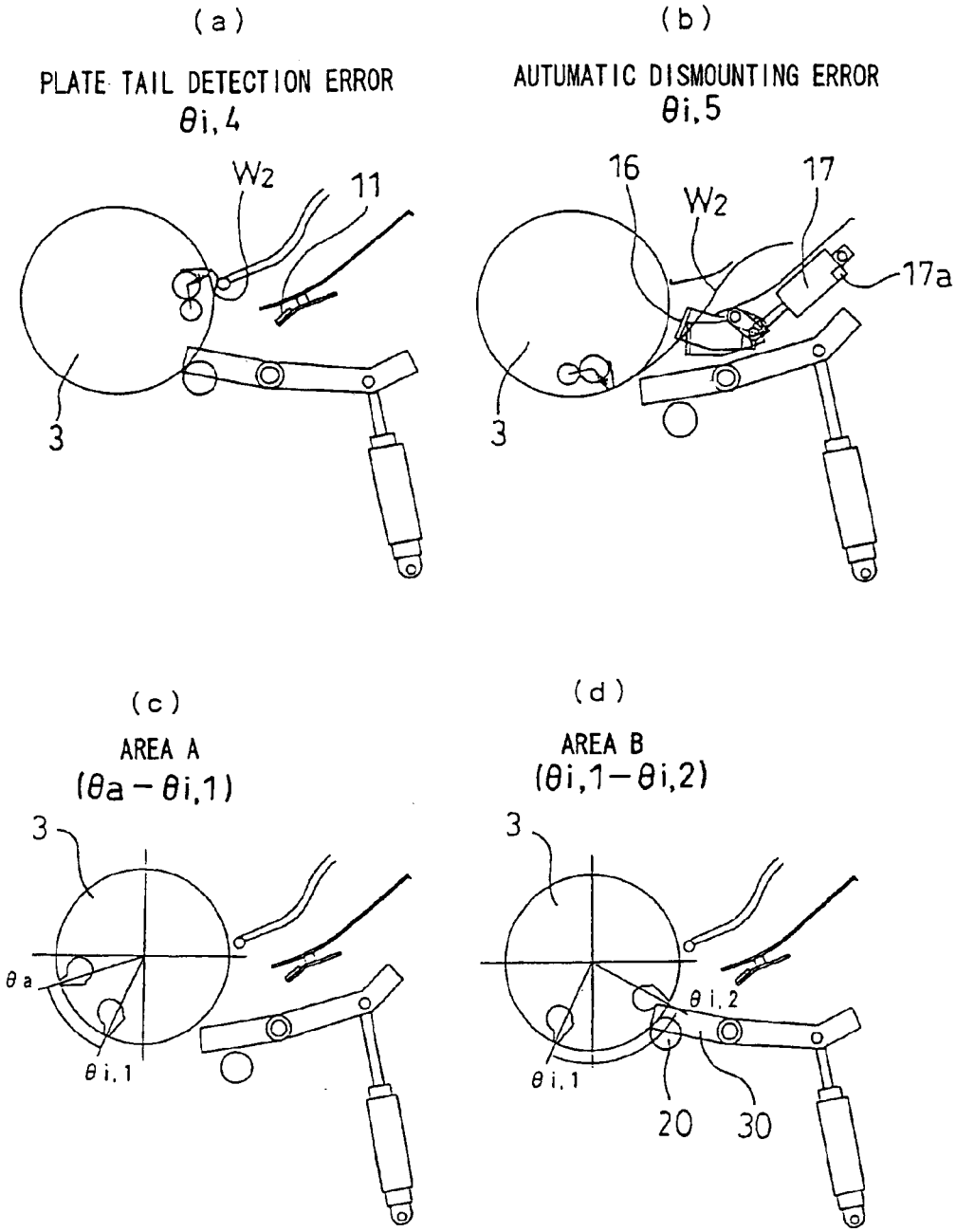
FIGS. 14(*a*) to 14(*d*) are explanation drawings of action areas, except for those of error units, during an error in plate removal.
Figure 15:
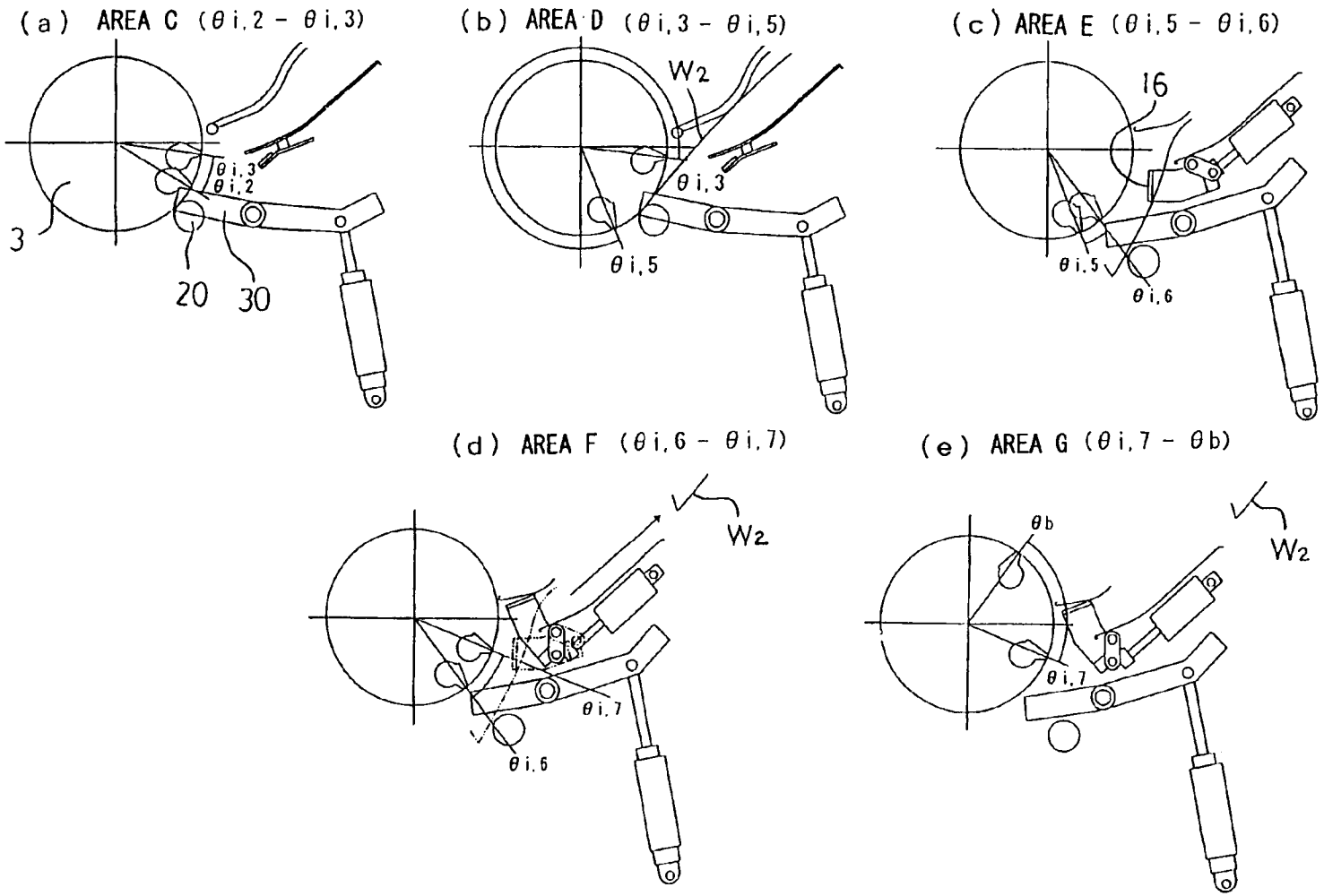
FIGS. 15(*a*) to 15(*e*) are explanation drawings of action areas, except for those of the error units, during the error in plate removal.
Figure 16:
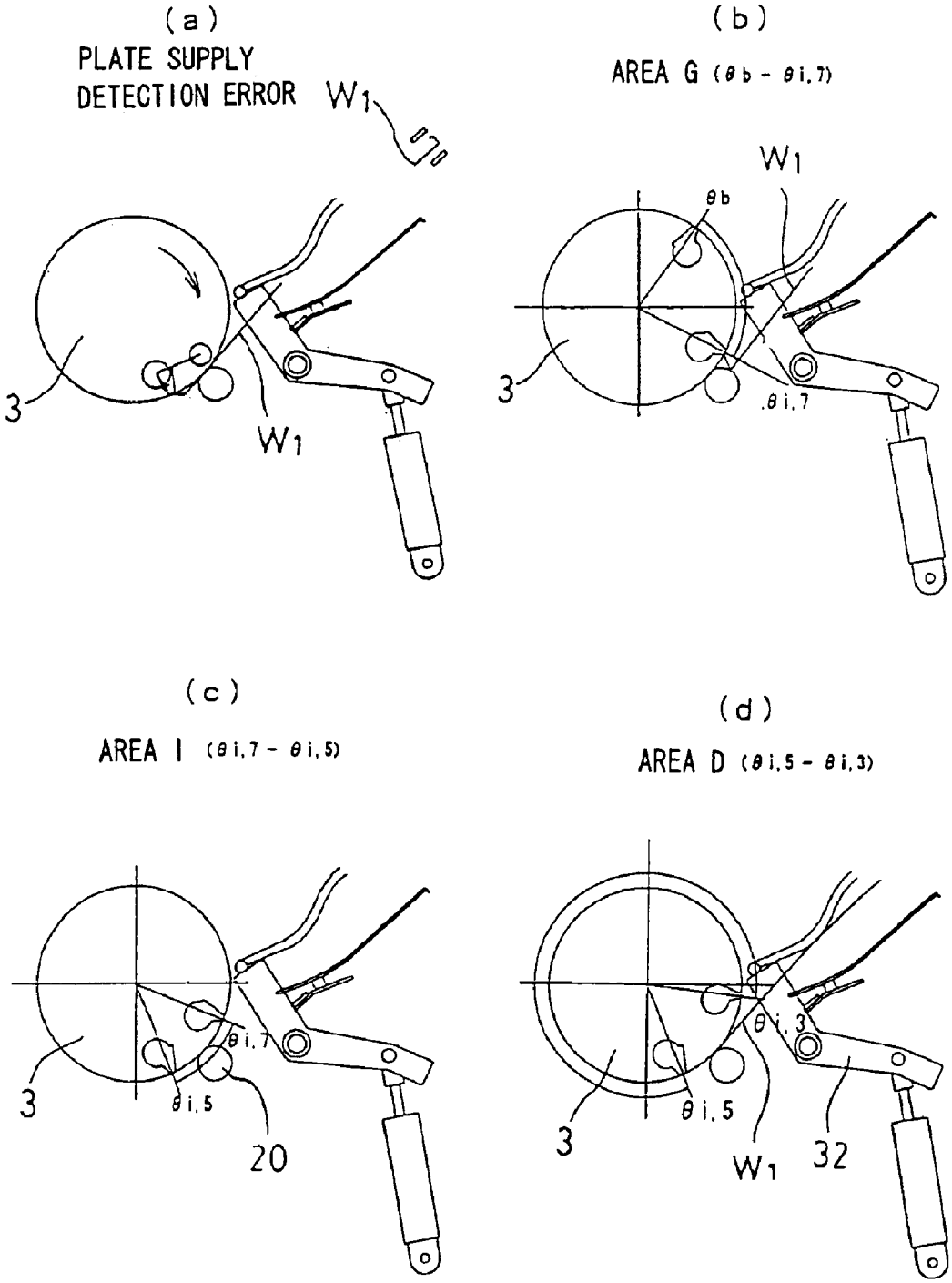
FIGS. 16(*a*) to 16(*d*) are explanation drawings of action areas, except for those of error units, during an error in plate supply.
Figure 17:
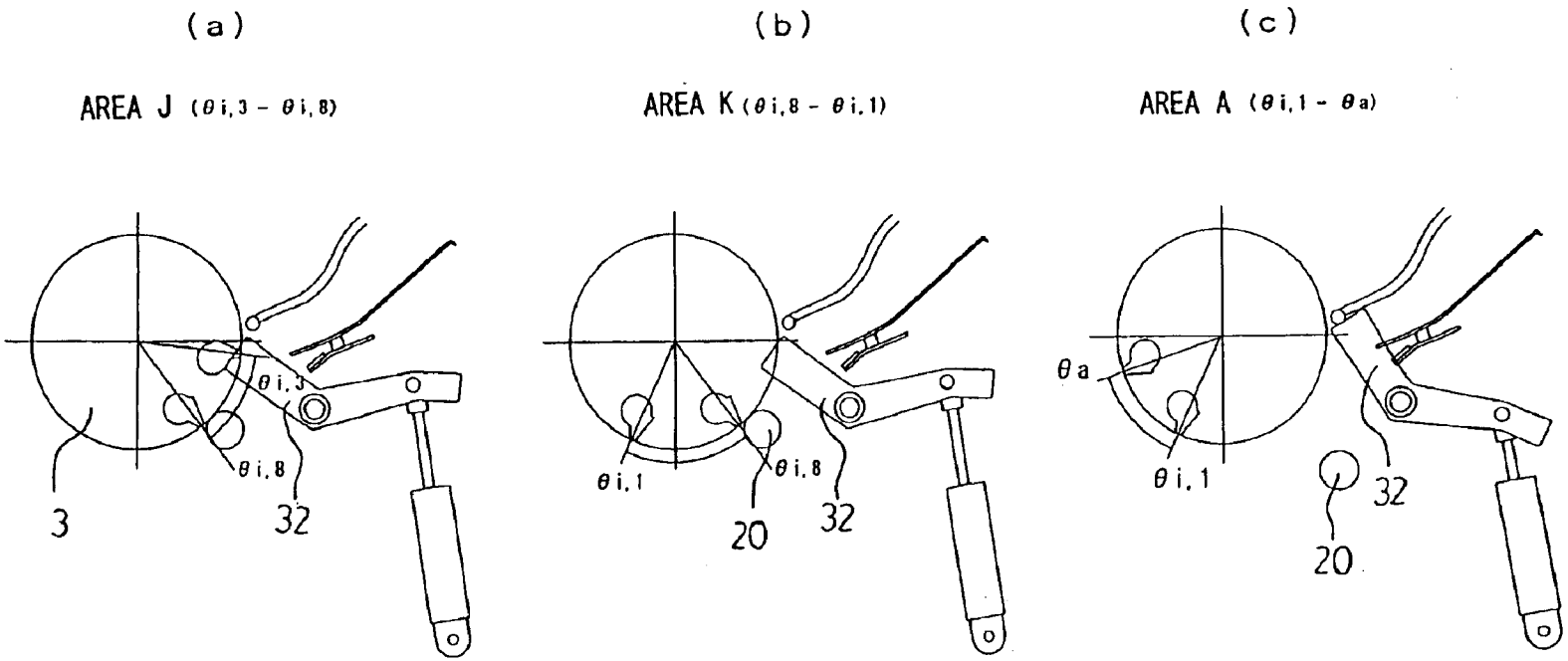
FIGS. 17(*a*) to 17(*c*) are explanation drawings of action areas, except for those of the error units, during the error in plate supply.
Figure 19:
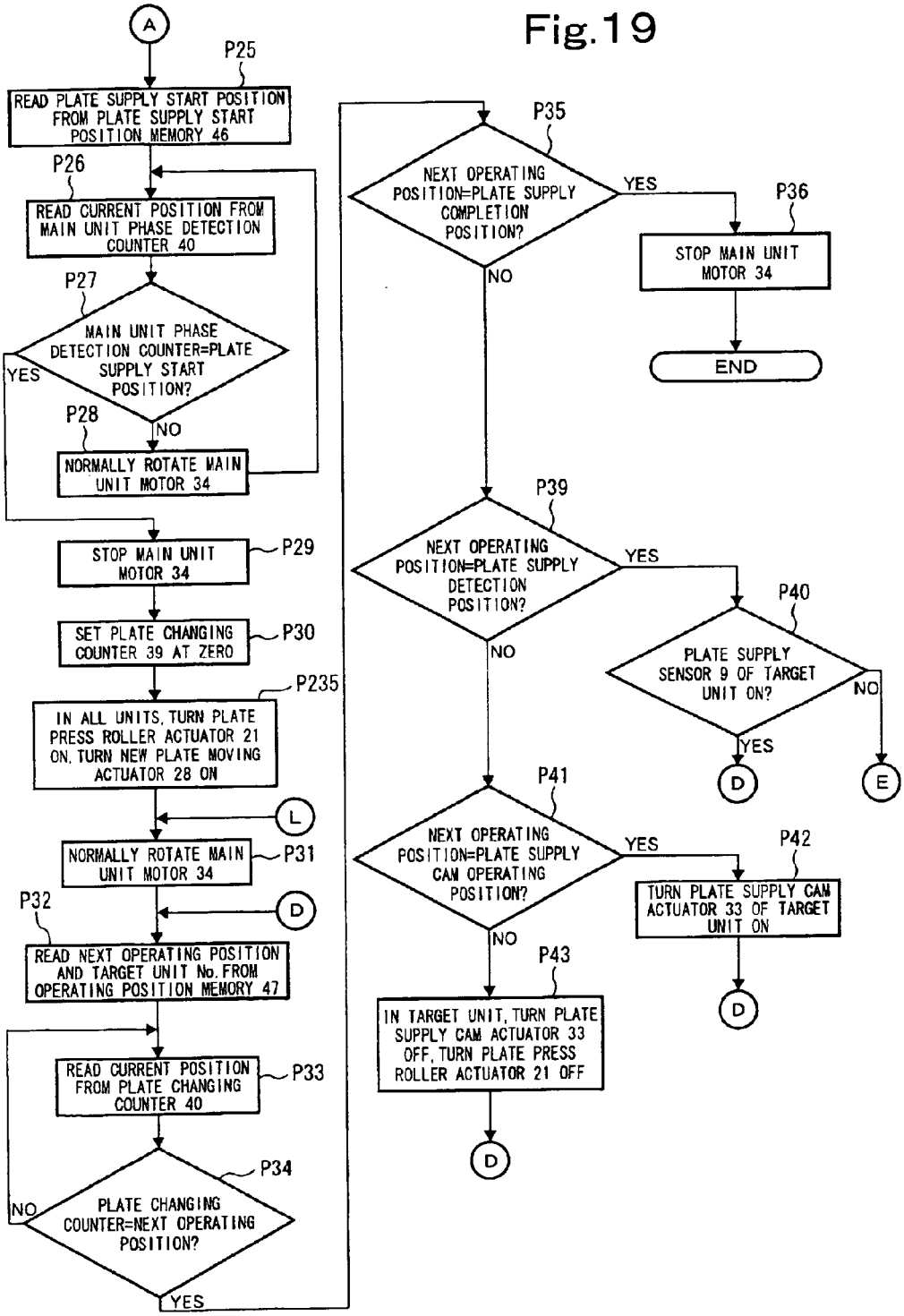
FIG. 19 is a flow chart for a plate supply step.
Figure 22:
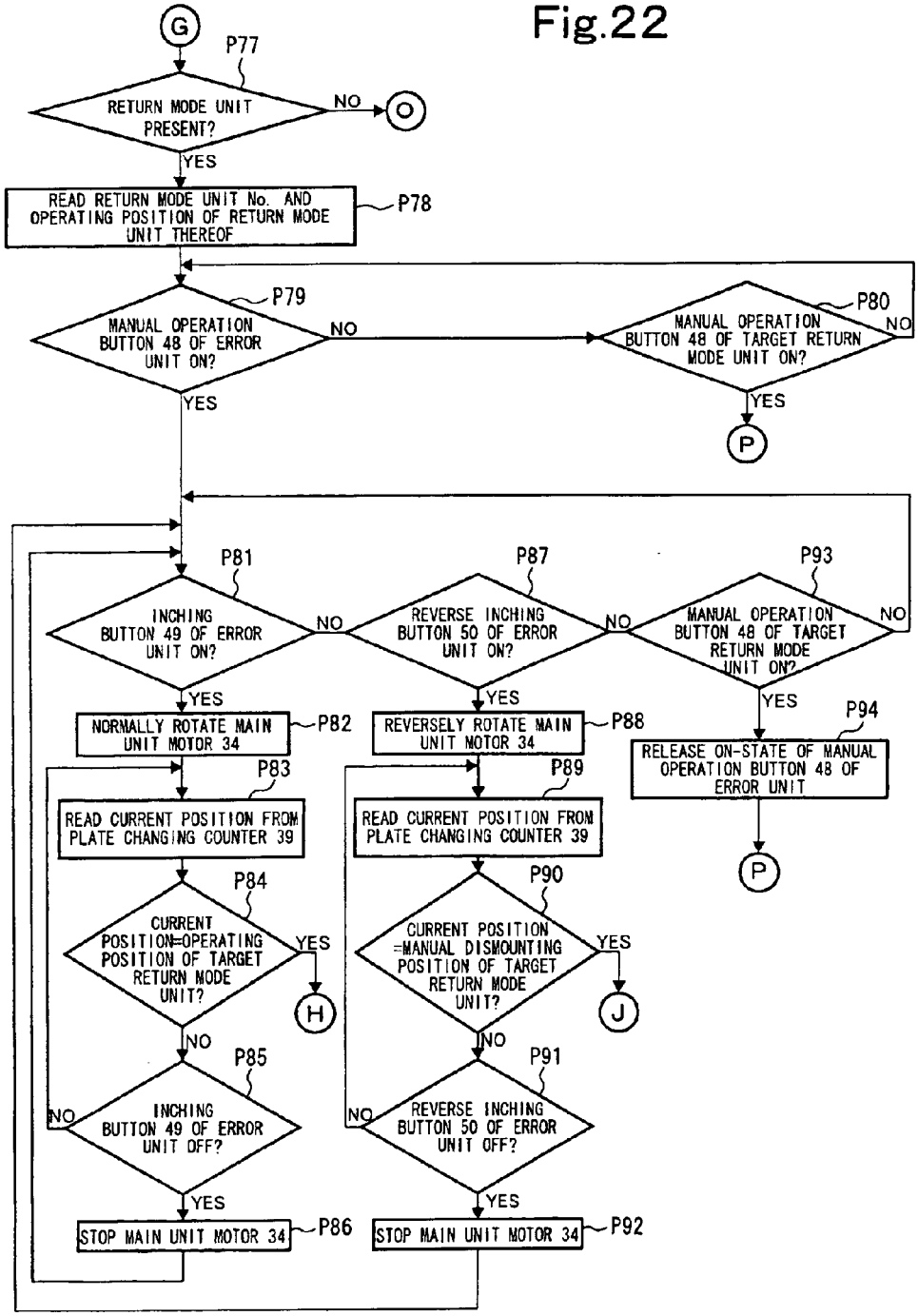
FIG. 22 is a flow chart for an error elimination step.
Figure 23:
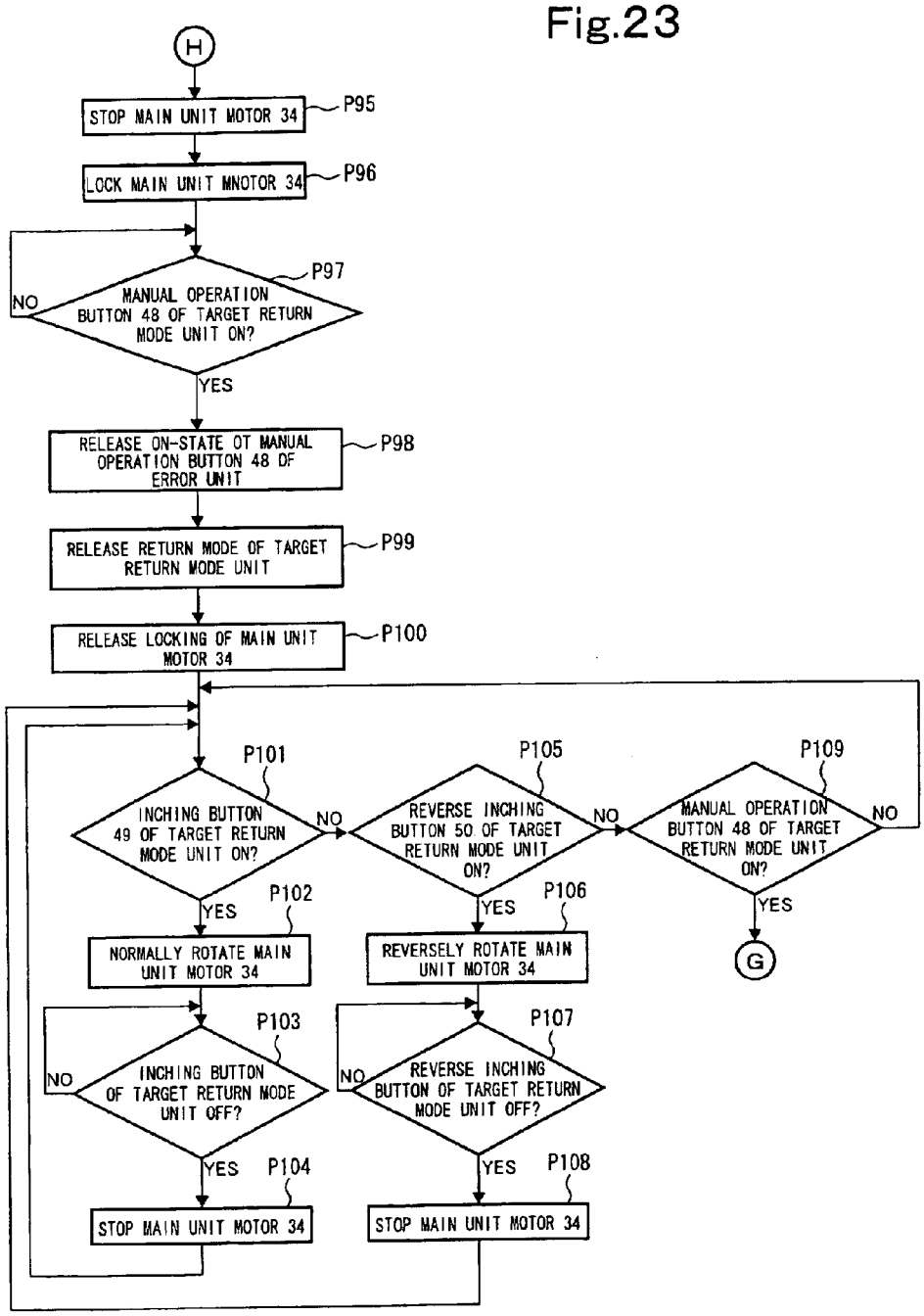
FIG. 23 is a flow chart for a second return step.
Figure 24:
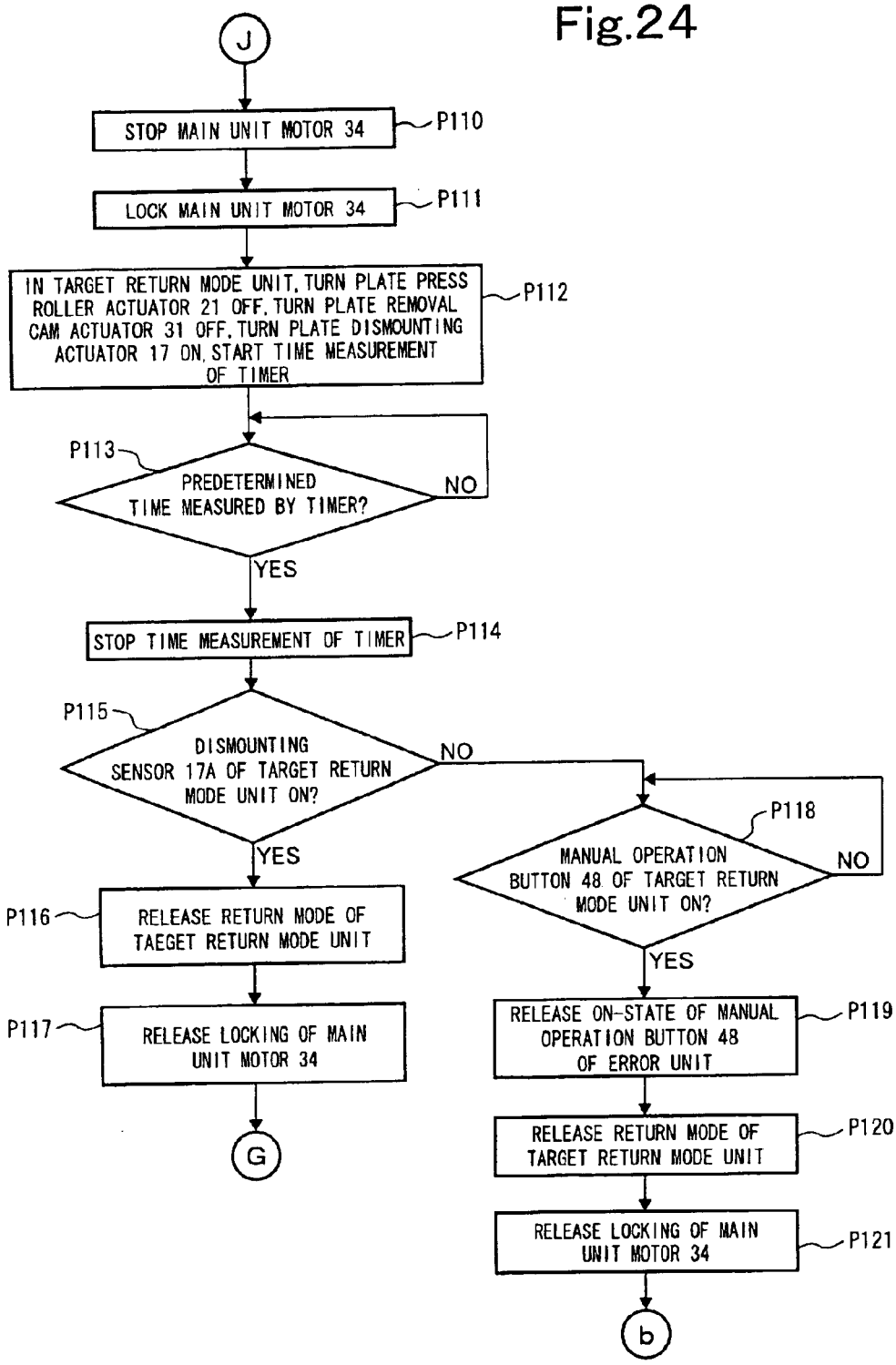
FIG. 24 is a flow chart for the second return step.
Figure 25:
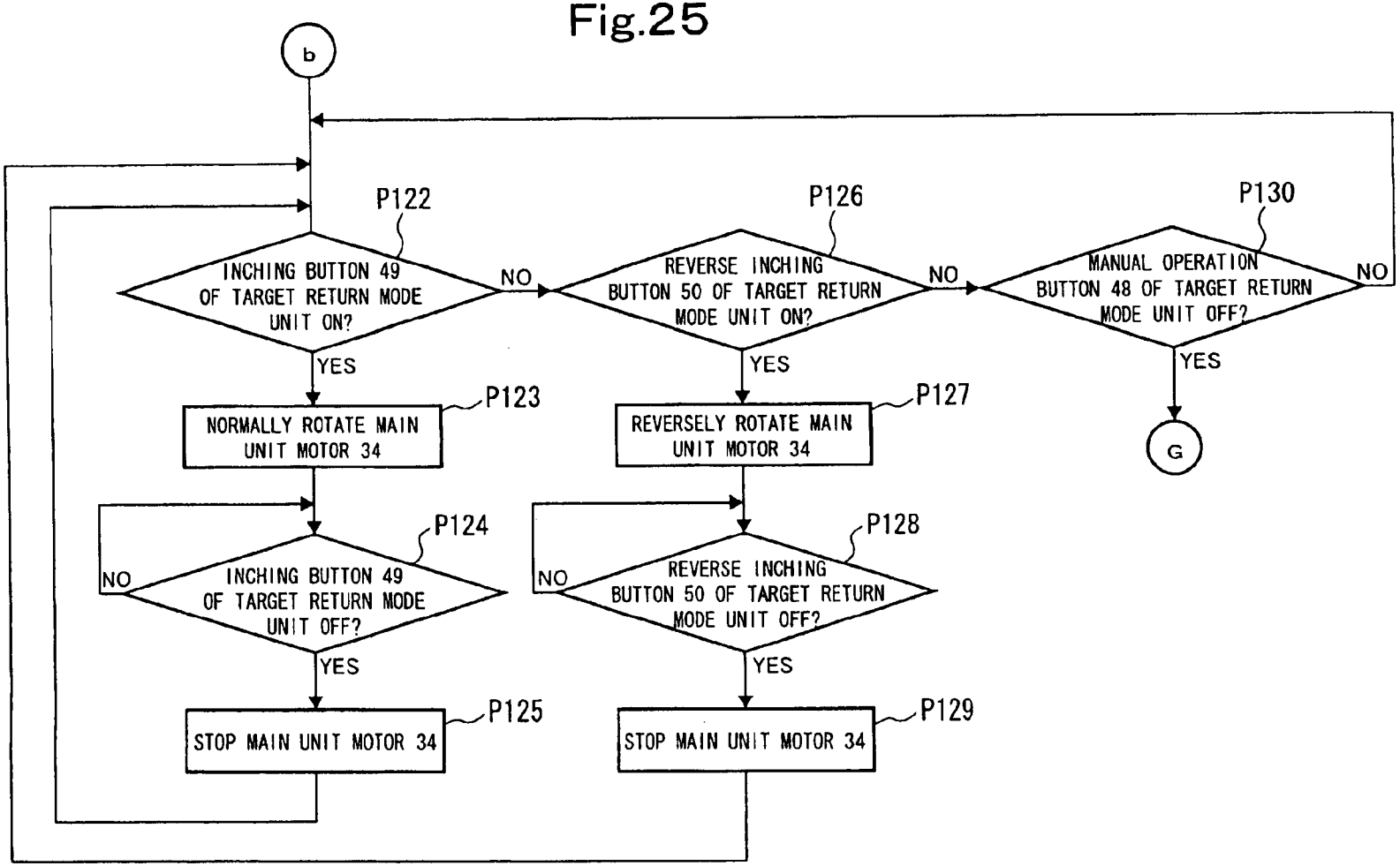
FIG. 25 is a flow chart for the second return step.
Figure 26:
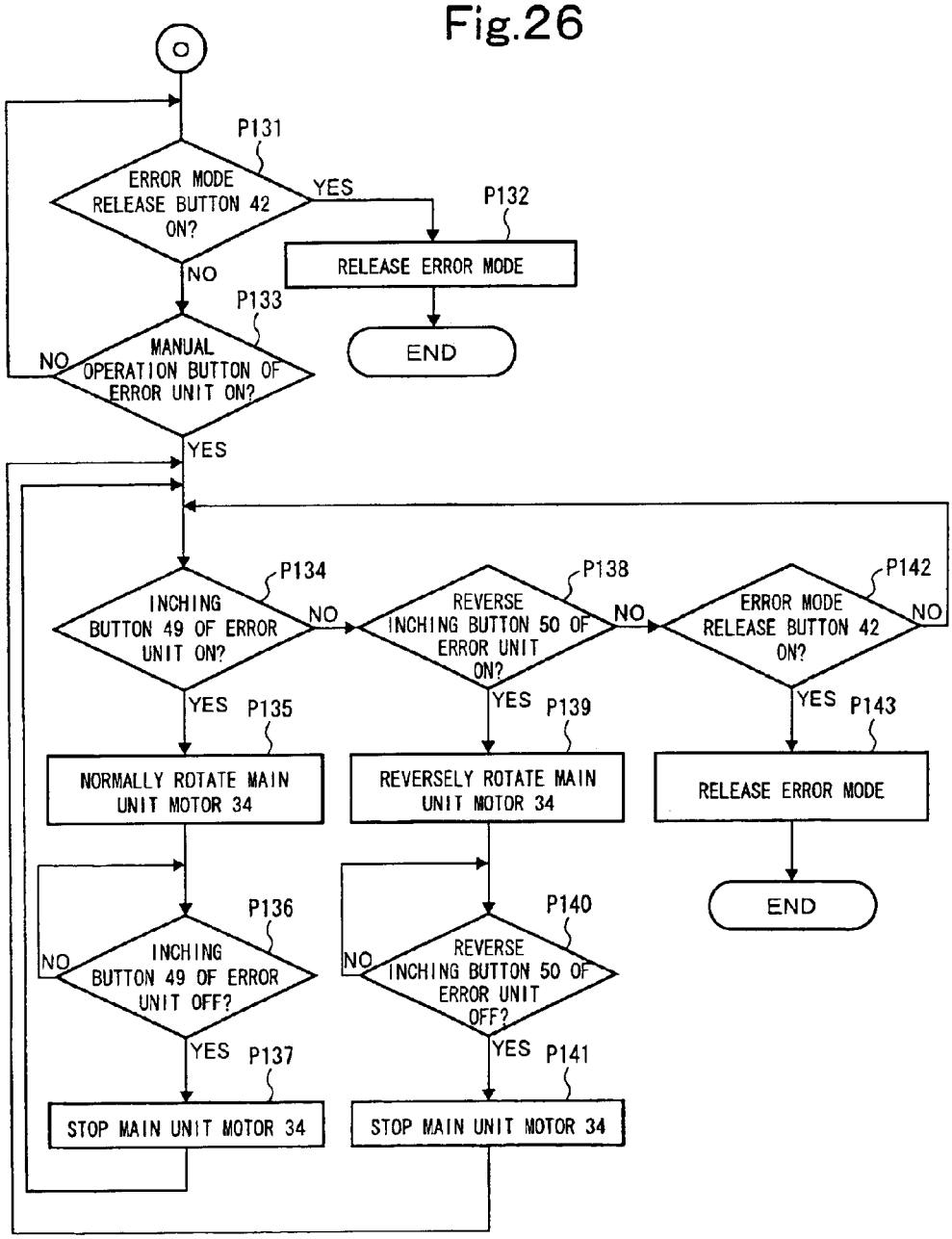
FIG. 26 is a flow chart for the error elimination step.
Figure 28:
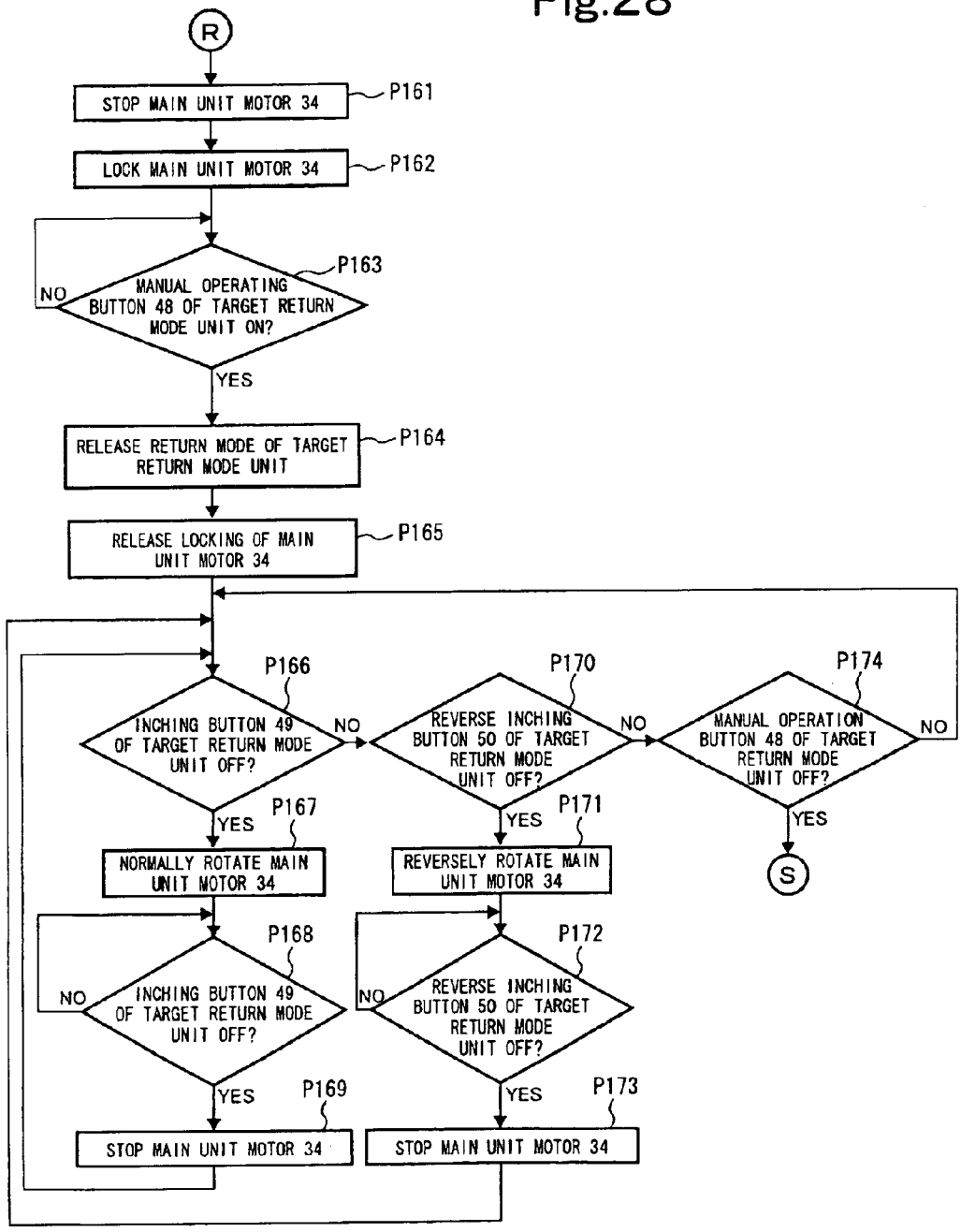
FIG. 28 is a flow chart for the third return step.
Figure 29:
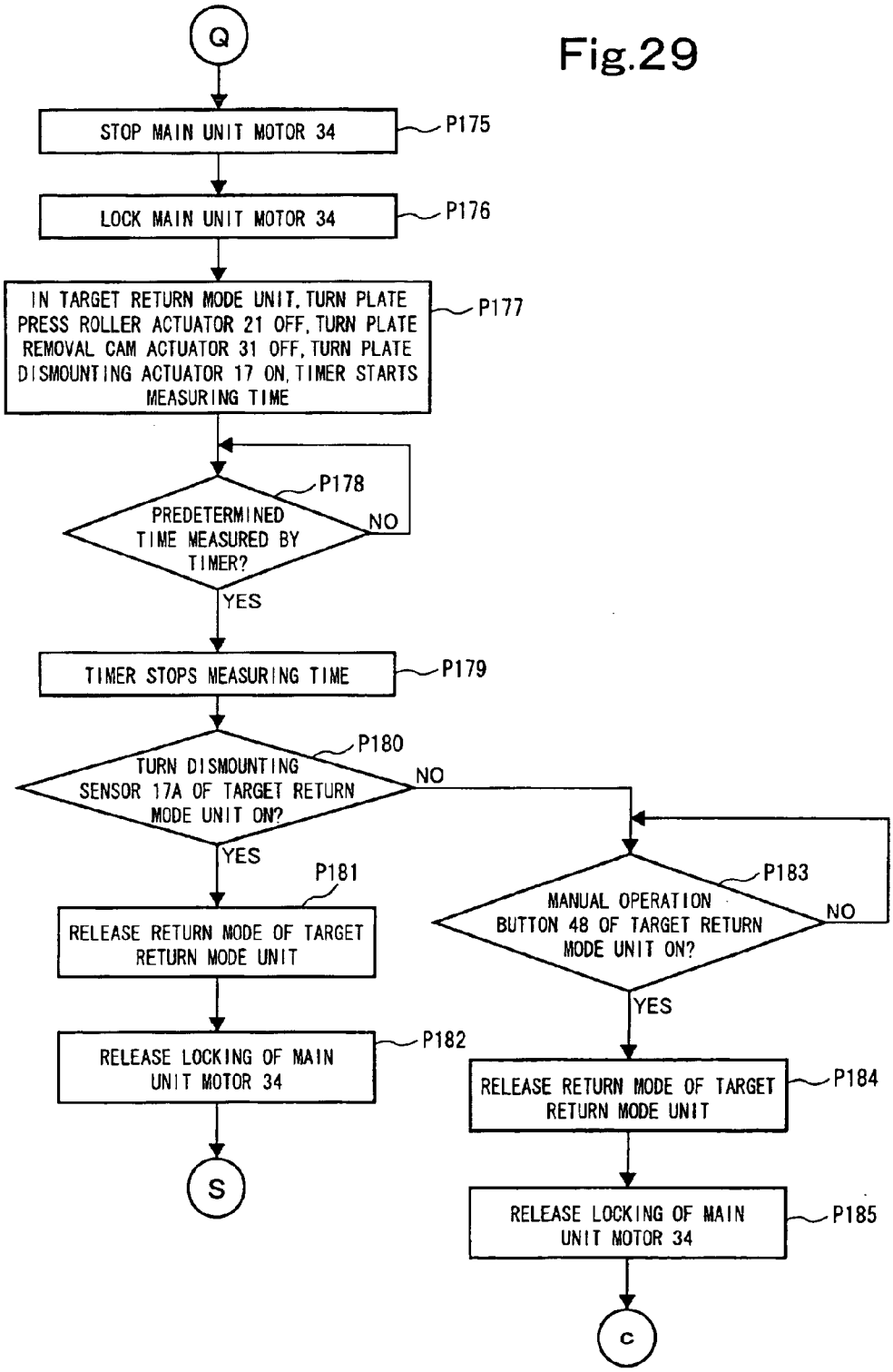
FIG. 29 is a flow chart for the third return step.
Figure 30:
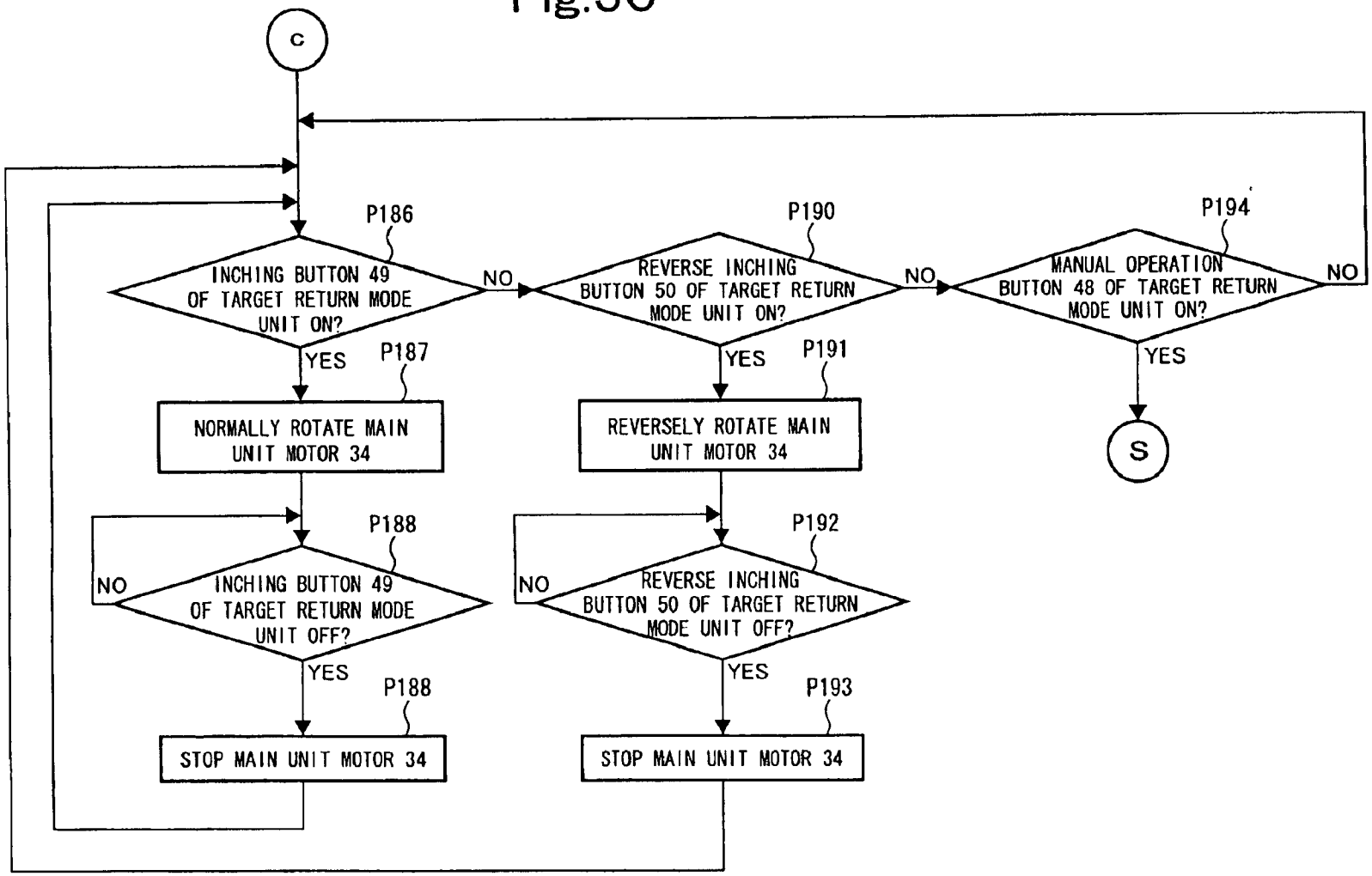
FIG. 30 is a flow chart for the third return step.
Figure 31:
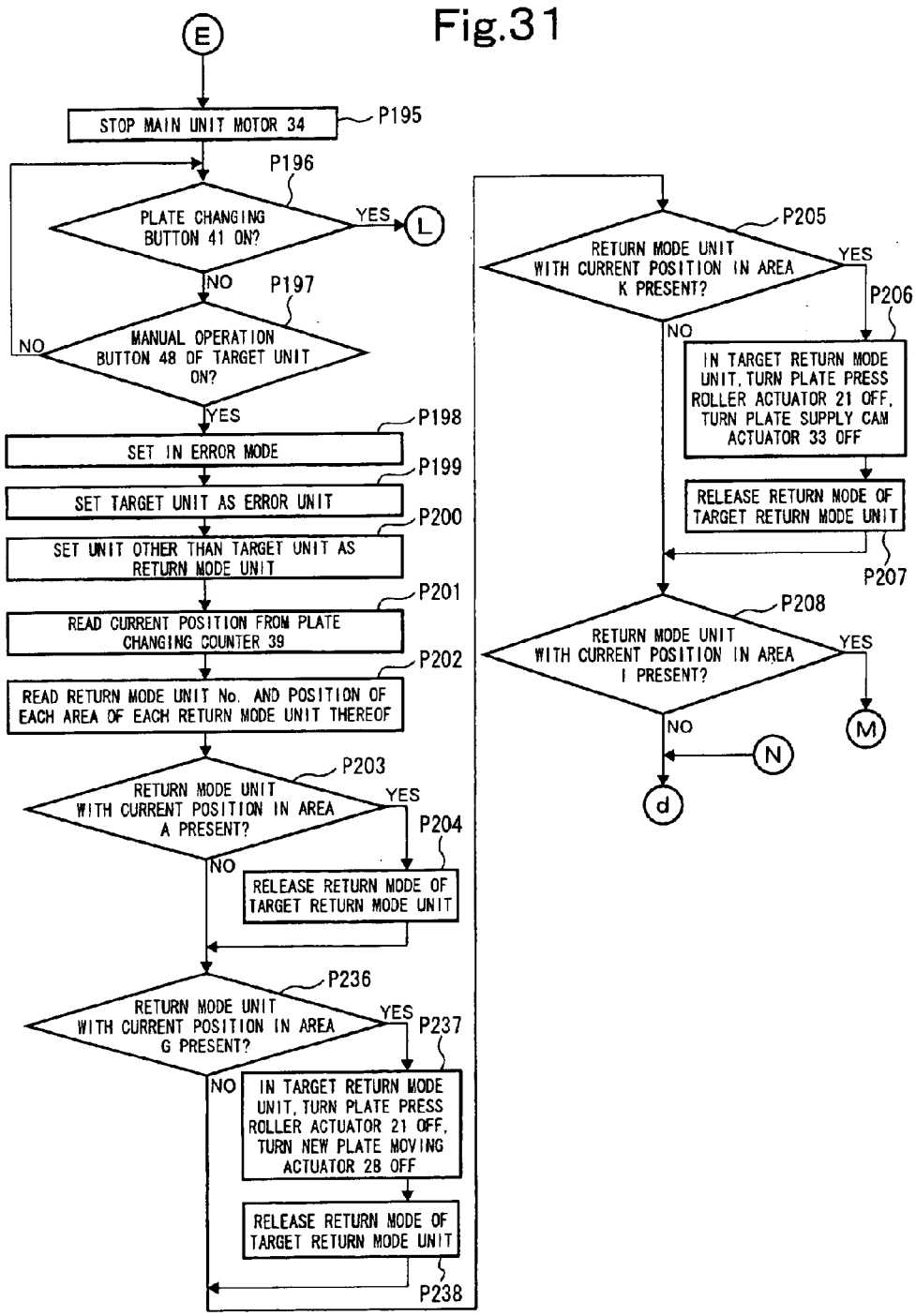
FIG. 31 is a flow chart for the first return step.
Figure 32:
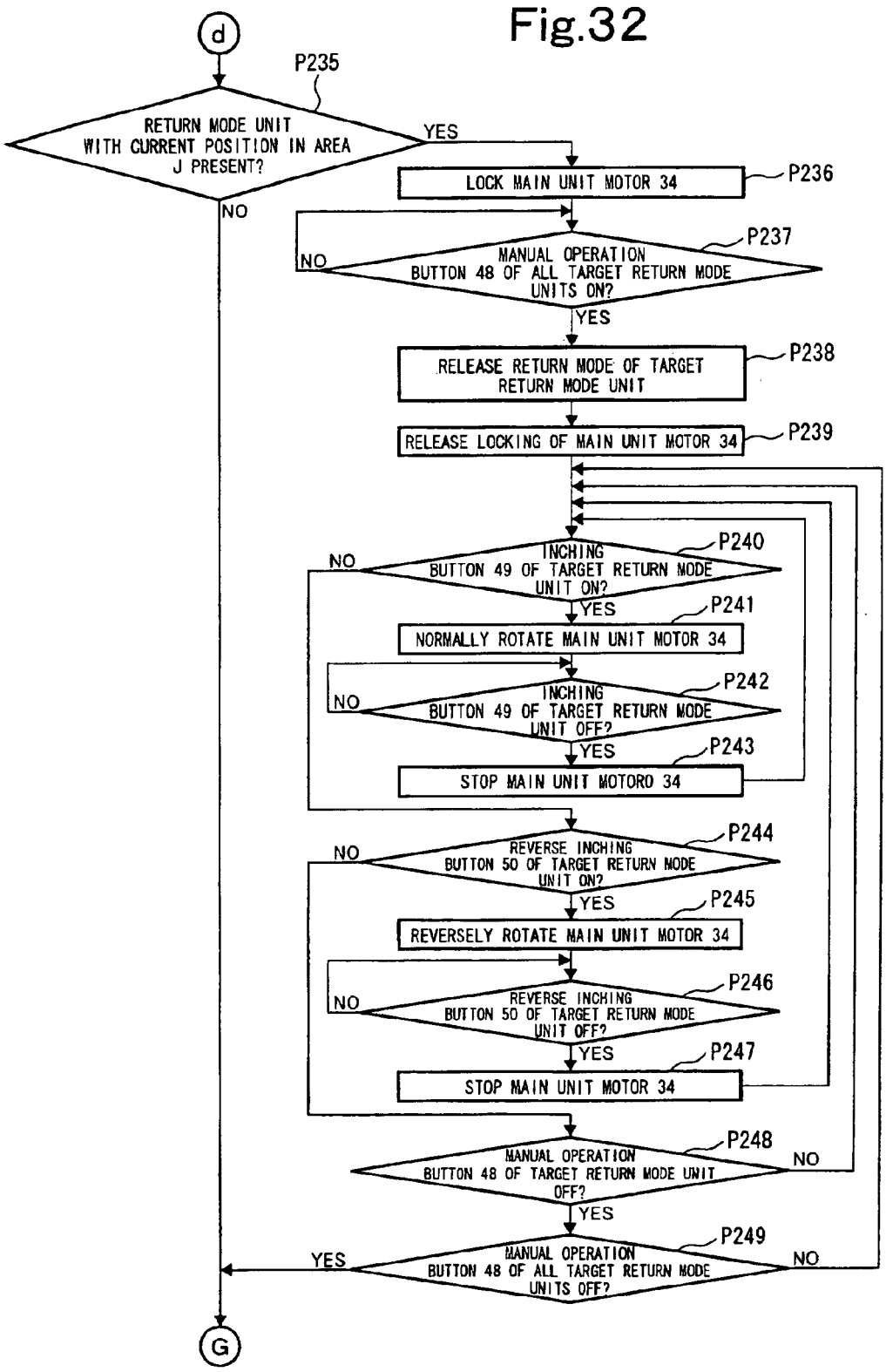
FIG. 32 is a flow chart for the first return step.
Figure 33:
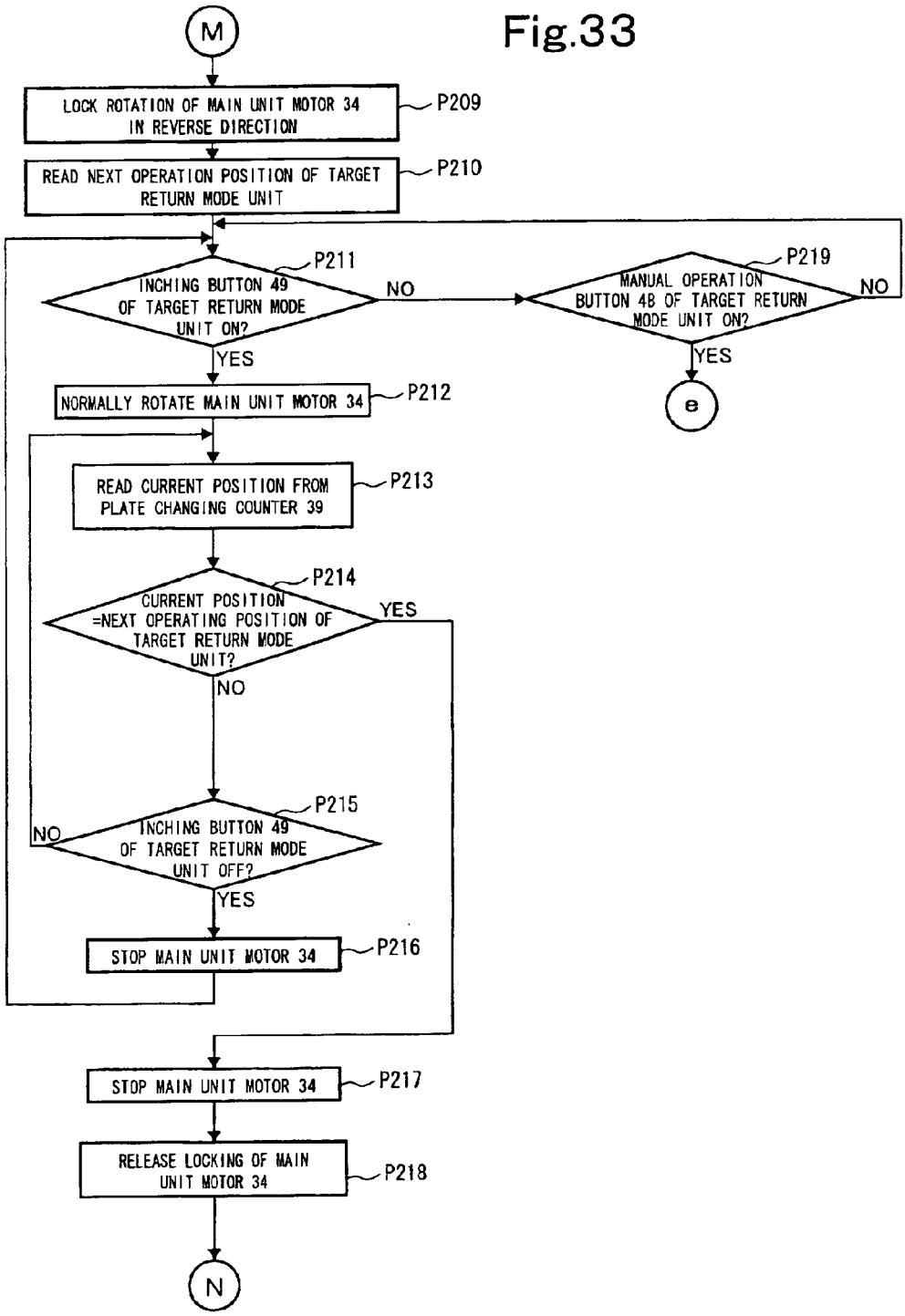
FIG. 33 is a flow chart for the first return step.
Figure 34:
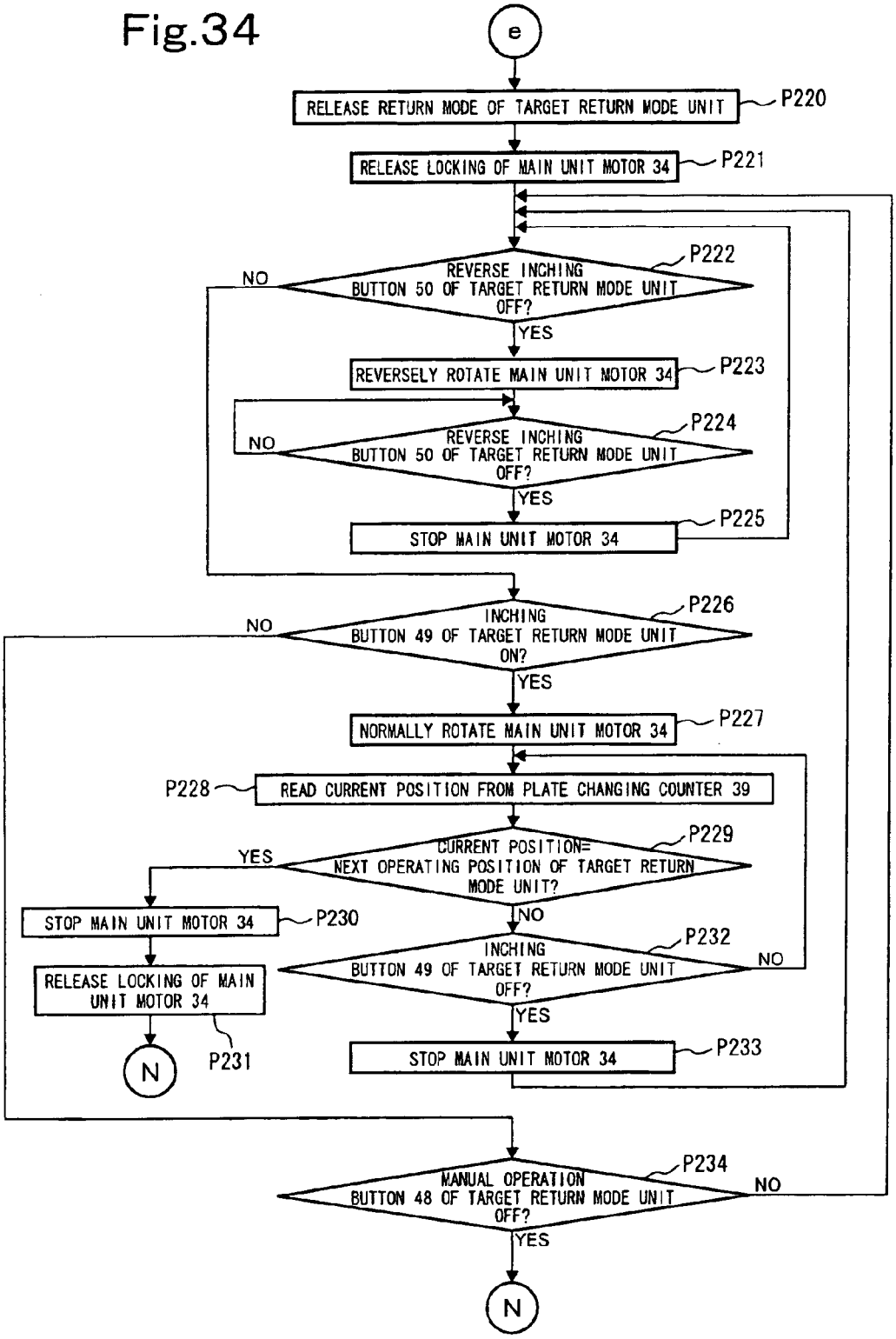
FIG. 34 is a flow chart for the first return step.

FIG. 1 is a schematic configuration drawing of an automatic plate changer and its surroundings of a perfecting printing press showing an embodiment of the present invention. FIG. 2 is a plan view of a loader. FIG. 3 is a rear view of the loader. FIG. 4 is an enlarged view of a moving plate guide portion. FIG. 5 is an enlarged view of a plate gripping/extracting guide portion. FIG. 6 is an enlarged view of a plate press roller portion. FIG. 7 is a perspective view of a plate cylinder. FIG. 8 is a control block diagram. FIG. 9 is a time-chart showing the operating positions of printing units during plate changing. FIGS. 10(*a*) to 10(*d*) are explanation drawings of various operating positions during plate removal. FIGS. 11(*a*) to 11(*c*) are explanation drawings of various operating positions during plate removal. FIGS. 12(*a*) to 12(*d*) are explanation drawings of various operating positions during plate supply. FIGS. 13(*a*) to 13(*c*) are explanation drawings of various operating positions during plate supply. FIGS. 14(*a*) to 14(*d*) are explanation drawings of action areas, except for those of error units, during an error in plate removal. FIGS. 15(*a*) to 15(*e*) are explanation drawings of action areas, except for those of the error units, during the error in plate removal. FIGS. 16(*a*) to 16(*d*) are explanation drawings of action areas, except for those of error units, during an error in plate supply. FIGS. 17(*a*) to 17(*c*) are explanation drawings of action areas, except for those of the error units, during the error in plate supply. FIG. 18 is a flow chart for a plate removal step. FIG. 19 is a flow chart for a plate supply step. FIG. 20 is a flow chart for a first return step. FIG. 21 is a flow chart for the first return step. FIG. 22 is a flow chart for an error elimination step. FIG. 23 is a flow chart for a second return step. FIG. 24 is a flow chart for the second return step. FIG. 25 is a flow chart for the second return step. FIG. 26 is a flow chart for the error elimination step. FIG. 27 is a flow chart for a third return step. FIG. 28 is a flow chart for the third return step. FIG. 29 is a flow chart for the third return step. FIG. 30 is a flow chart for the third return step. FIG. 31 is a flow chart for the first return step. FIG. 32 is a flow chart for the first return step. FIG. 33 is a flow chart for the first return step. FIG. 34 is a flow chart for the first return step.

As shown in FIG. 1, ink rollers 2, a plate cylinder 3, and a blanket cylinder 4 of an upper printing section (upper printing unit) are rotatably supported between right and left frames 1 of a web rotary press, and a web passing between the blanket cylinder 4 and a blanket cylinder of a lower printing section (lower printing unit) is subjected to printing. It goes without saying that the upper printing unit and the lower printing unit constitute a set, and a plurality of such sets are arranged in line in the direction of travel of the web, and that these cylinders are rotated in an interlocked manner by a drive device (to be described later) via a power transmission mechanism, although these features are not shown.

An automatic plate changer (plate changing means) is annexed to each of the upper printing unit and the lower printing unit of each of the sets mentioned above. The automatic plate changers in the upper printing unit and the lower printing unit are of nearly the same basic construction. Moreover, various constructions can be applied for them. Thus, only the automatic plate changer of the upper printing unit will be taken as an example, and explained briefly.

As shown in FIGS. 2 and 3 as well, a loader (plate accommodation portion) 6 is supported between the right and left frames 1 so as to be rotatable about a pivot shaft 5 (see the locus of rotation, C, in FIG. 1). Within the loader 6, a new plate $W_1$ and a removal plate $W_2$ are to be gripped by a new plate hooking member 7 and a removal plate hooking member 8, respectively.

For a plate supply, the loader 6 is rotated counterclockwise to the illustrated state by an actuator (not shown). Then, the new plate hooking member 7, with which the trailing edge of the new plate $W_1$ is engaged, is moved obliquely downwardly from an ascent limit by a new plate moving actuator (new plate moving means) 28, such as a rodless cylinder, whereby the new plate $W_1$ is supplied to the plate cylinder 3. Then, the new plate $W_1$ is wrapped around the circumferential surface of the plate cylinder 3 while being pulled out of the loader 6 by rotation of the plate cylinder 3. The state of new plate supply at this time is detected by a pair of light projecting/receiving plate supply sensors (new plate detecting means) 9 provided in the loader 6 near a descent limit of the new plate hooking member 7. That is, when the plate supply is carried out normally, the new plate $W_1$ is wrapped around the circumferential surface of the plate cylinder 3 while being pulled out of the loader 6 by rotation of the plate cylinder 3. Thus, the trailing edge of the new plate $W_1$ does not shut off the plate supply sensors 9 at a predetermined time. However, if the leading edge of the new plate $W_1$ is not inserted, or is incompletely inserted, into a gap 26 of the plate cylinder 3, for example, the amount of movement of the new plate $W_1$ by rotation of the plate cylinder 3 is so small that the plate supply sensors 9 remain shut off without passage of the trailing edge of the new plate $W_1$ through the plate supply sensors 9 at the predetermined time. In short, when the plate supply sensors 9 remain shut off without passage of the new plate $W_1$ through the plate supply sensors 9 at the predetermined time, it is determined that an abnormality in plate supply has occurred.

For a plate removal, on the other hand, with the loader 6 being located at the same position as mentioned above, the removal plate hooking member 8, with which the trailing edge of the removal plate $W_2$ is engaged, is moved obliquely in an upward direction from the descent limit by a removal plate accommodation actuator (removal plate accommodating means) 29, such as a rodless cylinder, whereby the removal plate $W_2$ is accommodated into the loader 6.

Between the right and left frames 1, a stationary plate guide 13 is provided via a bracket 12, and a moving plate guide 10 is supported so as to be swingable between an advance position (shown in FIG. 1) and a retreat position, where the moving plate guide 13 comes into a nearly vertical state, about a pivot shaft 15 by an actuator 14, such as an air cylinder. As shown in FIG. 4, at the time of the plate removal, the trailing edge of the removal plate $W_2$ released from holding by the plate cylinder 3 is discharged into a spacing between the stationary plate guide 13 and the moving plate guide 10 in accordance with the rotation of the plate cylinder 3 in a counterclockwise direction in FIG. 4. The state of the plate removal at this time is detected by a reflection type plate tail sensor (first removal plate detecting means) 11 provided at the front end of the moving plate guide 10, as shown in FIG. 4. That is, if the plate removal is carried out normally, the trailing edge of the plate is discharged into spacing between the stationary plate guide 13 and the moving plate guide 10, and the plate tail sensor 11 detects this discharge. If the trailing edge of the plate is not discharged into spacing between the stationary plate guide 13 and the moving plate guide 10, however, the plate tail sensor 11 does not detect the trailing edge of the removal plate $W_2$ at a predetermined time, whereby it is determined that an abnormality in plate removal has occurred. As shown in FIG. 5, moreover, a plate dismounting guide (removal/holding means) 16 is supported by the moving plate guide 10 so as to be swingable between a holding/release position (indicated by solid lines in FIG. 5) and a removal/holding position (indicated by double-dotted chain lines in FIG. 5) about a pivot shaft 18 by a plate dismounting actuator 17, such as an air cylinder, via a lever 19. At the time of the plate removal, the plate dismounting guide 16 is swung from the holding/release position to the removal/holding position to pull the leading edge of the removal plate $W_2$ out of the gap 26 of the plate cylinder 3 and hold the removal plate $W_2$ while separating its leading edge from the plate cylinder 3. The removal/holding position of the plate dismounting guide 16 is detected by a dismounting sensor (second removal plate detecting means) 17*a*, such as a position sensor housed in an air cylinder or the like, as the maximum contraction position of the plate dismounting actuator 17, whereby it is detected, as by the plate tail sensor 11, whether there is an abnormality in the state of the plate removal. That is, in the case of a normal plate removal, the leading edge of the removal plate $W_2$ is pulled out of the gap 26 of the plate cylinder 3 by the plate dismounting guide 16, and the removal plate $W_2$ is held at the removal/holding position. In other words, the plate dismounting actuator 17 is maximally contracted, and this maximum contraction is detected by the dismounting sensor 17*a*. However, if the leading edge of the removal plate $W_2$ is not disengaged from the gap 26 of the plate cylinder 3, for example, the plate dismounting guide 16 cannot swing to the removal/holding position. In other words, the dismounting sensor 17*a* does not detect the maximum contraction of the plate dismounting actuator 17 at a predetermined time, whereby it is determined that an abnormality in the plate removal has occurred.

Between the right and left frames 1 and below the moving plate guide 10, a plate press roller 20 is supported so as to be swingable between an advance position (see a double-dotted chain line in FIG. 6), where the plate press roller 20 contacts the plate cylinder 3, and a receding position (see a solid line in FIG. 6), where the plate press roller 20 separates from the plate cylinder 3, about a pivot shaft 22 by a plate press roller actuator 21, such as an air cylinder, via a bell crank 23, as shown in FIG. 6.

In FIGS. 1, 5, and 6, reference numeral 25 denotes a winding bar (plate holding means) rotatably fitted within the gap 26 of the plate cylinder 3. Within the winding bar 25, a plurality of U-shaped leaf springs 27 is mounted in an axial direction. As the winding bar 25 is rotated in a predetermined direction, the leaf springs 27 engage and disengage from the trailing edge and leading edge of the plate, and can thereby clamp and unclamp the plate, under the action of a clamping/unclamping mechanism (plate switching means) such as a plate removal cam 30 and a plate removal cam actuator 31 (see FIG. 8 and FIGS. 10(*a*) to 10(*d*)), or a plate supply cam 32 and a plate supply cam actuator 33 (see FIG. 8 and FIGS. 12(*a*) to 12(*d*)). In FIGS. 2 and 3, reference numeral 6*a* denotes a guide bar for accommodating and guiding the removal plate $W_2$ below it, while reference numeral 6*b* denotes a guide bar for accommodating and guiding the new plate $W_1$ between the guide bar 6*a* and the guide bar 6*b*. The guide bar 6*b* is provided with a catching portion 6*ba* which the new plate hooking member 7 engages during downward movement to become thrown up to a position where the new plate hooking member 7 does not interfere with the new plate $W_1$.

The various actuators 14, 17, 21 . . . are driven and controlled by a CPU 35 as a control device, such as a microcomputer, which also controls a main unit motor 34 as the aforementioned drive device for imparting interlocked rotations to all of the plate cylinders 3 of the respective printing units, as shown in FIG. 8.

That is, the various actuators, such as the plate dismounting actuator 17, plate press roller actuator 21, new plate moving actuator 28, removal plate accommodation actuator 29, plate removal cam actuator 31, and plate supply cam actuator 33, which are provided in each of the printing units for the first color to the Nth color, are connected to the CPU 35 by a bus-line BUS via an input-output device 36*a*. The main unit motor 34, on the other hand, is connected to the CPU 35 by the bus-line BUS via a motor driver 37 and an input-output device 36*b*. A rotary encoder 38 is annexed to the main unit motor 34, and its rotational speed signals are inputted into a plate changing counter 39 and a main unit phase detecting counter 40, and then connected to the CPU 35 by the bus-line BUS via the input-output device 36*b*.

A plate changing button (switch) 41 and an error mode release button (switch) 42, which are provided in an operating panel (not shown), are connected to the CPU 35 by the bus-line BUS via an input-output device 36*c*. A fixed memory 43 and an alterable memory 44 are connected to the CPU 35 by the bus-line BUS, together with a plate removal start position memory 45, a plate supply start position memory 46, and a memory 47 for various operating positions.

Furthermore, detection signals of the plate supply sensor 9, plate tail sensor 11, and dismounting sensor 17*a*, which are provided in each of the printing units for the first color to the Nth color, are connected to the CPU 35 by the bus-line BUS via an input-output device 36*d*. Also, a manual operation button (switch) 48 for releasing drive locking of the main unit motor 34, an inching button (switch) 49 for driving the main unit motor 34 in the normal-rotation direction by becoming ON only when pushed, and a reverse inching button (switch) 50 for driving the main unit motor 34 in the reverse-rotation direction by becoming ON only when pushed are similarly provided as drive device driving means in each of the printing units for the first color to the Nth color, and they are connected to the CPU 35 by the bus-line BUS via an input-output device 36*e*. Upon normal rotation of the main unit motor 34, the plate cylinder 3 is rotated clockwise (in the direction of plate supply) in FIG. 5. Upon reverse rotation of the main unit motor 34, the plate cylinder 3 is rotated counterclockwise (in the direction of plate removal) in FIG. 5.

In the aforementioned CPU 35, as shown in FIG. 9, various operating positions during plate changing are set, with a predetermined phase difference among them, for one printing unit. Further, various operating positions of the upper and lower printing units for the 1st color to the Nth color are also set in correspondence with the phase difference of each plate cylinder 3.

In the illustrated example, nine operating positions, i.e., θa, θi,1, θi,2, θi,3, θi,4, θi,5, θi,6, θi,7, and θb, are set for plate removal. Of these positions, θi,6 is a manual dismounting position (manual removal position) which is a dismounting position at the time of an error mode to be described later, and θb is the position of termination of plate removal. As shown in FIGS. 10(*a*) to 10(*d*) and 11(*a*) to 11(*c*), θa is a plate removal start position; θi,1 is a plate removal cam operating position where the plate press roller actuator 21 (see FIG. 6) and the plate removal cam actuator 31 become ON (contracted); θi,2 is a plate removal cam contact start position where a plate removal cam follower 30*a* starts contacting the plate removal cam 30; θi,3 is a plate removal cam contact termination position where the plate removal cam follower 30*a* terminates contact with the plate removal cam 30; θi,4 is a plate tail detection position where the plate tail sensor 11 detects the trailing edge of the removal plate $W_2$; θi,5 is an automatic dismounting position (automatic removal position) where the plate press roller actuator 21 and the plate removal cam actuator 31 become OFF, the plate dismounting actuator 17 becomes ON (contracted), a timer begins measuring time, and detection by the dismounting sensor 17*a* is performed after a lapse of a predetermined time; and θi,7 is a plate accommodation position where the plate dismounting actuator 17 becomes OFF (extended), and the removal plate accommodation actuator 29 (see FIG. 1) become OFF (removal plate hooking member 8 moves to the ascent limit). Here, "i" denotes the unit number and, in the present embodiment, the 1st color lower unit is defined as 1, the 1st color upper unit is defined as 2, . . . the "n" th color (final color) lower unit is defined as 2*n*−1, and the nth color (final color) upper unit is defined as 2*n*.

The flow of a plate removal will be explained. In starting the plate removal, the printing press is located at the plate removal start position θa (FIG. 10(*a*)). At this time, the plate removal cam actuator 31 and the plate press roller actuator 21 are in the OFF state, in which the plate removal cam 30 is located at a plate removal retreat position, and the plate press roller 20 is located at a receding position.

Then, the plate cylinder 3 is rotated in the direction of the plate removal (counterclockwise in FIG. 10(*a*)). When the plate cylinder 3 arrives at the plate removal cam operating position θi,1 (FIG. 10(*b*)), the plate removal cam actuator 31 and the plate press roller actuator 21 become ON, whereby the plate removal cam 30 is located at a plate removal action position, and the plate press roller 20 is located at an advance position.

When the plate cylinder 3 continues to rotate further, the plate removal cam follower 30*a* contacts the plate removal cam 30 at the plate removal cam contact start position θi,2 (FIG. 10(*c*)). At the plate removal cam contact termination position θi,3 (FIG. 10(*d*)), contact of the plate removal cam follower 30*a* with the plate removal cam 30 terminates. As the plate cylinder 3 rotates from θi,2 to θi,3, the plate removal cam follower 30*a* moves while engaging the plate removal cam 30, and the winding bar 25 turns, within the gap 26 of the plate cylinder 3, from a holding position shown in FIG. 10(*c*) to a release position shown in FIG. 10(*d*). Thus, holding of the end of the printing plate is released, whereby the trailing edge of the removal plate $W_2$ bursts out of the gap 26 of the plate cylinder 3. On the other hand, the leading edge of the removal plate $W_2$ is in engagement with the gap of the plate cylinder 3.

As the plate cylinder 3 continues rotation further, the trailing edge of the removal plate $W_2$ advances into spacing between the stationary plate guide 13 and the moving plate guide 10, as shown in FIG. 11(*a*). When the plate cylinder 3 is located at the plate tail detection position θi,4, the plate tail sensor 11 detects the trailing edge of the removal plate $W_2$ to check for an error in plate removal. When plate removal takes place normally, the plate tail sensor 11 detects the trailing edge of the removal plate $W_2$ (FIG. 11(*a*)). In the case of a plate removal error, however, the trailing edge of the removal plate $W_2$ does not advance into spacing between the stationary plate guide 13 and the moving plate guide 10, but the trailing edge of the removal plate $W_2$ passes through a narrow gap between the front end of the stationary plate guide 13 and the plate cylinder 3, so that the plate tail sensor 11 fails to detect the trailing edge of the removal plate $W_2$. A control flow in case of the plate removal error will be described later. A flow of normal plate removal will now be described.

As the plate cylinder 3 continues rotating further, the removal plate $W_2$ is removed from the plate cylinder 3 and entered into the loader 6 shown in FIG. 1. When the plate cylinder 3 is rotated to the automatic dismounting position θi,5 (FIG. 11(*b*)), the plate removal cam actuator 31 and the plate press roller actuator 21 come into the OFF state, in which the plate removal cam 30 is located at the plate removal retreat position and the plate press roller 20 is located at the receding position. Further, the plate dismounting actuator 17 becomes ON, whereby the plate dismounting guide 16 located at the holding release position is turned to the removal holding position. As a result, the leading edge of the removal plate $W_2$ is extracted from the gap 26 of the plate cylinder 3, and the removal plate $W_2$ is held, with its leading edge being separated from the circumferential surface of the plate cylinder 3. In this manner, contact of the removal plate $W_2$ with the plate cylinder 3 of other printing unit, which continues rotating for plate removal, is avoided to prevent damage to the removal plate $W_2$ or the apparatus.

A predetermined time after the plate dismounting actuator 17 becomes ON at the automatic dismounting position θi,5, the dismounting sensor 17*a* checks for an error in plate removal. That is, when plate removal is occurring normally, the plate dismounting actuator 17 is contracted maximally, and this maximum contraction is detected by the dismounting sensor 17*a* (FIG. 11(*b*)). In the event of a plate removal error, the leading edge of the removal plate $W_2$ is not extracted from, but engaged with, the gap 26 of the plate cylinder 3, as shown in FIG. 14(*b*). Thus, the plate dismounting actuator 17 cannot undergo maximum contraction, and the dismounting sensor 17*a* cannot detect its maximum contraction. A control flow in case of the plate removal error will be described later. The flow of a normal plate removal will be described here.

The plate cylinder 3 continues to rotate further, and the plate cylinder 3 rotates to the plate accommodation position θi,7 (11(*c*)). At this time, the plate dismounting actuator 17 becomes OFF, whereby the plate dismounting guide 16 is turned from the removal holding position to the holding release position. The removal plate accommodation actuator, which has been put in the ON state, becomes OFF, whereupon the removal plate hooking member 8 is moved from the position of the double-dotted chain lines to the position of the solid lines in FIG. 1. Thus, the removal plate hooking member 8 moves while hooking the trailing edge of the removal plate $W_2$, so that the removal plate $W_2$ is accommodated into the loader 6.

When the plate cylinder 3 continues rotation further and comes to the plate removal termination position θb, the printing press stops, and a plate supply action is started.

As described earlier, when plate removal is performed normally, the plate cylinder 3 begins to rotate in the direction of plate removal from the plate removal start position θa, and does not stop until plate removal is completed. Thus, a make-ready time required for plate removal can be shortened, and productivity can be increased.

In FIG. 10(*a*), the plate removal start position θa of a certain printing unit is taken as an example, but other printing unit is different from this printing unit in terms of the phase of the plate cylinder. That is, the phase of the plate cylinder 3 at the plate removal start position θa is different among the respective printing units. In other printing unit, therefore, the phase of the plate cylinder 3 is shifted by the amount corresponding to the phase difference of the plate cylinder 3, and plate removal is started. In detail, as shown in FIG. 9, when the printing press makes a reverse rotation from the plate removal start position θa, the 1st color lower unit with unit No. 1 arrives at the plate removal cam operating position θ1,1. Thus, the aforementioned control at the plate removal cam operating position θi,1 is exercised over the 1st color lower unit. Then, the 1st color upper unit with unit No. 2 arrives at the plate removal cam operating position θ2,1, so that control is affected over the 1st color upper unit. Then, the 1st color lower unit arrives at the plate removal cam contact start position θ1,2, and the cam follower 30*a* contacts the plate removal cam 30. While the cam follower 30*a* of the 1st color lower unit is contacting the plate removal cam 30, the 2nd color lower unit with unit No. 3 arrives at the plate removal cam operating position θ3,1; therefore, control is performed over the 2nd color lower unit. In this manner, control is exercised such that during the plate removal step of a certain printing unit, the plate removal step of another printing unit is sequentially started.

Eight operating positions, i.e., θb, θi,7, θi,5, θi,3, θi,2, θi,8, θi,1, and θa, are set for plate supply. Of these positions, θa is a plate supply termination position. As shown in FIGS. 12(*a*) to 12(*d*) and 13(*a*) to 13(*c*), θb is a plate supply start position where the plate press roller actuator 21 (see FIG. 6) is ON, the new plate moving actuator 28 (see FIG. 1) is ON (the new plate hooking member 7 is moved to the descent limit), and a leading edge bend of the new plate $W_1$ is placed on the plate press roller 20; θi,7 is a new plate insertion start position where the leading edge front end of the new plate $W_1$ is opposed to the gap 26 of the plate cylinder 3; θi,5 is a plate supply detection position where the plate supply sensor 9 detects whether the new plate $W_1$ is present or absent; θi,3 is a plate supply cam operating position where the plate supply cam actuator 33 becomes ON (extended); θi,2 is a plate supply cam contact start position where the plate supply cam follower 32*a* starts contact with the plate supply cam 32; θi,8 is a plate supply cam contact termination position where the plate supply cam follower 32*a* terminates contact with the plate supply cam 32; and θi,1 is a plate press roller retreat position (plate supply cam return position) where the plate press roller actuator 21 is OFF (extended), and the new plate moving actuator 28 is OFF (the new plate hooking member 7 is moved to the ascent limit). Here, "i" denotes the unit number and, in the present embodiment, the 1st color lower unit is defined as 1, the 1st color upper unit is defined as 2, . . . the nth color (final color) lower unit is defined as 2*n*−1, and the nth color (final color) upper unit is defined as 2*n*.

The flow of plate supply will now be described. In starting plate supply, the printing press is brought to the plate supply start position θb (FIG. 12(*a*)). The plate supply start position θb is the same position as the aforementioned plate removal termination position θb. At this time, the plate press roller actuator 21 becomes ON, whereby the plate press roller 20 is brought from the position indicated by a double-dotted chain line in the drawing to an advance position indicated by a solid line. Also, the new plate moving actuator 28 becomes ON to move the new plate hooking member 7 from the position of solid lines to the position of double-dotted chain lines in FIG. 1. As a result, the new plate $W_1$ accommodated in the loader 6 is brought close to the plate cylinder 3, and the leading end portion of the new plate $W_1$ is placed on the plate press roller 20. The plate supply cam actuator 33 is in the OFF state, in which the plate supply cam 32 is located at a plate supply retreat position.

Then, the plate cylinder 3 is rotated in the direction of plate supply (clockwise in FIG. 12(*a*)), whereupon the gap 26 of the plate cylinder 3 and the leading front end of the new plate $W_1$ are opposed to each other at the new plate insertion start position θi,7 (FIG. 12(*b*)). Thus, the leading end portion of the new plate $W_1$ is inserted into the gap 26 of the plate cylinder 3. This insertion is performed while the plate cylinder 3 is rotating. Once the leading end portion of the new plate $W_1$ is inserted into the gap 26 of the plate cylinder 3, the new plate $W_1$ is pressed by the plate press roller 20 and brought into intimate contact with the circumferential surface of the plate cylinder 3.

As the plate cylinder 3 continues rotation further, the new plate $W_1$ is wrapped around the circumferential surface of the plate cylinder 3 and pulled out of the loader 6 in accordance with the rotation of the plate cylinder 3. When the plate cylinder 3 comes to the plate supply detection position θi,5 (FIG. 12(*c*)), the plate supply sensors 9 detect the state of plate supply. That is, when plate supply goes on normally, the new plate $W_1$ is pulled out of the loader 6, and the new plate $W_1$ is not existent between the pair of plate supply sensors 9. Thus, the plate supply sensors 9 are not shut off by the new plate $W_1$ (FIG. 12(*c*)). In the event of an error in plate supply, on the other hand, the trailing edge of the new plate $W_1$ shuts off the plate supply sensors 9, because the new plate $W_1$ does not move, or the amount of its movement is small, as shown in FIG. 16(*a*). A control flow at the time of the plate supply error will be described later. The flow of normal plate supply will be described hereinbelow.

When the plate cylinder 3 continues to be rotated further, the trailing edge of the new plate $W_1$ is inserted into the gap 26 of the plate cylinder 3 by the plate press roller 20. At the plate supply cam operating position θi,3 (FIG. 12(*d*)), the plate supply cam actuator 33 become ON to move the plate supply cam 32 from the plate supply retreat position to the plate supply action position.

When the plate cylinder 3 is rotated still further, the plate supply cam follower 32*a* contacts the plate supply cam 32 at the plate supply cam contact start position θi,2 (FIG. 13(*a*)), and the contact of the plate supply cam follower 32*a* with the plate supply cam 32 terminates at the plate supply cam contact termination position θi,8 (FIG. 13(*b*)). In accordance with the rotation of the plate cylinder 3 from θi,2 to θi,8, the plate supply cam follower 32*a* moves while engaging the plate supply cam 32, and the winding bar 25 rotates within the gap 26 of the plate cylinder 3 from the release position shown in FIG. 13(*a*) to the holding position shown in FIG. 13(*b*). Thus, an end portion of the new plate $W_1$ is held by the leaf spring 27.

When the plate cylinder 3 continues rotation further and reaches the plate press roller retreat position θi,1 (FIG. 13(*c*)), the plate supply cam actuator 33 becomes OFF to move the plate supply cam 32 from the plate supply action position to the plate supply retreat position. Also the plate press roller actuator 21 becomes OFF to bring the plate press roller 20 to the receding position.

When the plate cylinder 3 continues rotation further, reaching the plate supply termination position θa, the printing press stops, and a plate changing action is started.

As described above, while plate supply is taking place normally, the plate cylinder 3 begins rotation in the plate supply direction from the plate supply start position θb, and does not stop until plate supply is completed. Thus, a make-ready time taken for plate supply can be shortened, and productivity can be increased.

In FIG. 12(*a*), the plate supply start position θb of a certain printing unit is taken as an example. Other printing units are different from each other in plate cylinder phase, and the phase of the printing plate 3 at the plate supply start position θb is different among the different printing units. In other printing units, therefore, plate supply is begun, with the phase of the plate cylinder 3 being shifted by the amount corresponding to the phase difference of the plate cylinder 3. In the present embodiment, however, control over the plate press roller 20 and the new plate hooking member 7 at the plate supply start position θb is performed for all the units simultaneously. That is, as shown in FIG. 9, the plate press roller actuator 21 and the new plate moving actuator 28 in all the units are controlled at the plate supply start position θb. When the printing press is rotated in the normal direction from this state, the "n"th color upper unit having unit No. 2*n* (final printing unit) arrives at the new plate insertion start position θ2*n*,7. At this time, the leading front end of the new plate $W_1$ is inserted into the gap 26 of the plate cylinder 3. Then, the "n"th color lower unit having unit No. 2*n*−1 arrives at the new plate insertion start position θ2*n*−1,7, at which time the leading front end of the new plate $W_1$ is inserted into the gap 26 of the plate cylinder 3. Then, the "n"th color upper unit arrives at the new plate detection position θ2*n*,5. At this time, it is detected whether an error in plate supply has occurred. In this manner, control is exercised such that during the plate supply step of a certain printing unit, the plate supply step of another printing unit is sequentially started.

If an abnormality in the plate changing (a plate removal error or a plate supply error) has occurred in a certain printing unit during the plate changing, the aforementioned CPU 35 controls at least one of the aforementioned main unit motor 34 and automatic plate changer in normal units other than the error unit in accordance with the progress status of the plate changing of the normal units.

That is, if a plate tail detection error at the plate tail detection position θi,4 or an automatic dismounting error at the automatic dismounting position θi,5 happens in a certain printing unit during plate removal, as shown in FIGS. 14 and 15, the error unit is set in an error mode, and a predetermined measure is taken. On the other hand, normal units other than the error unit are set in a return mode, and measures taken are different depending on which of areas A to G to be described later the normal units belong to.

The above-mentioned area A (θa–θi,1) represents a state where plate removal is not started at all (FIG. 14(*c*)). In this case, the return mode is released automatically and, after dealing with the error unit, the plate removal is effected automatically or manually. Area B (θi,1–θi,2) represents the ON state of the plate press roller 20 and the plate removal cam 30, a state where the trailing edge of the removal plate $W_2$ is completely mounted on the plate cylinder 3 (FIG. 14(*d*)). In this case, the plate removal cam 30 and the plate press roller 20 are rendered OFF, and the return mode is released automatically. After handling of the error unit, the plate removal is performed automatically or manually. Area C (θi,2–θi,3) represents a state until the plate removal cam follower 30*a* finishes contacting the plate removal cam 30, a state where the trailing edge of the removal plate $W_2$ incompletely juts out of the gap 26 of the plate cylinder 3 (FIG. 15(*a*)). In this case, the main unit motor 34 is locked. The manual operation button 48 is turned on to release the return mode, the plate cylinder 3 is normally rotated (by the inching button 49) and reversely rotated (by the reverse inching button 50), and the trailing edge of the plate is bound by a tape T (see FIG. 7). Then, the manual operation button 48 is rendered OFF. After dealing with the error unit, the plate removal cam 30 and the plate press roller 20 are rendered OFF manually, and the removal plate $W_2$ is eliminated manually.

Area D (θi,3–θi,5) represents a state existent from the plate removal cam contact termination position until the automatic dismounting position (FIG. 15(*b*)). In this case, in order to deal with the error unit, or to handle the return mode unit after dealing with the error unit, the main unit motor 34 is stopped at θi,3 during normal rotation or at θi,6 during a reverse rotation when the main unit motor 34 is rotated normally or reversely, where after the main unit motor 34 is locked. Then, the targeted return mode unit is dealt with automatically or manually, and the return mode is released automatically or manually. Area E (θi,5–θi,6) represents a state existent from the automatic dismounting position until the manual dismounting position. In this state, the removal plate $W_2$ is basically detached from the plate cylinder 3 and held by the plate dismounting guide 16 (FIG. 15(*c*)). However, there is a possibility that a grip is not cleared, so that the main unit motor 34 is locked. The operator turns on the manual operation button 48 to release the return mode. After observing the status of dismounting and, if finding the grip to be cleared, the operator immediately turns off the manual operation button 48. If finding the grip not to be cleared, the operator rotates the main unit motor 34 normally or reversely to clear the grip, and turns off the manual operation button 48. After the error unit is dealt with, the plate dismounting guide 16 is turned off manually, and the removal plate $W_2$ is accommodated.

Area F (θi,6–θi,7) represents a state existent from the manual dismounting position until the plate accommodation position (FIG. 15(*d*)). In this case, the plate dismounting guide 16 is rendered OFF, the removal plate $W_2$ is accommodated, and the return mode is released automatically. Area G (θi,7–θb) represents a state where the plate removal is terminated (FIG. 15(*e*)). In this case, the return mode is released automatically.

In the event of an error happening during the plate removal, measures taken for the normal units belonging to the areas other than area D are completed before the printing press is rotated to eliminate the error of the error unit. For the normal unit belonging to area D, the necessary measure is taken during elimination of the error in the error unit or after handling of the error unit.

If a plate supply detection error at the plate supply detection position θi,5 occurs in a certain printing unit at the time of plate supply, as shown in FIGS. 16 and 17, the error unit is set in the error mode, and a predetermined measure is taken. The normal units other than the error unit are set in the return mode, and measures for them are different depending on which of areas G, I, D, J, K, and A the normal units belong to.

The above-mentioned area G (θb–θi,7) represents a state present before the leading end portion of the new plate $W_1$ is inserted into the gap 26 of the plate cylinder 3 (FIG. 16(*b*)). In this case, the new plate moving actuator 28 is rendered OFF to move the new plate hooking member 7 from the position of the double-dotted chain lines to the position of the solid lines in FIG. 1 and accommodate the new plate $W_1$ into the loader 6. Also, the plate press roller actuator 21 is rendered OFF to detach the plate press roller 20 from the plate cylinder, and the return mode is released automatically. After dealing with the error unit, plate supply is performed automatically or manually.

Area I (θi,7–θi,5) represents a state where the plate press roller 20 is in contact with the plate cylinder, and the leading edge of the new plate $W_1$ is on the way to mounting on the plate cylinder 3 (FIG. 16(*c*)). In this case, the main unit motor 34 is locked in the reverse direction. If the operator judges reverse inching unnecessary, the operator rotates the main unit motor 34 normally by the reverse inching button 49 to mount the leading edge of the plate on the plate cylinder 3. When the plate cylinder 3 is normally rotated to θi,5, locking of the main unit motor 34 in the reverse-rotation direction is released. As a result, the same state as that for area D to be described later is attained. If the operator judges reverse inching necessary, on the other hand, the operator puts the manual button 48 into the ON state to release the return mode, rotate the plate cylinder 3 reversely or normally, thereby detaching the leading edge of the plate and withdrawing the new plate $W_1$ out of the printing press, and turns off the manual operation button 48. After taking a measure for the error unit, the plate press roller 20 is thrown off manually.

Area D (θi,5–θi,3) represents a state existent from the plate supply detection position until actuation of the plate supply cam 32 (FIG. 16(*d*)). In this case, the same control as that for area D at the time of the plate removal error is performed. Area J (θi,3–θi,8) represents a state existent from the actuation of the plate supply cam 32 until the plate supply cam follower 32*a* finishes contact with the plate supply cam 32, a state where the leaf spring 27 of the plate cylinder 3 is holding the trailing edge of the new plate $W_1$ (FIG. 17(*a*)). In this case, the main unit motor 34 is locked. The manual operation button 48 is turned on to release the return mode, the plate cylinder 3 is normally rotated or reversely rotated, and the trailing edge of the plate is bound by a tape T (see FIG. 7). Then, the manual operation button 48 is rendered OFF. After dealing with the error unit, the plate supply cam 32 and the plate press roller 20 are rendered OFF manually.

Area K (θi,8–θi,1) represents a state existent from the termination of contact of the plate supply cam follower 32*a* with the plate supply cam 32 until the OFF state of the plate press roller 20 and the plate supply cam 32 (FIG. 17(*b*)). In this case, the plate press roller 20 and the plate supply cam 32 are rendered OFF, and the return mode is released automatically. Area A (θi,1–θa) represents a state where plate supply has terminated (FIG. 17(*c*)). In this case, the return mode is released automatically.

In the event of an error happening during the plate supply, measures taken for the normal units belonging to the areas other than area D are completed before the printing press is rotated to eliminate the error in the error unit. For the normal unit belonging to area D, the necessary measure is taken during elimination of the error in the error unit or after dealing with of the error unit.

The plate changing apparatus of the present invention is configured as described above. Next, control actions on plate changing work will be described in detail using flow charts in FIGS. 18 to 34.

Ordinary plate removal steps are as shown in FIG. 18. If the plate changing button 41 is found to be ON in step P1, the plate removal start position is read from the plate removal start position memory 45 in step P2, and the current position is read from the main unit phase detection counter 40 in step P3. Then, in step P4, it is determined whether the current position derived from the main unit phase detection counter 40 is the plate removal start position (θa). If the answer is negative (NO), the main unit motor 34 is normally rotated in step P5, and the program returns to step P3. If the answer is affirmative (YES), the main unit motor 34 is stopped in step P6. Namely, the main unit motor 34 is rotated normally until the current position becomes the plate removal start position (θa). Then, the plate changing counter 39 is set at zero in step P7, whereafter the main unit motor 34 is rotated reversely in step P8 (plate removal drive step).

In the plate changing, the start position for plate changing (θa, θb) is controlled based on the current position read from the main unit phase detection counter 40, but other positions are controlled based on the current position read from the plate changing counter. This is because the plate changing requires the main unit to be rotated 360 degrees or more. In detail, the main unit phase detection counter 40 is used not only for plate changing, but also for control of other devices. Thus, when the main unit makes one turn (360-degree rotation), the current position from the main unit phase detection counter 40 is reset. This makes this counter unsuitable for detecting the current position for the plate changing. Hence, the counter for the plate changing is also provided so as to be able to detect a phase of 360 degrees or more.

Then, in step P9, the next operating position and the target unit No. are read from the operating position memory 47. Then, in step P10, the current position is read from the plate changing counter 39 (plate removal phase detection step). Then, it is determined in step P11 whether the current position loaded from the plate changing counter 39 is the next operating position. If NO, the program returns to step P10. If YES, it is determined in step P12 whether the next operating position is the plate removal completion position (θb). If YES, the main unit motor 34 is stopped in step P13, and the program proceeds to the plate supply step in FIG. 19. If NO, it is determined in step P14 whether the next operating position is the plate removal cam operating position (θi,1). If YES, the plate removal cam actuator 31 and the plate press roller actuator 21 of the target unit are turned on in step P15 (plate removal switching means operating step), and the program returns to step P9. If NO, it is determined in step P16 whether the next operating position is the plate tail detection position (θi,4). If YES, it is determined in step P17 whether the plate tail sensor 11 of the target unit is ON (abnormality detection step, first plate removal detection step). If YES, the program returns to step P9. If the answer is NO in step P17, the program proceeds to the first return step of FIGS. 20 and 21.

If the answer is NO in step P16, it is determined in step P18 whether the next operating position is the automatic dismounting position (θi,5). If YES, in step P19, the plate removal cam actuator 31 and the plate press roller actuator 21 are turned off and the plate dismounting actuator 17 is turned on in the target unit, and counting of the timer is started (removal holding means operating step). After the timer is found in step P20 to have measured a predetermined time, time measurement of the timer is stopped in step P21. Then, it is determined in step P22 whether the dismounting sensor 17*a* of the target unit has become ON (abnormality detection step, second plate removal detection step). If YES, the program returns to step P9. If NO, the program goes to the first return step of FIGS. 20 and 21. If the answer is NO in step P18, the next operating position is the plate accommodation position (θi,7). Thus, the plate dismounting actuator 17 of the target unit is turned off in step P23, and the removal plate accommodation actuator 29 of the target unit is turned off in step P24 (removal plate accommodation step). Then, the program returns to step P9.

In short, while the printing press is being rotated reversely, it is read which unit's operating position is reached (step P9), and a comparison with the current position is always made (step P11). When that operating position is reached, plate removal treatment according to the operating position (steps P13, P15, P17, P19, P23, P24) is performed.

An ordinary plate supply step is performed as shown in FIG. 19. First, the plate supply start position is read from the plate supply start position memory 46 in step P25, and the current position is read from the main unit phase detection counter 40 in step P26. Then, it is determined in step P27 whether the current position read from the main unit phase detection counter 40 is the plate supply start position (θb). If the answer is negative (NO), the main unit motor 34 is rotated normally in step P28, and the program returns to step P26. If the answer is affirmative (YES), the main unit motor 34 is stopped in step P29. That is, the main unit motor 34 is rotated normally until the current position becomes the plate supply start position (θb). Then, in step P30, the plate changing counter 39 is set at zero. Then in step P235, the plate press roller actuator 21 of all units is turned on (plate press roller operating step), and the new plate moving actuator 28 is turned on. Then, the main unit motor 34 is normally rotated in step P31 (plate supply drive step).

Then, in step P32, the next operating position and the target unit No. are read from the operating position memory 47, whereafter the current position is read from the plate changing counter 39 in step P33 (plate supply phase detection step). In step P34, it is determined whether the current position from the plate changing counter 39 is the next operating position. If NO, the program returns to step P33. If YES, it is determined in step P35 whether the next operating position is the plate supply completion position (θa). If YES, the main unit motor 34 is stopped in step P36 to terminate the plate changing work. If NO, it is determined in step P39 whether the next operating position is the plate supply detection position (θi,5). If YES, it is determined in step P40 whether the plate supply sensor 9 of the target unit is ON (abnormality detection step, plate supply detection step). If YES, the program returns to step P32. If the answer is negative in step P40, the program shifts to the first return step of FIGS. 31 to 34.

If the answer is negative in step P39, it is determined in step P41 whether the next operating position is the plate supply cam operating position (θi,3). If YES, the plate supply cam actuator 33 of the target unit is turned on in step P42 (plate supply switching means operating step), and the program returns to step P32. If NO, the next operating position is the plate press roller retreat position (θi,1). Thus, in step P43, the plate supply cam actuator 33 and the plate press roller actuator 21 of the target unit are turned off (plate press roller retreat step), and the program returns to step P32.

In short, while the printing press is being rotated normally, it is read which unit's operating position is reached next (step P32), and a comparison with the current position is always made (step P34). When that operating position is reached, plate supply treatment according to the operating position (steps P36, P38, P40, P42, P43, etc.) is performed.

If a plate removal error is found in the aforementioned steps P17 and P22 to have occurred, the first return step shown in FIGS. 20 and 21 is performed. That is, the main unit motor 34 is stopped in step P44 (stop step). Then, in step P45, it is determined whether the plate changing button 41 is ON. If YES, the program returns to step P8 (plate changing resumption step). If NO, it is determined in step P46 whether the manual operation button (switch) 48 of the target unit is ON. If NO, the program returns to step P45. If YES, the unit is set in the error mode in step P47. That is, if the operator observes the status of the printing unit, where an error has occurred, and judges the error unremovable without the rotation of the plate cylinder 3, the operator turns on the manual operation button (switch) 48 of the printing unit showing the occurrence of the error. If the error is corrected and a normal state is restored without the rotation of the plate cylinder 3, the plate changing button 41 is rendered ON to resume the plate removal which has been suspended.

Then, the target unit is set to be the error unit in step P48, and the units other than the target unit are set to be return mode units in step P49 (mode setting step). Then, the current position is read from the plate changing counter 39 in step P50, and the return mode unit Nos. and the positions of the respective areas of the return mode units are read in step P51. Then, it is determined in step P52 whether there is the return mode unit whose current position is in area A or area G. If there is such return mode unit, the return mode of the target return mode unit is automatically released in step P53 (first automatic return mode release step), and the program shifts to step P54. If there is no such return mode unit, it is determined in step P54 whether there is the return mode unit whose current position is in area B.

If such return mode unit is found to be present in step P54, the plate press roller actuator 21 and the plate removal cam actuator 31 of the target return mode unit are turned off in step P55 (first control step). In step P56, the return mode of the target return mode unit is automatically released in step P56 (first automatic return mode release step), and the program goes to step P57. If there is no such return mode unit, it is determined in step P57 whether there is the return mode unit whose current position is in area F.

If there is found to be such return mode unit in step P57, the plate dismounting actuator 17 of the target return mode unit is turned off in step P58, and the removal plate accommodation actuator 29 of the target return mode unit is turned off in step P59 (first control step). In step P60, the return mode of the target return mode unit is automatically released (first automatic return mode release step). Then, the program goes to step P61. If there is such return mode unit in step P57, it is determined in step P61 whether there is the return mode unit whose current position is in area C or area E.

If there is no such return mode unit in step P61, the program goes to the error elimination step shown in FIG. 22. If there is such return mode unit, the main unit motor 34 is locked in step P62 (first drive lock step). Then, if the manual operation buttons (switches) 48 of all target return mode units are found to be ON in step P63, the ON state of the manual operation button (switch) 48 of the error unit is released in step P64. After the return mode of the target return mode unit is released in step P65 (first manual return mode release step), locking of the main unit motor 34 is released in step P66 (first lock release step).

As a result, it becomes possible to rotate the main unit motor 34 normally and reversely by operating the inching button (switch) 49 and the reverse inching button (switch) 50 of the target return mode unit.

Then, in step 67, it is determined whether the inching button (switch) 49 of the target return mode unit is ON. If NO, the program goes to step P71. If YES, the main unit motor 34 is rotated normally in step P68. Then, if the inching button (switch) 49 of the target return mode unit is found to be OFF in step P69, the main unit motor 34 is stopped in step P70, and the program returns to step P67. That is, if the main unit comes to a position where a measure can be taken, the main unit is stopped, and the measure is taken.

Then, in step P71, it is determined whether the reverse inching button (switch) 50 of the target return mode unit is ON. If NO, the program proceeds to step P75. If YES, the main unit motor 34 is rotated reversely in step P72. If the reverse inching button (switch) 50 of the target return mode unit is found to be OFF in step P73, the main unit motor 34 is stopped in step P74, and the program returns to step P67. That is, if the main unit comes to a position where a measure can be taken, the main unit is stopped, and the measure is taken.

Then, in step P75, it is determined whether the manual operation button (switch) 48 of the target return mode unit is OFF. If NO, the program returns to step P67. If YES, it is determined in step P76 whether the manual operation buttons (switches) 48 of all the target return mode units are OFF. If NO, the program returns to step P67. If YES, the program goes to the error elimination step shown in FIG. 22. That is, the operator checks the status of the target return mode unit and judges whether normal rotation is necessary, whether reverse rotation is necessary, or whether rotation is unnecessary, in order to take a necessary measure. Based on this judgment, the operator depresses the inching button (switch) 49 or the reverse inching button (switch) 50 to rotate the main unit motor 34 normally or reversely. After rotation to a position where the measure is easily taken, the operator's finger leaves the button to stop the main unit motor 34. Then, an appropriate measure is taken for the target return mode unit. If no rotation is necessary, a measure is taken without depressing the inching button (switch) 49 or the reverse inching button (switch) 50. Upon completion of the measure, the manual operation button 48 of the target return mode unit is depressed. If there a plurality of the return mode units belonging to area C or area E, the program proceeds to the error elimination step, after the measures for all these return mode units are completed, namely, after the manual operation buttons of all the target return mode units are rendered OFF. At this point in time, only the return mode unit in area D remains in the return mode, while the return mode for the other return mode units is released.

If, in step P61, there is no return mode unit having the current position in area C or area E, or if, in step P76, the manual operation buttons (switches) 48 of all the target return mode units are OFF, the error elimination step (common to plate supply and plate removal) shown in FIG. 22 is performed. That is, a measure is taken for the error unit. In dealing with the error unit, the main unit motor 34 is reversely rotated for removal of the printing plate, not only in the case of an error in plate removal, but also in the case of an error in plate supply. If the reverse rotation of the main unit motor 34 is not enough to remove the printing plate, such as when the printing plate is bent or is caught by a component of the printing press, the inching button (switch) 49 or reverse inching button (switch) 50 of the error unit is operated to rotate the printing cylinder 3, in order to permit the removal of the printing plate. If, at this time, the return mode unit located in area D in the first return step comes to the operating position, a measure for its return mode is taken, and then the error unit is dealt with again.

In step P77, it is determined whether the return mode unit is present or absent. If there is no return mode unit, the program proceeds to the error elimination step (common to plate supply and plate removal) shown in FIG. 26. That is, if in the first return step the return mode of all the return mode units is released, namely, if there is no return mode unit located in area D, the program proceeds to a flow for dealing with only the error unit. If there is the return mode unit, the return mode unit No. and the operating position of the return mode unit are read in step P78. Then, in step P79, it is determined whether the manual operation button (switch) 48 of the error unit is ON. If NO, it is determined in step P80 whether the manual operation button (switch) 48 of the target return mode unit is ON. If NO, the program returns to step P79. If YES, the program goes to a flow (common to plate supply and plate removal) shown in FIG. 27 for handling the return mode unit after the error elimination step.

If the answer is YES in step P79, namely, if the manual operation button 48 of the error unit is ON, it is possible to rotate the main unit motor 34 normally or reversely by operating the inching button (switch) 49 or reverse inching button (switch) 50 of the error unit. In step P81, it is determined whether the inching button (switch) 49 of the error unit is ON. If YES, the main unit motor 34 is rotated normally in step P82, and the current position is read from the plate changing counter 39 in step P83 (phase detection step). Then, in step P84, it is determined whether the current position is the operating position (θi,3) of the target return mode unit. If YES, the program proceeds to the second return step (common to plate supply and plate removal) shown in FIG. 23. If NO, it is determined in step P85 whether the inching button (switch) 49 of the error unit is OFF. If NO, the program returns to step P83. If YES, the main unit motor 34 is stopped in step P86, and the program returns to step P81.

If the answer is negative in step P81, it is determined in step P87 whether the reverse inching button (switch) 50 is ON. If YES, the main unit motor 34 is reversely rotated in step P88, and the current position is read from the plate changing counter 39 in step P89 (phase detection step). Then, in step P90, a determination is made as to whether the current position is the manual dismounting position (θi,6) of the target return mode unit. If YES, the program proceeds to the second return step (common to plate supply and plate removal) shown in FIGS. 24 and 25. If NO, it is determined in step P91 whether the reverse inching button (switch) 50 of the error unit is OFF. If NO, the program returns to step P89. If YES, the main unit motor 34 is stopped in step P92, and the program returns to step P81.

If the answer is negative in step P87, step 93 is executed to determine whether the manual operation button (switch) 48 of the target return mode unit is ON. If NO, the program returns to step P81. If YES, the ON state of the manual operation button (switch) 48 of the error unit is automatically released in step P94. The program proceeds to a flow (common to plate supply and plate removal), as shown in FIG. 27, for handling the return mode unit after the error elimination step.

That is, the operator depresses the inching button (switch) 49 or the reverse inching button (switch) 50 of the error unit to rotate the main unit motor 34 normally or reversely. If, during this normal or reverse rotation, the return mode unit rotates normally, arriving at the operating position (θi,3), or rotates reversely, arriving at the manual dismounting position (θi,6), a measure is taken for this target return mode unit. Once removal of the printing plate of the error unit is completed, the manual operation button for the return mode unit, for which the measure has not been completed, is turned on to take the measure for this return mode unit. By operating the manual operation button, the ON state of the manual operation button of the error unit is released.

If, in the aforementioned step P84, the current position is the operating position (θi,3) of the target return mode unit, the second return step (common to plate supply and plate removal) shown in FIG. 23 is executed. That is, after the main unit motor 34 is stopped in step P95, the main unit motor 34 is locked in step P96 (second drive lock step). Then, if the manual operation button (switch) 48 of the target return mode unit is ON in step P97, the ON state of the manual operation button (switch) 48 of the error unit is automatically released in step P98. Then, in step P99, the return mode of the target return mode unit is released (second manual return mode release step), and locking of the main unit motor 34 is released in step P100 (second lock release step).

As a result, it is possible to rotate the main unit motor 34 normally or reversely by operating the inching button (switch) 49 or the reverse inching button (switch) 50 of the error unit of the target return mode unit.

Then, in step P101, it is determined whether the inching button (switch) 49 of the target return mode unit is ON. If YES, the main unit motor 34 is normally rotated in step P102. If the inching button (switch) 49 of the target return mode unit is OFF in step P103, the main unit motor 34 is stopped in step P104, and the program returns to step P101. In other words, the main unit motor 34 is normally rotated only while the inching button (switch) 49 is being depressed. If the answer is negative in step P101, it is determined in step P105 whether the reverse inching button (switch) 50 of the target return mode unit is ON. If YES, the main unit motor 34 is reversely rotated in step P106. If the reverse inching button (switch) 50 of the target return mode unit is OFF in step P107, the main unit motor 34 is stopped in step P108, and the program returns to step P101. In other words, the main unit motor 34 is reversely rotated only while the reverse inching button (switch) 50 is being depressed. If the answer is negative in step P105, it is determined in step P109 whether the manual operation button (switch) 48 of the target return mode unit is OFF. If NO, the program returns to step P101. If YES, the program shifts to the error elimination step shown in FIG. 22. In this manner, the operator rotates the plate cylinder 3 in accordance with the status of the return mode unit to locate the plate cylinder 3 in a phase in which a measure is easy to take, followed by binding the trailing edge of the plate with the tape T (see FIG. 7). After this measure is completed, the manual operation button (switch) 48 of the return mode unit concerned is turned off. Upon completion of the measure for the return mode unit, the error unit begins to be dealt with again. The error elimination step and the second return step are performed repeatedly, whereby the number of the return mode units set in the return mode is decreased.

If, in the aforementioned step P90, the current position is the manual dismounting position of the target return mode unit, the second return step (common to plate supply and plate removal) shown in FIGS. 24 and 25 is executed. That is, the leading edge of the printing plate in the return mode unit is removed.

After the main unit motor 34 is stopped in step P110, the main unit motor 34 is locked in step P111 (second drive lock step). Then, in step P112, the plate press roller actuator 21 and the plate removal cam actuator 31 of the target return mode unit are turned off, the plate dismounting actuator 17 is turned on, and time measurement of the timer is started (automatic removal holding step).

If the timer has measured a predetermined time in step P113, time measurement of the timer is stopped in step P114. Then, in step P115, a determination is made of whether the dismounting sensor 17*a* of the target return mode unit is ON (removal confirmation step). If YES, the return mode of the target return mode unit is automatically released in step P116 (second automatic return mode release step), and locking of the main unit motor 34 is released in step P117 (second lock release step). In this manner, a measure for the return mode unit is taken automatically, and the return mode and the locking of the main unit motor 34 are released automatically. That is, the operator can resume the measure for the error unit, without moving from the error unit to the return mode unit. Then, the program shifts to the error elimination step shown in FIG. 22.

If the answer is negative in step P115, namely, if dismounting by the plate dismounting guide 16 is not performed normally, a determination is made in step P118 as to whether the manual operation button (switch) 48 of the target return mode unit is ON. If YES, the ON state of the manual operation button (switch) 48 of the error unit is automatically released in step P119. Then, the return mode of the target return mode unit is released in step P120 (second manual return mode release step), and locking of the main unit motor 34 is released in step P121 (second lock release step).

Then, in step P122, it is determined whether the inching button (switch) 49 of the target return mode unit is ON. If YES, the main unit motor 34 is normally rotated in step 123. Then, if the inching button (switch) 49 of the target return mode unit is OFF in step P124, the main unit motor 34 is stopped in step P125, and the program returns to step P122. That is, the main unit motor 34 is normally rotated while the inching button (switch) 49 is being depressed.

If the answer is negative in step P122, it is determined in step P126 whether the reverse inching button (switch) 50 of the target return mode unit is ON. If YES, the main unit motor 34 is reversely rotated in step P127. If the reverse inching button (switch) 50 of the target return mode unit is OFF in step P128, the main unit motor 34 is stopped in step P129, and the program returns to step P122. That is, the main unit motor 34 is reversely rotated while the reverse inching button (switch) 50 is being depressed.

If the answer is negative in step P126, it is determined in step P130 whether the manual operation button (switch) 48 is OFF. If NO, the program returns to step P122. If YES, the program shifts to the error elimination step shown in FIG. 22. In this manner, the operator rotates the plate cylinder 3 in accordance with the status of the return mode unit to locate the plate cylinder 3 in a phase in which a measure is easy to take, whereafter the operator detaches the leading edge of the printing plate manually. Upon completion of this measure, the manual operation button (switch) 48 of the return mode unit concerned is turned off. After a measure for the return mode unit is terminated, a measure for the error unit begins to be taken again. By repeating the error elimination step and the second return step, the number of the return mode units set in the return mode is decreased.

If there is no return mode unit in the aforementioned step P77, the error elimination step (common to plate supply and plate removal) shown in FIG. 26 is executed. This drawing shows a flow of processings to be performed when the return mode of all the return mode units is released, and only a measure for the error unit remains to be taken. In this case, the return mode of all the return mode units is released. Thus, even when the plate cylinder 3 is rotated for dealing with the error unit, it does not occur that the main unit motor 34 is stopped to interrupt the measure for the error unit. The return mode unit being set in the return mode represents a mode in which depending on the phase, the plate changing means is actuated, or the main unit motor 34 is stopped or locked. Release of the return mode represents a state where even when the return mode unit is in a phase in which the plate changing means is actuated, or the main unit motor 34 is stopped or locked, this control is not exercised. Thus, the necessary measure can be taken freely, with rotation of the plate cylinder 3 being unimpeded.

In step P131, it is determined whether the error mode release button (switch) 42 is ON. If YES, the error mode is released in step P132 to terminate a measure for the error unit. That is, if the measure for the error unit is taken without rotating the plate cylinder 3, the error mode release button (switch) 42 is turned on to release the error mode, thereby terminating the measure. If the answer is negative in step P131, a determination is made in step P133 as to whether the manual operation button (switch) 48 of the error unit is ON. If NO, the program returns to step P131. If YES, it is determined in step P134 whether the inching button (switch) 49 of the error unit is ON.

If the answer is affirmative in step P134, the main unit motor 34 is normally rotated in step P135. If the inching button (switch) 49 of the error unit is OFF in step P136, the main unit motor 34 is stopped in step P137, and the program returns to step P134. That is, the main unit motor 34 is normally rotated while the inching button (switch) 49 is being depressed. If the answer is negative in step P134, it is determined in step P138 whether the reverse inching button (switch) 50 of the error unit is ON. If YES, the main unit motor 34 is reversely rotated in step P139. If the reverse inching button (switch) 50 of the error unit is OFF in step P140, the main unit motor 34 is stopped in step P141, and the program returns to step P134. That is, the main unit motor 34 is reversely rotated while the reverse inching button (switch) 50 is being depressed. If the answer is negative in step P138, it is determined in step P142 whether the error mode release button (switch) 42 is ON. If NO, the program returns to step P134. If YES, the error mode is released in step P143 to terminate dealing with the error unit.

In the above-described manner, the operator rotates the plate cylinder 3 according to the status of the error to take the measure (removal of the printing plate). Upon termination of the measure for the error unit, the error mode release button (switch) 42 is turned on to release the error mode, bringing the program to end. Once the error mode is released, work for removing the printing plate, and work for switching from the operating state of the plate changing means to its nonoperating state are done, beginning in the printing unit having the trailing edge of the plate bound with the tape T in the first return step, and the printing unit having the printing plate held by the plate dismounting guide 16 in the first return step. Each of the works is performed by a manual operation for each unit. For the printing units in which plate removal work or plate supply work has not been started in the first return step (plate removal: areas A, B, plate supply: area H), plate changing is performed automatically or manually. As a means of releasing the error mode, the error mode release button (switch) 42 need not be provided. Instead, the error mode may be released by operating the plate changing button 41, a plate removal button (not shown) for starting plate removal, or a plate supply button (not shown) for starting plate supply.

When the manual operation button (switch) 48 of the target return mode unit is ON in the aforementioned step P80, and when the ON state of the manual operation button (switch) 48 of the error unit is released in the aforementioned step P94, a measure (common to plate supply and plate removal), as shown in FIG. 27, is taken for the return mode unit after the error elimination step. That is, after termination of the measure for the error unit, a measure is taken for the return mode unit set in the return mode. This measure refers to removal of the printing plate, and thus basically requires that the plate cylinder 3 be reversely rotated, but its normal rotation is performed depending on the status.

In step P144, the return mode of the target return mode unit is released. Then, in step P145, it is determined whether the inching button (switch) 49 of the return mode release unit, which has been released from the return mode, is ON. If YES, the main unit motor 34 is normally rotated in step P146, and the current position is read from the plate changing counter 39 in step P147. Then, in step P148, it is determined whether the current position is the operating position (θi,3) of the return mode unit. If YES, a measure (common to plate supply and plate removal), as shown in FIG. 28, is taken for the return mode unit after the error elimination step. If NO, it is determined in step P149 whether the inching button (switch) 49 of the target return mode unit is OFF. If NO, the program returns to step P147. If YES, the main unit motor 34 is stopped in step P150, and the program returns to step P145.

If the answer is negative in step P145, it is determined in step P151 whether the reverse inching button (switch) 50 of the return mode release unit is ON. If YES, the main unit motor 34 is reversely rotated in step P152, and the current position is read from the plate changing counter 39 in step P153. Then, in step P154, it is determined whether the current position is the manual dismounting position (θi,6) of the return mode unit. If YES, a measure (common to plate supply and plate removal), as shown in FIGS. 29 and 30, is taken for the return mode unit after the error elimination step. If NO, it is determined in step P155 whether the reverse inching button (switch) 50 of the target return mode unit is OFF. If NO, the program returns to step. P153. If YES, the main unit motor 34 is stopped in step P156, and the program returns to step P145.

If the answer is negative in step P151, it is determined in step P157 whether the manual operation button (switch) 48 of the return mode release unit is OFF. If NO, the program returns to step P145. If YES, it is determined in step P158 whether there is the return mode unit. If the return mode unit exists, the manual operation button (switch) 48 of the target return mode unit is rendered ON in step P159, and the program returns to step P144. If the return mode unit is absent, the error mode release button (switch) 42 is rendered ON in step P160 to terminate the measure for the return mode unit after the error elimination step. In this manner, after processing for one return mode unit is completed, the manual operation button (switch) 48 of this return mode unit is turned off to release the return mode. This procedure is continued until there is no return mode unit set in the return mode. If other return mode unit is located at the operating position during rotation of the plate cylinder 3 for handling of the return mode unit, processing is performed for the other return mode unit.

If the current position is the operating position of the target return mode unit in the aforementioned step P148, a measure (common to plate supply and plate removal), as shown in FIG. 28, is taken for the return mode unit after the error elimination step. This is a measure to be taken when other return mode unit comes to the operating position during rotation of the plate cylinder 3 for handling the return mode unit after the error elimination step. First, the main unit motor 34 is stopped in step P161, and then the main unit motor 34 is locked in step P162. Then, if the manual operation button (switch) of a different return mode unit is ON in step P163, the return mode of the different return mode unit is released in step P164, whereafter locking of the main unit motor 34 is released in step P165.

Then, in step P166, it is determined whether the inching button (switch) 49 of the different return mode unit is ON. If YES, the main unit motor 34 is normally rotated in step P167. If the inching button (switch) 49 of the different return mode unit is OFF in step P168, the main unit motor 34 is stopped in step P169, and the program returns to step P166. That is, the main unit motor 34 is normally rotated while the inching button (switch) 49 is being depressed. If the answer is negative in step P166, it is determined in step P170 whether the reverse inching button (switch) 50 of the different return mode unit is ON. If YES, the main unit motor 34 is reversely rotated in step P171. If the reverse inching button (switch) 50 of the different return mode unit is OFF in step P172, the main unit motor 34 is stopped in step P173, and the program returns to step P166. That is, the main unit motor 34 is reversely rotated while the reverse inching button (switch) 50 is being depressed. If the answer is negative in step P170, it is determined in step P174 whether the manual operation button (switch) 48 of the different return mode unit is OFF. If NO, the program returns to step P166. If YES, the program returns to processing for the different return mode unit after the error elimination step shown in FIG. 27 to resume the measure for the target return mode unit.

If, in the aforementioned step P154, the current position is the manual dismounting position of the target return mode unit, a measure (common to plate supply and plate removal), as shown in FIGS. 29 and 30, is taken for the return mode unit after the error elimination step. This is a measure to be taken when a different return mode unit comes to the operating position during rotation of the plate cylinder 3 for handling the return mode unit after the error elimination step. First, the main unit motor 34 is stopped in step P175, and then the main unit motor 34 is locked in step P176. Then, in step P177, the plate press roller actuator 21 and the plate removal cam actuator 31 are turned off, and the plate dismounting actuator 17 is turned on, in the different return mode unit, while the timer begins to measure time.

If the timer has measured a predetermined time in step P178, measurement of time by the timer is stopped in step P179. Then, in step P180, it is determined whether the dismounting sensor 17*a* of the different return mode unit is ON. If YES, the return mode of the different return mode unit is automatically released in step P181, and locking of the main unit motor 34 is released in step P182. Then, the program returns to the measure for the return mode unit after the error elimination step shown in FIG. 27. That is, the operator can resume the measure for the target return mode unit, without moving from the target return mode unit to the different target return mode unit.

If the answer is negative in step P180, namely, if dismounting by the plate dismounting guide 16 fails to be performed normally, step 183 is executed to determine whether the manual operation button (switch) 48 of the different return mode unit is ON. If YES, the return mode of the different return mode unit is released in step 184, and locking of the main unit motor 34 is released in step P185.

Then, in step P186, it is determined whether the inching button (switch) 49 of the different return mode unit is ON. If YES, the main unit motor 34 is normally rotated in step P187. Then, if the inching button (switch) 49 of the different return mode unit is OFF in step P188, the main unit motor 34 is stopped in step P189, and the program returns to step P186. That is, the main unit motor 34 is normally rotated only while the inching button (switch) 49 is being depressed.

If the answer is negative in step P186, it is determined in step P190 whether the reverse inching button (switch) 50 of the different return mode unit is ON. If YES, the main unit motor 34 is reversely rotated in step P191. Then, if the reverse inching button (switch) 50 of the different return mode unit is OFF in step P192, the main unit motor 34 is stopped in step P193, and the program returns to step P186. That is, the main unit motor 34 is reversely rotated only while the reverse inching button (switch) 50 is being depressed.

If the answer is negative in step P190, a determination is made in step 194 as to whether the manual operation button of the different return mode unit is OFF. If NO, the program returns to step P186. If YES, the program returns to the measure for the return mode unit after the error elimination step shown in FIG. 27, and the measure for the target return mode unit is resumed. In this manner, the operator rotates the plate cylinder 3 in accordance with the status of the different return mode unit to locate the plate cylinder 3 in a phase in which a measure is easy to take, whereafter the operator detaches the leading edge of the printing plate manually. Upon completion of this measure, the manual operation button (switch) 48 of the different return mode unit concerned is turned off. After the measure for the different return mode unit is terminated, a measure for the target return mode unit begins to be taken again. This procedure is repeated until there are none of the return mode units.

If the plate supply error is observed in the aforementioned step P40, the first return step shown in FIGS. 31 to 34 is executed. First of all, the main unit motor 34 is stopped in step P195 (stop step). Then, in step P196, it is determined whether the plate changing button 41 is ON. If YES, the program returns to step P31 (plate changing resumption step). If NO, it is determined in step P197 whether the manual operation button (switch) 48 of the target unit is ON. If NO, the program returns to step P196. If YES, the unit is set in the error mode in step P198. That is, if the operator observes the status of the printing unit, where the error has occurred, and judges the error unremovable without the rotation of the plate cylinder 3, then the operator turns on the manual operation button (switch) 48 of the printing unit showing the occurrence of the error. If the error is corrected and a normal state is restored without the rotation of the plate cylinder 3, the plate changing button 41 is rendered ON to resume plate supply which has been suspended.

Then, the target unit is set to be the error unit in step P199, and the units other than the target unit are set to be return mode units in step P200 (mode setting step). Then, the current position is read from the plate changing counter 39 in step P201, and the return mode unit Nos. and the positions of the respective areas of the return mode units are read in step P202. Then, it is determined in step P203 whether there is the return mode unit whose current position is in area G or area A. If there is such return mode unit, the return mode of the target return mode unit is released in step P204 (first automatic return mode release step), and the program shifts to step P205.

If there is no such return mode unit, it is determined in step P236 whether there is the return mode unit whose current position is in area G. If such return mode unit is present in step P236, the plate press roller actuator 21 and the new plate moving actuator 28 of the target return mode unit are turned off in step P237 (first control step). In step P238, the return mode of the target return mode unit is automatically released in step P238 (first automatic return mode release step), and the program goes to step P205. If there is no such return mode unit, it is determined in step P205 whether there is the return mode unit whose current position is in area K.

If there is such return mode unit in step P205, the plate press roller actuator 21 and the plate supply cam actuator 33 of the target return mode unit are turned off in step P206 (first control step), whereupon the return mode of the target return mode unit is automatically released in step P207 (first automatic return mode release step). Then, the program proceeds to step P208. If there is no such return mode unit in step P205, it is determined in step P208 whether there is the return mode unit whose current position is in area I.

If there is such return mode unit in step P208, rotation of the main unit motor 34 in the reverse direction is locked (first drive lock step) in step P209 (see FIG. 33). Then, the next operating position of the target return mode unit is read in step P210. Then, it is determined in step P211 whether the inching button (switch) 49 of the target return mode unit is ON. If YES, the main unit motor 34 is normally rotated in step P212, and the current position is read from the plate changing counter 39 in step P213. Then, a determination is made in step P214 as to whether the current position is the next operating position (θi,5) of the target return mode unit. If NO, it is determined in step P215 whether the inching button (switch) 49 of the target return mode unit is OFF. If NO, the program returns to step P213. If YES, the main unit motor 34 is stopped in step P216, and the program returns to step P211.

The reason why rotation in the reverse direction of the main unit motor 34 is locked in step P209 to permit its rotation in the normal direction is as follows: The return mode unit belonging to area J is in a state where the leading edge of the new plate $W_1$ is being inserted into the gap 26 of the plate cylinder 3. Therefore, if the plate cylinder 3 is rotated at this stage, the leading edge of the new plate $W_1$ may be bent, and the new plate $W_1$ may become unusable. Depending on the status of insertion of the leading edge of the printing plate of the return mode unit belonging to area J, however, normal rotation of the plate cylinder 3 in this state may cause damage to the printing plate. In this case, a measure may have to be taken to rotate the plate cylinder 3 reversely to correct the status of insertion of the printing plate, and then rotate the plate cylinder 3 normally to move it into area D; or it may be necessary to rotate the plate cylinder 3 reversely, and then extract the leading edge of the plate from the plate cylinder 3. The operator must select a corrective measure suitable for the circumstances.

If the answer is affirmative in step P214, the main unit motor 34 is stopped in step P217, and locking of the main unit motor 34 is automatically released in step P218 (first lock release step). Then, the program proceeds to step P235. That is, the leading edge of the plate is mounted on the plate cylinder 3 by normal rotation, whereby the target return mode unit belonging to area I is shifted to area D.

If the answer is negative in step P211, it is determined in step P219 whether the manual operation button (switch) 48 of the target return mode unit is ON. If NO, the program returns to step P211. If YES, namely, if the operator judges it necessary to rotate the plate cylinder 3 reversely, the return mode of the target return mode unit is released in step P220 (first manual return mode release step), and locking of the main unit motor 34 is released in step P221 (first lock release step).

Then, in step P222, it is determined whether the reverse inching button (switch) 50 of the target return mode unit is ON. If NO, the program proceeds to step P226. If YES, the main unit motor 34 is rotated reversely in step P223. Then, if the reverse inching button (switch) 50 of the target return mode unit is OFF in step P224, the main unit motor 34 is stopped in step P225. That is, when the unit has come to a position where a measure can be taken, the main unit is stopped, and the measure taken. That is, the status of insertion of the printing plate is corrected, or the leading edge of the printing plate is extracted from the plate cylinder 3. If the leading edge of the printing plate is extracted from the plate cylinder 3, the manual operation button (switch) 48 of the target return mode unit is turned off in step P234 to be described later.

Then, in step P226, a determination is made as to whether the inching button (switch) 49 of the target return mode unit is ON. If YES, the main unit motor 34 is normally rotated in step P227, and the current position is read from the plate changing counter 39 in step P228. Then, in step P229, it is determined whether the current position is the next operating position (θi,5) of the target return mode unit. If YES, the main unit motor 34 is stopped in step P230, and locking of the main unit motor 34 is automatically released in step P231 (firs lock release step). Then, the program goes to step P235. That is, the leading edge of the plate is mounted on the plate cylinder 3 by normal rotation, whereby the target return mode unit belonging to area I is shifted to area D. If NO in step P229, it is determined in step P232 whether the inching button (switch) 49 of the target return mode unit is OFF. If NO, the program returns to step P228. If YES, the main unit motor 34 is stopped in step P233, and the program returns to step P222.

If the answer is NO in step P226, it is determined instep P234 whether the manual operation button (switch) 48 of the target return mode unit is OFF. If NO, the program returns to step P222. If YES, the program proceeds to step P235. In this manner, the operator observes the status of the target return mode unit and, if judging that normal rotation causes the leading edge of the plate to be mounted on the plate cylinder 3, the operator turns on the inching button (switch) 49 (step P211) to move the target return mode unit belonging to area I into area D. Then, the operator turns off the manual operation button (switch) 49 of the target return mode unit. If the operator judges reverse rotation necessary, the operator turns on the manual operation button (switch) 49 of the target return mode unit (step P219) to release locking of rotation in the reverse direction of the main unit motor 34 (step P221). Then, the main unit motor 34 is rotated reversely (step P223) to correct the printing plate into an appropriate state. Then, the inching button (switch) 49 is turned on (step P226) to move the target return mode unit belonging to area I into area D. Then, the manual operation button (switch) 49 of the target return mode unit is turned off. In extracting the leading edge of the plate from the plate cylinder 3, the steps taken are to turn on the manual operation button (switch) 49 of the return mode unit (step P219), release the locking of rotation in the reverse direction of the main unit motor 34 (step P221), rotate the main unit motor 34 reversely (step P223) to extract the leading edge of the plate, and turn off the manual operation button (switch) 49 of the target return mode unit.

If there is no relevant return mode unit in step P208, it is determined in step P235 whether there is the return mode unit whose current position is in area J. If there is no such return mode unit, the program returns to step P77. If there is such return mode unit, the main unit motor 34 is locked in step P236 (first drive lock step). Then, the manual operation button (switch) 48 of all target return mode units is turned on in step P237. Then, the return mode of the target return mode unit is released in step P238 (first manual return mode release step), and locking of the main unit motor 34 is released in step P239.

Then, in step 240, it is determined whether the inching button (switch) 49 of the target return mode unit is ON. If NO, the program goes to step P244. If YES, the main unit motor 34 is normally rotated in step P241. If the inching button (switch) 49 of the target return mode unit is OFF in step P242, the main unit motor 34 is stopped in step P243, and the program returns to step P240. That is, when the unit comes to a position where a measure can be taken, the main unit is stopped, and the measure taken.

Then, in step 244, it is determined whether the reverse inching button (switch) 50 of the target return mode unit is ON. If NO, the program goes to step P248. If YES, the main unit motor 34 is reversely rotated in step P245. If the reverse inching button (switch) 50 of the target return mode unit is OFF in step P246, the main unit motor 34 is stopped in step P247, and the program returns to step P240. That is, when the unit comes to a position where a measure can be taken, the main unit is stopped, and the measure taken.

Then, in step P248, it is determined whether the manual operation button (switch) 48 of the target return mode unit is OFF. If NO, the program returns to step P240. If YES, it is determined in step P249 whether the manual operation button (switch) 48 of all the target return mode units is OFF. If NO, the program returns to step P240. If YES, the program returns to step P77. At this point in time, only the return mode unit in area D is in the return mode, and the return mode of the other return mode units is released.

In the present embodiment, as described above, when a plate removal error is detected during the plate removal step and the main unit motor 34 stops, control is exercised on the automatic plate changer in the normal unit before start and after completion of removal of the removal plate $W_2$ from the plate cylinder 3 and during the operating state of the automatic plate changer. Thus, the removal plate $W_2$ of this normal unit can be dealt with automatically. Furthermore, if there is the normal unit in which the end portion of the removal plate $W_2$ is being removed, driving of the main unit motor 34 is locked. Thus, damage to the removal plate $W_2$ can be prevented in the normal unit which is immediately after start of the error elimination step. Also, the operator can be prevented from accidentally performing the error elimination step before dealing with the removal plate $W_2$ of the normal unit. During the error elimination step, moreover, driving of the main unit motor 34 is locked, when the normal unit is located in a phase related to removal of the end portion of the removal plate $W_2$. Thus, before the error elimination step is resumed, the removal plate $W_2$ of the normal unit can be dealt with. Thus, damage to the removal plate $W_2$ of the normal unit can be prevented, return work for plate changing can be performed easily in a short amount of time, and burden on the operator can be reduced. Besides, the operator can be prevented from making the mistake of resuming the error elimination step before dealing with the removal plate $W_2$ of the normal unit.

When a plate supply error is detected during the plate supply step and the main unit motor 34 stops, control is exercised on the automatic plate changer in the normal unit before mounting of the leading end portion of the new plate $W_1$ and after mounting of the new plate $W_1$ on the plate cylinder 3 and during the operating state of the automatic plate changer. Thus, the new plate $W_1$ of this normal unit can be dealt with automatically. Furthermore, if there is the normal unit in which the leading end portion of the new plate $W_1$ is being mounted, driving of the main unit motor 34 at least in the direction of removal of the printing plate is prohibited. Thus, damage to the new plate $W_1$ immediately after handling of the new plate in the normal unit can be prevented. Also, the operator can be prevented from mistakenly performing the error elimination step before handling of the new plate $W_1$ of the normal unit. During the error elimination step, moreover, driving of the main unit motor 34 is locked, when the normal unit is located in a phase related to supply of the end portion of the new plate $W_1$. Thus, before the error elimination step is resumed, the new plate $W_1$ of the normal unit can be handled. Thus, damage to the new plate $W_1$ of the normal unit can be prevented, return work for the plate changing can be performed easily in a short amount of time, and burden on the operator can be reduced. Besides, the operator can be prevented from making the mistake of resuming the error elimination step before handling the new plate $W_1$ of the normal unit.

Furthermore, during the error elimination step, when the normal unit is located in a phase related to removal of the end portion of printing plate, the end portion of the printing plate can be removed automatically to separate the end portion of the printing plate from the plate cylinder 3, and the inability of the main unit motor 34 to be driven at least in the direction of plate removal can be automatically released. Thus, the operator can resume the error elimination step without reciprocating between the error unit and the normal unit, can prevent damage to the printing plate of the normal unit, and can do return work for the plate changing easily in a short amount of time. Also, burden on the operator can be reduced.

If there is the normal unit remaining untreated after the error elimination step, it is possible to treat the printing plate of other normal unit which is located in a specific phase when the plate cylinder 3 is rotated normally or reversely to handle the printing plate of the untreated normal unit. Thus, return work for the plate changing can be done easily in a short amount of time, and burden on the operator can be reduced.

Besides, the return mode of the return mode unit can be automatically released according to the progress status of plate changing of the normal unit. Thus, return work for the plate changing can be done easily in a short amount of time, and burden on the operator can be reduced.

The present invention also has the advantage that after a plate changing error is detected and the main unit motor 34 is stopped, the plate changing which has been suspended can be easily resumed by operating the plate changing button 41.

While the present invention has been described by the above embodiment, it is to be understood that the invention is not limited thereby, but may be varied or modified in many other ways. For example, the phase of the main unit motor 34 detected by the rotary encoder 38 is controlled as the phase of the plate cylinder of each printing unit, when the detected plate changing is performed or a plate changing error is handled. However, a rotary encoder can be provided in each printing unit, and control can be exercised based on the output from each rotary encoder. In the above embodiment, moreover, means for removing the printing plate from the plate cylinder and means for supplying the printing plate to the plate cylinder are shown as the plate changing means. However, these means are not restrictive, and the present invention may be applied to means for performing at least one of removal of the printing plate and supply of the printing plate. Such variations or modifications are not to be regarded as a departure from the spirit and scope of the invention, and all such variations and modifications as would be obvious to one skilled in the art are intended to be included within the scope of the appended claims.

What is claimed is:

1. A method for a plate changing in a printing press, for rotating all plate cylinders of a plurality of printing units by a drive device, and performing at least one of removal of printing plates from said plate cylinders and supply of printing plates to said plate cylinders by plate changing means provided in correspondence with said plate cylinders, comprising:

an abnormality detection step of detecting presence or absence of a plate changing abnormality by a detector provided in correspondence with each of said plate cylinders;

a stop step of stopping said drive device when said plate changing abnormality is detected in said abnormality detection step;

a return step of controlling at least one of said drive device and said plate changing means of a normal unit, other than an error unit in which said plate changing abnormality has been detected, in accordance with a status of progress of plate changing in said normal unit after said stop step; and an error elimination step of eliminating said plate changing abnormality in said error unit, in which said plate changing abnormality has been detected, after said stop step.

2. The method for plate changing in a printing press according to claim 1, wherein said return step includes a first return step of controlling at least one of said drive device and said plate changing means of said normal unit in accordance with said status of progress of plate changing in said normal unit at a position when said drive device has been stopped by said stop step, and said first return step is executed before start of said error elimination step.

3. The method for plate changing in a printing press according to claim 2, wherein said first return step includes:

a first control step of controlling said plate changing means of said normal unit when there is said normal unit in which opposite end portions of said printing plate both are not mounted on said plate cylinder or are both mounted on said plate cylinder and said plate changing means is in an operating state;

a first drive lock step of prohibiting driving of said drive device at least in a plate removal direction when there is said normal unit in one of a first incomplete removal state where one end of said printing plate is mounted on said plate cylinder, and removal of other end of said printing plate from said plate cylinder is started, but said removal is not completed, and a second incomplete removal state where one end of said printing plate whose other end has been removed from said plate cylinder is located between an automatic removal position, at which said one end of said printing plate can be automatically removed, and a manual removal position at which said one end of said printing plate can be manually removed, and a first incomplete supply state where one end of said printing plate is mounted on said plate cylinder, and mounting of other end of said printing plate on said plate cylinder is started, but said mounting is not completed, and a second incomplete supply state where mounting of one end of said printing plate on said plate cylinder is started, but said mounting is not completed; and a first lock release step of releasing a state, which prohibits driving of said drive device at least in said plate removal direction, by operating a manual operation switch of said normal unit in said first incomplete removal state, said second incomplete removal state, said first incomplete supply state, or said second incomplete supply state after said first drive lock step.

4. The method for plate changing in a printing press according to claim 3, wherein said plate cylinder includes plate holding means movable between a holding position, at which said plate holding means holds an end portion of said printing plate, and a release position at which said plate holding means releases holding of said end portion of said printing plate, said plate changing means includes:

plate removal switching means supported to be movable between a plate removal operating position, at which said plate removal switching means switches said plate holding means from said holding position to said release position, and a plate removal retreat position at which said plate removal switching means retreats from said plate removal operating position;

removal holding means supported to be movable between a removal holding position, at which said removal holding means removes one end of said printing plate from said plate cylinder and holds said one end of said printing plate separated from said plate cylinder, and a holding release position at which said removal holding means releases holding of said printing plate;

removal plate accommodation portion for accommodating said printing plate removed from said plate cylinder;

removal plate accommodation means for moving said printing plate into said removal plate accommodation portion;

first removal plate detection means for detecting a failure in removal of other end of said printing plate from said plate cylinder; and second removal plate detection means for detecting a failure in removal of one end of said printing plate from said plate cylinder, said method for plate changing further comprises:

a plate removal step for removing said printing plate from said plate cylinder, said plate removal step includes:

a plate removal drive step of driving said drive device in said plate removal direction;

a plate removal phase detection step of detecting a phase of said plate cylinder;

a plate removal switching means operating step which, when said phase detected in said plate removal phase detection step is a plate removal switching means operating position, moves said plate removal switching means of corresponding said printing unit to said plate removal operating position;

a plate removal switching step, in which at a plate removal switching start position, switching of said plate holding means from said holding position to said release position by said plate removal switching means of corresponding said printing unit is started, and at a plate removal switching termination position, switching of said plate holding means from said holding position to said release position by said plate removal switching means of corresponding said printing unit is terminated;

a removal holding means operating step which, when said phase detected in said plate removal phase detection step is a plate removal holding means operating position, moves said removal holding means of corresponding said printing unit to said removal holding position; and a removal plate accommodation step which, when said phase detected in said plate removal phase detection step is a removal plate accommodation position, moves said removal holding means of corresponding said printing unit to said holding release position, and also moves said printing plate to said removal plate accommodation portion by said removal plate accommodation means, said abnormality detection step includes:

a first removal plate detection step which, when said phase detected in said plate removal phase detection step is a first removal plate detection position, detects a plate removal abnormality by said first removal plate detection means of corresponding said printing unit; and a second removal plate detection step of detecting the plate removal abnormality by said second removal plate detection means for said printing unit after execution of said removal holding means operating step and before execution of said removal plate accommodation step, said first control step moves said plate removal switching means of said normal unit, which is located between said plate removal switching means operating position and said plate removal switching start position, to said plate removal retreat position, and moves said removal holding means of said normal unit, which is located between a manual removal position, where one end of said printing plate can be manually removed from said plate cylinder, and said removal plate accommodation position, to said holding release position and moves said printing plate to said removal plate accommodation portion by said removal plate accommodation means, said first drive lock step is performed when there is said normal unit located between said plate removal switching start position and said plate removal switching termination position or between said removal holding means operating position and said manual removal position, said error elimination step is performed after said first lock release step, and said second drive lock step is performed when said normal unit, which has been located between said plate removal switching termination position and said removal holding means operating position in said stop step, is located at said plate removal switching termination position during driving of said drive device in a direction opposite to the plate removal direction by said drive step, or at said manual removal position during driving of said drive device in the plate removal direction by said drive step.

5. The method for plate changing in a printing press according to claim 3, wherein said plate cylinder includes plate holding means movable between a holding position, at which said plate holding means holds an end portion of said printing plate, and a release position at which said plate holding means releases holding of said end portion of said printing plate, said plate changing means includes:

a plate press roller supported to be contactable with and separable from said plate cylinder;

plate supply switching means supported to be movable between a plate supply operating position, at which said plate supply switching means switches said plate holding means from said release position to said holding position, and a plate supply retreat position at which said plate supply switching means retreats from said plate supply operating position;

removal holding means supported to be movable between a removal holding position, at which said removal holding means removes one end of said printing plate from said plate cylinder and holds said one end of said printing plate separated from said plate cylinder, and a holding release position at which said removal holding means releases holding of said printing plate;

a new plate accommodation portion for accommodating a printing plate to be supplied to said plate cylinder;

new plate moving means for moving a printing plate from said new plate accommodation portion to said plate cylinder or from said plate cylinder to said new plate accommodation portion; and new plate detection means for detecting a failure in mounting of one end of a printing plate on said plate cylinder;

said method for plate changing further comprises:

a plate supply step of supplying a printing plate to said plate cylinder, said plate supply step includes:

a plate press roller operating step of bringing said plate press rollers of all of said printing units into contact with said plate cylinders;

a plate supply drive step of driving said drive device in the plate supply direction;

a plate supply phase detection step of detecting a phase of said plate cylinder;

a plate supply switching means operating step which, when the phase detected in said plate supply phase detection step is a plate supply switching means operating position, moves said plate supply switching means of corresponding said printing unit to said plate supply operating position;

a plate supply switching step, in which at a plate supply switching start position, switching of said plate holding means from said release position to said holding position by said plate supply switching means of corresponding said printing unit is started, and at a plate supply switching termination position, switching of said plate holding means from said release position to said holding position by said plate supply switching means of corresponding said printing unit is terminated; and a plate press roller retreat step which, when the phase detected in said plate supply phase detection step is a plate press roller retreat position, separates said plate press roller of corresponding said printing unit from said plate cylinder, said abnormality detection step includes:

a plate supply detection step which, when the phase detected in said plate supply phase detection step is a plate supply detection position, detects a plate supply abnormality by plate supply detection means of corresponding said printing unit, said first control step retreats said plate press roller from said plate cylinder in said normal unit, which is located between a position where said plate press roller operating step is started and a new plate insertion start position where mounting of one end of said printing plate on said plate cylinder is started, and also moves a printing plate to said new plate accommodation portion by said new plate moving means, and retreats said plate press roller of said normal unit, which is located between said plate supply switching termination position and said plate press roller retreat position, from said plate cylinder, and also moves said plate supply switching means to said plate supply retreat position, said first drive lock step is performed when there is said normal unit located between said new plate insertion start position and said plate supply detection position or between said plate supply switching means operating position and said plate supply switching termination position, said error elimination step is performed after said first lock release step, and said second drive lock step is performed when said normal unit, which has been located between said plate supply detection position and said plate supply switching means operating position in said stop step, is located at said plate supply switching means operating position during driving of said drive device in a plate supply direction by said drive step, or at said manual removal position, at which one end of said printing plate can be manually removed from said plate cylinder, during driving of said drive device in a direction opposite to the plate supply direction by said drive step.

6. The method for plate changing in a printing press according to claim 2, further comprising a second drive step of driving said drive device after said error elimination step to rotate said plate cylinder, and wherein said return step has a third return step of controlling at least one of said drive device and said plate changing means of said normal unit in accordance with a status of said normal unit when the plate cylinder of said normal unit is in a predetermined phase during said second drive step.

7. The method for plate changing in a printing press according to claim 2, wherein said error elimination step has a drive step of driving said drive device to rotate said plate cylinder, and said return step has a second return step of controlling at least one of said drive device and said plate changing means of said normal unit in accordance with a status of said normal unit when said plate cylinder of said normal unit is in a predetermined phase during said drive step.

8. The method for plate changing in a printing press according to claim 7, wherein said second return step includes:

a second drive lock step of prohibiting driving of said drive device at least in a plate removal direction, when said plate cylinder of said normal unit being in a state, where one end of said printing plate is mounted on said plate cylinder and other end of said printing plate is not mounted on said plate cylinder, is located in a phase in which said one end of said printing plate is removed from said plate cylinder during rotation of said drive device in said plate removal direction, or when said plate cylinder of said normal unit being in said state is located in a phase in which said other end of said printing plate is mounted on said plate cylinder during rotation of said drive device in a plate supply direction; and a second lock release step of releasing a state, which prohibits driving of said drive device, after said second drive lock step.

9. The method for plate changing in a printing press according to claim 8, wherein said plate cylinder includes plate holding means movable between a holding position, at which said plate holding means holds an end portion of said printing plate, and a release position at which said plate holding means releases holding of said end portion of said printing plate, said plate changing means includes:

plate removal switching means supported to be movable between a plate removal operating position, at which said plate removal switching means switches said plate holding means from said holding position to said release position, and a plate removal retreat position at which said plate removal switching means retreats from said plate removal operating position;

removal holding means supported to be movable between a removal holding position, at which said removal holding means removes one end of said printing plate from said plate cylinder and holds said one end of said printing plate separated from said plate cylinder, and a holding release position at which said removal holding means releases holding of said printing plate;

removal plate accommodation portion for accommodating said printing plate removed from said plate cylinder;

removal plate accommodation means for moving said printing plate into said removal plate accommodation portion;

first removal plate detection means for detecting a failure in removal of other end of said printing plate from said plate cylinder; and second removal plate detection means for detecting a failure in removal of one end of said printing plate from said plate cylinder, said method for plate changing further comprises:

a plate removal step for removing said printing plate from said plate cylinder, said plate removal step includes:

a plate removal drive step of driving said drive device in said plate removal direction;

a plate removal phase detection step of detecting a phase of said plate cylinder;

a plate removal switching means operating step which, when said phase detected in said plate removal phase detection step is a plate removal switching means operating position, moves said plate removal switching means of corresponding said printing unit to said plate removal operating position;

a plate removal switching step, in which at a plate removal switching start position, switching of said plate holding means from said holding position to said release position by said plate removal switching means of corresponding said printing unit is started, and at a plate removal switching termination position, switching of said plate holding means from said holding position to said release position by said plate removal switching means of corresponding said printing unit is terminated;

a removal holding means operating step which, when said phase detected in said plate removal phase detection step is a plate removal holding means operating position, moves said removal holding means of corresponding said printing unit to said removal holding position; and a removal plate accommodation step which, when said phase detected in said plate removal phase detection step is a removal plate accommodation position, moves said removal holding means of corresponding said printing unit to said holding release position, and also moves said printing plate to said removal plate accommodation portion by said removal plate accommodation means, said abnormality detection step includes:

a first removal plate detection step which, when said phase detected in said plate removal phase detection step is a first removal plate detection position, detects a plate removal abnormality by said first removal plate detection means of corresponding said printing unit; and a second removal plate detection step of detecting the plate removal abnormality by said second removal plate detection means for said printing unit after execution of said removal holding means operating step and before execution of said removal plate accommodation step, said first control step moves said plate removal switching means of said normal unit, which is located between said plate removal switching means operating position and said plate removal switching start position, to said plate removal retreat position, and moves said removal holding means of said normal unit, which is located between a manual removal position, where one end of said printing plate can be manually removed from said plate cylinder, and said removal plate accommodation position, to said holding release position and moves said printing plate to said removal plate accommodation portion by said removal plate accommodation means, said first drive lock step is performed when there is said normal unit located between said plate removal switching start position and said plate removal switching termination position or between said removal holding means operating position and said manual removal position, said error elimination step is performed after said first lock release step, and said second drive lock step is performed when said normal unit, which has been located between said plate removal switching termination position and said removal holding means operating position in said stop step, is located at said plate removal switching termination position during driving of said drive device in a direction opposite to the plate removal direction by said drive step, or at said manual removal position during driving of said drive device in the plate removal direction by said drive step.

10. The method for plate changing in a printing press according to claim 8, wherein said plate cylinder includes plate holding means movable between a holding position, at which said plate holding means holds an end portion of said printing plate, and a release position at which said plate holding means releases holding of said end portion of said printing plate, said plate changing means includes:

a plate press roller supported to be contactable with and separable from said plate cylinder;

plate supply switching means supported to be movable between a plate supply operating position, at which said plate supply switching means switches said plate holding means from said release position to said holding position, and a plate supply retreat position at which said plate supply switching means retreats from said plate supply operating position;

removal holding means supported to be movable between a removal holding position, at which said removal holding means removes one end of said printing plate from said plate cylinder and holds said one end of said printing plate separated from said plate cylinder, and a holding release position at which said removal holding means releases holding of said printing plate;

a new plate accommodation portion for accommodating a printing plate to be supplied to said plate cylinder;

new plate moving means for moving a printing plate from said new plate accommodation portion to said plate cylinder or from said plate cylinder to said new plate accommodation portion; and new plate detection means for detecting a failure in mounting of one end of a printing plate on said plate cylinder;

said method for plate changing further comprises:

a plate supply step of supplying a printing plate to said plate cylinder, said plate supply step includes:

a plate press roller operating step of bringing said plate press rollers of all of said printing units into contact with said plate cylinders;

a plate supply drive step of driving said drive device in the plate supply direction;

a plate supply phase detection step of detecting a phase of said plate cylinder;

a plate supply switching means operating step which, when the phase detected in said plate supply phase detection step is a plate supply switching means operating position, moves said plate supply switching means of corresponding said printing unit to said plate supply operating position;

a plate supply switching step, in which at a plate supply switching start position, switching of said plate holding means from said release position to said holding position by said plate supply switching means of corresponding said printing unit is started, and at a plate supply switching termination position, switching of said plate holding means from said release position to said holding position by said plate supply switching means of corresponding said printing unit is terminated; and a plate press roller retreat step which, when the phase detected in said plate supply phase detection step is a plate press roller retreat position, separates said plate press roller of corresponding said printing unit from said plate cylinder, said abnormality detection step includes:

a plate supply detection step which, when the phase detected in said plate supply phase detection step is a plate supply detection position, detects a plate supply abnormality by plate supply detection means of corresponding said printing unit, said first control step retreats said plate press roller from said plate cylinder in said normal unit, which is located between a position where said plate press roller operating step is started and a new plate insertion start position where mounting of one end of said printing plate on said plate cylinder is started, and also moves a printing plate to said new plate accommodation portion by said new plate moving means, and retreats said plate press roller of said normal unit, which is located between said plate supply switching termination position and said plate press roller retreat position, from said plate cylinder, and also moves said plate supply switching means to said plate supply retreat position, said first drive lock step is performed when there is said normal unit located between said new plate insertion start position and said plate supply detection position or between said plate supply switching means operating position and said plate supply switching termination position, said error elimination step is performed after said first lock release step, and said second drive lock step is performed when said normal unit, which has been located between said plate supply detection position and said plate supply switching means operating position in said stop step, is located at said plate supply switching means operating position during driving of said drive device in a plate supply direction by said drive step, or at said manual removal position, at which one end of said printing plate can be manually removed from said plate cylinder, during driving of said drive device in a direction opposite to the plate supply direction by said drive step.

11. The method for plate changing in a printing press according to claim 7, further comprising a second drive step of driving said drive device after said error elimination step to rotate said plate cylinder, and wherein said return step has a third return step of controlling at least one of said drive device and said plate changing means of said normal unit in accordance with a status of said normal unit when the plate cylinder of said normal unit is in a predetermined phase during said second drive step.

12. The method for plate changing in a printing press according to claim 1, wherein said error elimination step has a drive step of driving said drive device to rotate said plate cylinder, and said return step has a second return step of controlling at least one of said drive device and said plate changing means of said normal unit in accordance with a status of said normal unit when said plate cylinder of said normal unit is in a predetermined phase during said drive step.

13. The method for plate changing in a printing press according to claim 12, wherein said second return step includes:

a second drive lock step of prohibiting driving of said drive device at least in a plate removal direction, when said plate cylinder of said normal unit being in a state, where one end of said printing plate is mounted on said plate cylinder and other end of said printing plate is not mounted on said plate cylinder, is located in a phase in which said one end of said printing plate is removed from said plate cylinder during rotation of said drive device in said plate removal direction, or when said plate cylinder of said normal unit being in said state is located in a phase in which said other end of said printing plate is mounted on said plate cylinder during rotation of said drive device in a plate supply direction; and a second lock release step of releasing a state, which prohibits driving of said drive device, after said second drive lock step.

14. The method for plate changing in a printing press according to claim 13, wherein said plate cylinder includes plate holding means movable between a holding position, at which said plate holding means holds an end portion of said printing plate, and a release position at which said plate holding means releases holding of said end portion of said printing plate, said plate changing means includes:

plate removal switching means supported to be movable between a plate removal operating position, at which said plate removal switching means switches said plate holding means from said holding position to said release position, and a plate removal retreat position at which said plate removal switching means retreats from said plate removal operating position;

removal holding means supported to be movable between a removal holding position, at which said removal holding means removes one end of said printing plate from said plate cylinder and holds said one end of said printing plate separated from said plate cylinder, and a holding release position at which said removal holding means releases holding of said printing plate;

removal plate accommodation portion for accommodating said printing plate removed from said plate cylinder;

removal plate accommodation means for moving said printing plate into said removal plate accommodation portion;

first removal plate detection means for detecting a failure in removal of other end of said printing plate from said plate cylinder; and second removal plate detection means for detecting a failure in removal of one end of said printing plate from said plate cylinder, said method for plate changing further comprises:

a plate removal step for removing said printing plate from said plate cylinder, said plate removal step includes:

a plate removal drive step of driving said drive device in said plate removal direction;

a plate removal phase detection step of detecting a phase of said plate cylinder;

a plate removal switching means operating step which, when said phase detected in said plate removal phase detection step is a plate removal switching means operating position, moves said plate removal switching means of corresponding said printing unit to said plate removal operating position;

a plate removal switching step, in which at a plate removal switching start position, switching of said plate holding means from said holding position to said release position by said plate removal switching means of corresponding said printing unit is started, and at a plate removal switching termination position, switching of said plate holding means from said holding position to said release position by said plate removal switching means of corresponding said printing unit is terminated;

a removal holding means operating step which, when said phase detected in said plate removal phase detection step is a plate removal holding means operating position, moves said removal holding means of corresponding said printing unit to said removal holding position; and a removal plate accommodation step which, when said phase detected in said plate removal phase detection step is a removal plate accommodation position, moves said removal holding means of corresponding said printing unit to said holding release position, and also moves said printing plate to said removal plate accommodation portion by said removal plate accommodation means, said abnormality detection step includes:

a first removal plate detection step which, when said phase detected in said plate removal phase detection step is a first removal plate detection position, detects a plate removal abnormality by said first removal plate detection means of corresponding said printing unit; and a second removal plate detection step of detecting the plate removal abnormality by said second removal plate detection means for said printing unit after execution of said removal holding means operating step and before execution of said removal plate accommodation step, said first control step moves said plate removal switching means of said normal unit, which is located between said plate removal switching means operating position and said plate removal switching start position, to said plate removal retreat position, and moves said removal holding means of said normal unit, which is located between a manual removal position, where one end of said printing plate can be manually removed from said plate cylinder, and said removal plate accommodation position, to said holding release position and moves said printing plate to said removal plate accommodation portion by said removal plate accommodation means, said first drive lock step is performed when there is said normal unit located between said plate removal switching start position and said plate removal switching termination position or between said removal holding means operating position and said manual removal position, said error elimination step is performed after said first lock release step, and said second drive lock step is performed when said normal unit, which has been located between said plate removal switching termination position and said removal holding means operating position in said stop step, is located at said plate removal switching termination position during driving of said drive device in a direction opposite to the plate removal direction by said drive step, or at said manual removal position during driving of said drive device in the plate removal direction by said drive step.

15. The method for plate changing in a printing press according to claim 13, wherein said plate cylinder includes plate holding means movable between a holding position, at which said plate holding means holds an end portion of said printing plate, and a release position at which said plate holding means releases holding of said end portion of said printing plate, said plate changing means includes:

a plate press roller supported to be contactable with and separable from said plate cylinder;

plate supply switching means supported to be movable between a plate supply operating position, at which said plate supply switching means switches said plate holding means from said release position to said holding position, and a plate supply retreat position at which said plate supply switching means retreats from said plate supply operating position;

removal holding means supported to be movable between a removal holding position, at which said removal holding means removes one end of said printing plate from said plate cylinder and holds said one end of said printing plate separated from said plate cylinder, and a holding release position at which said removal holding means releases holding of said printing plate;

a new plate accommodation portion for accommodating a printing plate to be supplied to said plate cylinder;

new plate moving means for moving a printing plate from said new plate accommodation portion to said plate cylinder or from said plate cylinder to said new plate accommodation portion; and new plate detection means for detecting a failure in mounting of one end of a printing plate on said plate cylinder;

said method for plate changing further comprises:

a plate supply step of supplying a printing plate to said plate cylinder, said plate supply step includes:

a plate press roller operating step of bringing said plate press rollers of all of said printing units into contact with said plate cylinders;

a plate supply drive step of driving said drive device in the plate supply direction;

a plate supply phase detection step of detecting a phase of said plate cylinder;

a plate supply switching means operating step which, when the phase detected in said plate supply phase detection step is a plate supply switching means operating position, moves said plate supply switching means of corresponding said printing unit to said plate supply operating position;

a plate supply switching step, in which at a plate supply switching start position, switching of said plate holding means from said release position to said holding position by said plate supply switching means of corresponding said printing unit is started, and at a plate supply switching termination position, switching of said plate holding means from said release position to said holding position by said plate supply switching means of corresponding said printing unit is terminated; and a plate press roller retreat step which, when the phase detected in said plate supply phase detection step is a plate press roller retreat position, separates said plate press roller of corresponding said printing unit from said plate cylinder, said abnormality detection step includes:

a plate supply detection step which, when the phase detected in said plate supply phase detection step is a plate supply detection position, detects a plate supply abnormality by plate supply detection means of corresponding said printing unit, said first control step retreats said plate press roller from said plate cylinder in said normal unit, which is located between a position where said plate press roller operating step is started and a new plate insertion start position where mounting of one end of said printing plate on said plate cylinder is started, and also moves a printing plate to said new plate accommodation portion by said new plate moving means, and retreats said plate press roller of said normal unit, which is located between said plate supply switching termination position and said plate press roller retreat position, from said plate cylinder, and also moves said plate supply switching means to said plate supply retreat position, said first drive lock step is performed when there is said normal unit located between said new plate insertion start position and said plate supply detection position or between said plate supply switching means operating position and said plate supply switching termination position, said error elimination step is performed after said first lock release step, and said second drive lock step is performed when said normal unit, which has been located between said plate supply detection position and said plate supply switching means operating position in said stop step, is located at said plate supply switching means operating position during driving of said drive device in a plate supply direction by said drive step, or at said manual removal position, at which one end of said printing plate can be manually removed from said plate cylinder, during driving of said drive device in a direction opposite to the plate supply direction by said drive step.

16. The method for plate changing in a printing press according to any of claims 4, 5, 9, 14, 10, or 15, wherein said second return step includes:

an automatic removal holding step which, when the plate cylinder of said normal unit is located at said manual removal position, moves said removal holding means of corresponding said normal unit to said removal holding position; and a removal confirmation step of detecting a plate removal abnormality by said second removal plate detection means after said automatic removal holding step, and said second lock release step is performed when it is confirmed in said removal confirmation step that a printing plate has been removed normally.

17. The method for plate changing in a printing press according to claim 12, wherein each of said printing units is provided with a manual operation switch, a mode setting step is provided of operating said manual operation switch of said printing unit, in which a plate changing abnormality has been detected, after said stop step, setting said printing unit with the detected plate changing abnormality to be an error unit, and setting the normal unit other than said error unit to be a return mode unit, said first return step includes:

a first automatic return mode release step of automatically releasing a return mode of said return mode unit in accordance with a status of progress of plate changing of said return mode unit; and a first manual return mode release step of operating the manual operation switch of said return mode unit to release the return mode, and said second return step is performed for said return mode unit not released from the return mode, and includes:

a second automatic return mode release step of automatically releasing the return mode of said return mode unit in accordance with a status of said return mode unit; and a second manual return mode release step of operating the manual operation switch of said return mode unit to release the return mode.

18. The method for plate changing in a printing press according to claim 17, wherein a plate changing switch for starting plate changing is provided, and a plate changing resumption step of operating said plate changing switch to drive said drive device, thereby resuming plate changing suspended by said stop step, is provided before said mode setting step.

19. The method for plate changing in a printing press according to claim 12, further comprising a second drive step of driving said drive device after said error elimination step to rotate said plate cylinder, and wherein said return step has a third return step of controlling at least one of said drive device and said plate changing means of said normal unit in accordance with a status of said normal unit when the plate cylinder of said normal unit is in a predetermined phase during said second drive step.

20. An apparatus for plate changing in a printing press, comprising:

a plurality of printing units each having a plate cylinder;

a drive device for driving all of said plate cylinders;

plate changing means provided in correspondence with said plate cylinders and adapted to perform at least one of removal of a printing plate from said plate cylinder and supply of a printing plate to said plate cylinder; and detection means provided in correspondence with said plate cylinders and adapted to detect a plate changing abnormality, said apparatus for plate changing further comprising a control device for stopping said drive device if the plate changing abnormality is detected by said detection means during plate changing, and controlling at least one of said drive device and said plate changing means of a normal unit, other than an error unit in which the plate changing abnormality has been detected, in accordance with a status of progress of plate changing in said normal unit after said drive device is stopped.

21. The apparatus for plate changing in a printing press according to claim 20, wherein said control device either prohibits driving of said drive device at least in a plate removal direction, or controls said plate changing means of said normal unit, in accordance with the status of progress of plate changing in said normal unit when said drive device is stopped.

22. The apparatus for plate changing in a printing press according to claim 20 or 21, further comprising phase detection means for detecting a phase of said plate cylinder, and wherein said control device stops said drive device when the phase detected by said phase detection means becomes a predetermined phase during driving of said drive device performed after stoppage of said drive device.

23. The apparatus for plate changing in a printing press according to claim 22, wherein each of said printing units has a manual operation switch, and drive device driving means for driving said drive device in a direction of normal rotation and in a direction of reverse rotation, said plate cylinder includes plate holding means movable between a holding position, at which said plate holding means holds an end portion of a printing plate, and a release position at which said plate holding means releases holding of said end portion of said printing plate, said plate changing means includes:

plate removal switching means supported to be movable between a plate removal operating position, at which said plate removal switching means can switch said plate holding means from said holding position to said release position, and a plate removal retreat position at which said plate removal switching means retreats from said plate removal operating position;

removal holding means supported to be movable between a removal holding position, at which said removal holding means removes one end portion of a printing plate from said plate cylinder and holds said one end portion of said printing plate separated from said plate cylinder, and a holding release position at which said removal holding means releases holding of said printing plate;

removal plate accommodation portion for accommodating the printing plate removed from said plate cylinder;

removal plate accommodation means for moving the printing plate into said removal plate accommodation portion;

first removal plate detection means for detecting a failure in removal of other end portion of the printing plate from said plate cylinder; and second removal plate detection means for detecting a failure in removal of one end portion of a printing plate from said plate cylinder, said control device drives said drive device in a plate removal direction;

when the phase detected by said phase detection means is a plate removal switching means operating position, moves said plate removal switching means of corresponding said printing unit to said plate removal operating position;

when the phase detected by said phase detection means is a first removal plate detection position, detects a plate removal abnormality by said first removal plate detection means of corresponding said printing unit;

if the plate removal abnormality is not detected by detection of said first removal plate detection means, when the phase detected by said phase detection means is a removal holding means operating position, moves said removal holding means of corresponding said printing unit to said removal holding position, and detects the plate removal abnormality by said second removal plate detection means of said printing unit concerned;

if the plate removal abnormality is not detected by detection of said second removal plate detection means, when the phase detected by said phase detection means is a removal plate accommodation position, moves said removal holding means of corresponding said printing unit to said holding release position, and also moves the printing plate to said removal plate accommodation portion by said removal plate accommodation means to accommodate a removal plate;

when the plate removal abnormality is detected by said first removal plate detection means and said second removal plate detection means, stops said drive device;

when said normal unit at a position of stoppage is located between said plate removal switching means operating position and a plate removal switching start position, at which switching of said plate holding means from said holding position to said release position by said plate removal switching means is started, moves said plate removal switching means of said normal unit to said plate removal retreat position;

when said normal unit at the position of stoppage is located between a manual removal position, at which one end portion of said printing plate can be manually removed from said plate cylinder, and said removal plate accommodation position, moves said removal holding means of said normal unit to said holding release position, and also moves the printing plate to said removal plate accommodation portion by said removal plate accommodation means;

when said normal unit at the position of stoppage is located between said plate removal switching start position and a plate removal switching termination position, at which switching of said plate holding means from said holding position to said release position by said plate removal switching means is terminated, or between said removal holding means operating position and said manual removal position, locks said drive device so as to be undrivable until said manual operation switch of said normal unit is operated;

when a phase of said normal unit, which has been located between said plate removal switching termination position and said removal holding means operating position, is located at said plate removal switching termination position during driving of said drive device by operating said drive device driving means of said error unit, stops said drive device, and locks said drive device so as to be undrivable until said manual operation switch of said normal unit is operated.

24. The apparatus for plate changing in a printing press according to claim 22, wherein each of said printing units has a manual operation switch, and drive device driving means for driving said drive device in a direction of normal rotation and in a direction of reverse rotation, said plate cylinder includes plate holding means movable between a holding position, at which said plate holding means holds an end portion of a printing plate, and a release position at which said plate holding means releases holding of said end portion of said printing plate, said plate changing means includes:

a plate press roller supported to be contactable with and separable from said plate cylinder;

plate supply switching means supported to be movable between a plate supply operating position, at which said plate supply switching means switches said plate holding means from said release position to said holding position, and a plate supply retreat position at which said plate supply switching means retreats from said plate supply operating position;

removal holding means supported to be movable between a removal holding position, at which said removal holding means removes one end portion of a printing plate from said plate cylinder and holds said one end portion of said printing plate separated from said plate cylinder, and a holding release position at which said removal holding means releases holding of said printing plate;

a new plate accommodation portion for accommodating a printing plate to be supplied to said plate cylinder;

new plate moving means for moving a printing plate from said new plate accommodation portion to said plate cylinder or from said plate cylinder to said new plate accommodation portion; and new plate detection means for detecting a failure in mounting of one end portion of a printing plate on said plate cylinder, said control device brings said plate press roller of each of all said printing units into contact with said plate cylinder;

drives said drive device in a plate supply direction;

when the phase detected by said phase detection means is a plate supply detection position, detects a plate supply abnormality by said plate supply detection means of corresponding said printing unit;

if the plate supply abnormality is not detected by said plate supply detection means, when the phase detected by said phase detection means is a plate supply switching means operating position, moves said plate supply switching means of corresponding said printing unit to said plate supply operating position;

when the phase detected by said phase detection means is a plate press roller retreat position, separates said plate press roller of corresponding said printing unit from said plate cylinder;

when the plate supply abnormality is detected by detection of said plate supply detection means, stops said drive device;

when said normal unit at a position of stoppage is located between a point of contact of said plate press roller with said plate cylinder and a new plate insertion start position, at which mounting of one end of said printing plate on said plate cylinder is started, retreats said plate press roller of said normal unit from said plate cylinder, and also moves the printing plate to said new plate accommodation portion by said new plate moving means;

when said normal unit at the position of stoppage is located between a plate supply switching termination position, at which switching of said plate holding means from said release position to said holding position by said plate supply switching means is terminated, and said plate press roller retreat position, retreats said plate press roller of said normal unit from said plate cylinder, and also moves said plate supply switching means to said plate supply retreat position;

when said normal unit at the position of stoppage is located between said new plate insertion start position and said plate supply detection position, or between said plate supply switching means operating position and said plate supply switching termination position, prohibits driving of said drive device at least in a direction opposite to the plate supply direction until said manual operation switch of said normal unit is operated; and when a phase of said normal unit, which has been located between said plate supply detection position and said plate supply switching means operating position, is located at said plate supply switching means operating position during driving of said drive device by operating said drive device driving means of said error unit, stops said drive device, and prohibits driving of said drive device at least in the direction opposite to the plate supply direction until said manual operation switch of said normal unit is operated.

* * * * *